US008499595B2

(12) United States Patent
Zhang et al.

(10) Patent No.: US 8,499,595 B2
(45) **Date of Patent: *Aug. 6, 2013**

(54) CABLE WRAP SECURITY DEVICE

(75) Inventors: Ningsheng Zhang, Charlotte, NC (US); Ronald M. Marsilio, Lake Wiley, SC (US); Dennis D. Belden, Jr., Canton, OH (US)

(73) Assignee: Checkpoint Systems, Inc.

( * ) Notice: Subject to any disclaimer, the term of this patent is extended or adjusted under 35 U.S.C. 154(b) by 736 days.

This patent is subject to a terminal disclaimer.

(21) Appl. No.: 12/460,715

(22) Filed: Jul. 22, 2009

(65) Prior Publication Data

US 2009/0288460 A1 Nov. 26, 2009

Related U.S. Application Data

(63) Continuation-in-part of application No. 12/396,164, filed on Mar. 2, 2009, now Pat. No. 7,918,112, which is a continuation of application No. 11/647,014, filed on Dec. 28, 2006, now Pat. No. 7,497,101, which is a continuation of application No. 11/318,668, filed on Dec. 27, 2005, now Pat. No. 7,168,275, which is a continuation-in-part of application No. 11/023,721, filed on Dec. 28, 2004, now Pat. No. 7,162,899.

(51) Int. Cl.
*E05B 65/00* (2006.01)
*E05B 45/00* (2006.01)

(52) U.S. Cl.
USPC ..... 70/57; 70/49; 70/57.1

(58) Field of Classification Search
USPC ..... 70/14, 18, 19, 30, 57, 57.1, 58, 233; 242/382, 382.5, 384.7, 388, 396.2, 396.4
See application file for complete search history.

(56) References Cited

U.S. PATENT DOCUMENTS

| | | | |
|---|---|---|---|
| 199,468 | A | 1/1878 | Rheubottom |
| 343,849 | A | 6/1886 | Pond |
| 394,739 | A | 12/1888 | Toulmin |
| 437,548 | A | 9/1890 | Anderson |
| 596,237 | A | 12/1897 | Damon |
| 639,196 | A | 12/1899 | Fehling |
| 673,612 | A | 5/1901 | Appleby |
| 886,905 | A | 5/1908 | Ward |
| 895,403 | A | 8/1908 | Jackson |
| 1,083,612 | A | 1/1914 | Hooker |

(Continued)

FOREIGN PATENT DOCUMENTS

| | | |
|---|---|---|
| DE | 27 25 580 | 12/1977 |
| EP | 0 620 381 A1 | 10/1994 |
| SE | 123470 | 11/1948 |
| WO | WO 2006 040693 A2 | 4/2006 |

*Primary Examiner* — Christopher Boswell

(57) ABSTRACT

A security device includes a plurality of cables which are securable about an item of merchandise with a lockable cable-linking member and a cable-tightening mechanism each connected to the cables in a spaced apart manner. The cable-linking member may include a key member for unlocking the tightening mechanism. The tightening mechanism includes an internal spool and other internal members some of which are related to the locking and unlocking of the tightening mechanism. The tightening mechanism carries sense loops which typically include the cables and which if compromised actuate an onboard audible alarm. The device is configured to sound a security gate alarm upon passing through the gate and upon simply reaching a certain distance from the gate. The tightening mechanism may include a flip-up handle for rotating the spool to tighten the cable.

24 Claims, 49 Drawing Sheets

U.S. PATENT DOCUMENTS

| | | | | |
|---|---|---|---|---|
| 1,124,130 | A | 1/1915 | Grant | |
| 1,141,245 | A | 6/1915 | Gillespie | |
| 1,165,320 | A | 12/1915 | Clary | |
| 1,165,816 | A | 12/1915 | Tichenor | |
| 1,657,190 | A | 1/1928 | Ballou | |
| 1,992,868 | A | 2/1935 | Krause | |
| 2,002,946 | A | 5/1935 | Jacobs | |
| 3,395,555 | A | 8/1968 | Hickman | |
| 3,397,849 | A | 8/1968 | Hansen | |
| 3,466,668 | A | 9/1969 | Ochiai | |
| 3,568,902 | A | 3/1971 | Highberger | |
| 3,611,760 | A | 10/1971 | Muther | |
| 3,831,407 | A | 8/1974 | Coleman | |
| 3,906,758 | A | 9/1975 | Hurwitt | |
| 3,929,300 | A | 12/1975 | Lindqvist | |
| 4,004,440 | A | 1/1977 | Dreyer | |
| 4,071,023 | A | 1/1978 | Gregory | |
| 4,086,795 | A | 5/1978 | Foster et al. | |
| 4,136,843 | A | 1/1979 | Gourley | |
| 4,418,551 | A | 12/1983 | Kochackis | |
| 4,756,171 | A | 7/1988 | Homar | |
| 4,823,465 | A | 4/1989 | Collins | |
| 4,896,517 | A | 1/1990 | Ling | |
| 4,930,324 | A | 6/1990 | Meier | |
| 4,949,679 | A | 8/1990 | Wolfer | |
| 5,144,821 | A | 9/1992 | Ernesti et al. | |
| 5,156,028 | A | 10/1992 | Jiang | |
| 5,178,619 | A | 1/1993 | Galazaka | |
| 5,193,368 | A | 3/1993 | Ling | |
| 5,345,947 | A | 9/1994 | Fisher | |
| 5,379,496 | A | 1/1995 | Krauss | |
| 5,517,836 | A | 5/1996 | Hong | |
| 5,551,447 | A | 9/1996 | Hoffman et al. | |
| 5,581,853 | A | 12/1996 | Miller et al. | |
| 5,598,727 | A | 2/1997 | White | |
| 5,610,587 | A | 3/1997 | Fujiiuchi et al. | |
| 5,671,506 | A | 9/1997 | Eliasson | |
| 5,687,455 | A | 11/1997 | Alexander | |
| 5,687,456 | A | 11/1997 | Chang | |
| 5,722,266 | A | 3/1998 | Yeager et al. | |
| 5,794,464 | A | 8/1998 | Yeager et al. | |
| 5,856,782 | A | 1/1999 | Sasagawa et al. | |
| 5,960,652 | A | 10/1999 | Marmstad | |
| 6,092,401 | A | 7/2000 | Sankey et al. | |
| 6,128,932 | A | 10/2000 | Mainetti et al. | |
| 6,237,375 | B1 | 5/2001 | Wymer | |
| 6,550,293 | B1 | 4/2003 | Delagato et al. | |
| 6,755,055 | B2 | 6/2004 | Sedon et al. | |
| 7,162,899 | B2 | 1/2007 | Fawcett et al. | |
| 7,168,275 | B2 | 1/2007 | Fawcett et al. | |
| 7,251,966 | B2 * | 8/2007 | Fawcett et al. | 70/57 |
| 7,350,381 | B2 * | 4/2008 | Fawcett et al. | 70/57 |
| 7,481,086 | B2 * | 1/2009 | Fawcett et al. | 70/57 |
| 7,497,100 | B2 * | 3/2009 | Fawcett et al. | 70/57 |
| 7,497,101 | B2 | 3/2009 | Fawcett et al. | |
| 7,918,112 | B2 * | 4/2011 | Fawcett et al. | 70/57 |
| 7,984,629 | B2 * | 7/2011 | Xiaobin | 70/57 |
| 2003/0182763 | A1 | 10/2003 | Jeffries | |
| 2008/0034815 | A1 | 2/2008 | Fawcett | |

* cited by examiner

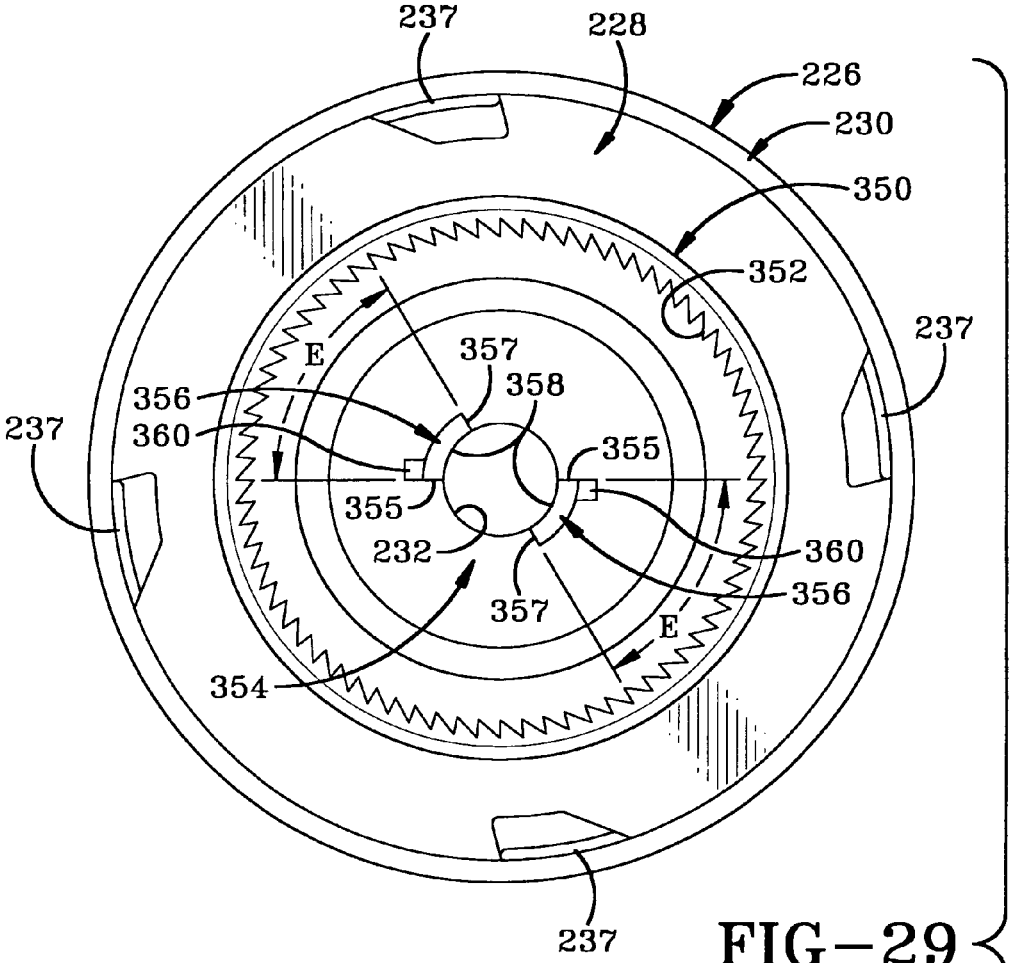
FIG–29
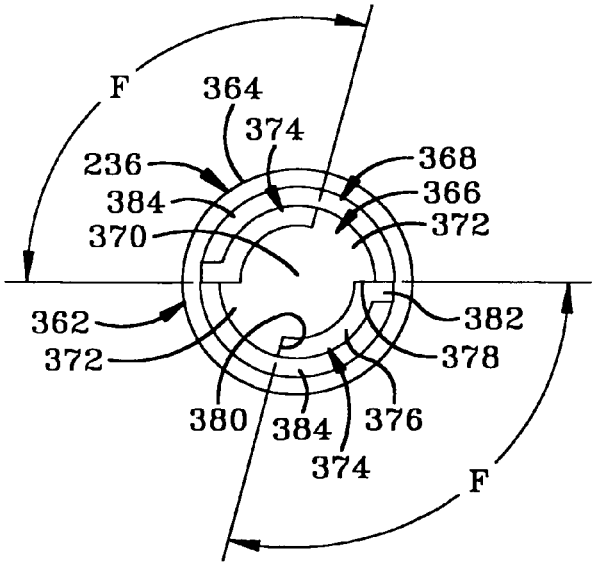

CABLE WRAP SECURITY DEVICE

CROSS REFERENCE TO RELATED APPLICATIONS

This application is a continuation-in-part of U.S. patent application Ser. No. 12/396,164, filed Mar. 2, 2009, which is a continuation of U.S. patent application Ser. No. 11/647,014, filed Dec. 28, 2006, now U.S. Pat. No. 7,497,101, which is a continuation of U.S. patent application Ser. No. 11/318,668, filed Dec. 27, 2005, now U.S. Pat. No. 7,168,275, which is a continuation-in-part of U.S. patent application Ser. No. 11/023,721, filed Dec. 28, 2004, now U.S. Pat. No. 7,162,899; the disclosures of which are incorporated herein by reference.

BACKGROUND OF THE INVENTION

1. Technical Field

The invention relates to a security device, and more particularly to an adjustable security device which wraps around and secures a box-like structure in a secure locked position. Even more particularly, the invention relates to such a cable security device which includes a plurality of wires or cable that wrap around the article to be protected and has an unique ratchet mechanism for tightening the cable around the article of merchandise and a quick release locking mechanism, and which has an attached key for unlatching the ratchet mechanism.

2. Background Information

Retail stores have a difficult time protecting boxes containing various expensive merchandise, books and other similarly structured packages, or protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Boxes and box-like structures are also subjected to unauthorized openings while being shipped via a courier. These articles can be easily opened and resealed when packaged and taped-shut in the conventional manner without the recipient or the sender knowing of such actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Few prior art locking devices have adequately solved this problem of securing packages or objects in a closed condition while being displayed in retail stores or shipped from one location to another. Some prior art security devices include a wire which wraps around an article and is secured by some type of locking mechanism. For example, see U.S. Pat. Nos. 3,611,760, 4,418,551, 4,756,171, 4,896,517, 4,930,324, 5,156,028, 5,794,464, and 6,092,401.

The particular security device shown in U.S. Pat. No. 5,794,464 has proven satisfactory, but requires a special tool to operate the latch mechanism, both for tightening the cable about the object to be protected and to release the latch mechanism after the security device has been removed from the package to enable the internal mechanism on which the cable is wound to be free-wheeling in order to be pulled outwardly to a larger size for placement around another package. This separate and specially designed key becomes a problem in that it can become lost or stolen and must always be associated with and manipulated for operating the security device.

Furthermore, the ratchet mechanism of U.S. Pat. No. 5,794,464 as well as the other known cable wrap ratchet-actuated security devices can be defeated by excessive force or manipulation of the ratchet device and/or of the package being protected, which could go undetected by the store personnel.

Therefore, the need exists for a cable wrap security device which includes a ratchet member and a locking member which does not require any special tool to tighten the cable about a package, in which part of the lock mechanism forms the tool for unlatching the ratchet mechanism to provide for the free-wheeling of the internal spool thereof, and in which the ratchet member can be provided with an internal audible alarm which will be actuated if the integrity of the security device is compromised or the protected article stolen from the retail store.

BRIEF SUMMARY OF THE INVENTION

The present invention provides a security device comprising: a housing; a first cable; a spool within the housing which is rotatable about a vertical axis in a cable-tightening direction to wind the cable thereon and rotatable in an opposite cable-loosening direction to unwind the cable therefrom; a first internal member within the housing which is movable relative to the housing between a lowered locked position which prevents rotation of the spool in the cable-loosening direction and a raised unlocked position which allows rotation of the spool in the cable-loosening direction; a spring which biases the first internal member downwardly to the locked position so that an upward force is required to overcome the downward spring bias to move the first internal member from the locked position to the unlocked position; and an interference member within the housing which selectively prevents movement of the first internal member from the locked position to the unlocked position.

The present invention also provides a security device comprising: a housing; a first cable; a spool within the housing which is rotatable about a vertical axis in a cable-tightening direction to wind the cable thereon and rotatable in an opposite cable-loosening direction to unwind the cable therefrom; a first internal member within the housing which is movable relative to the housing between a lowered locked position which prevents rotation of the spool in the cable-loosening direction and a raised unlocked position which allows rotation of the spool in the cable-loosening direction; a second internal member within the housing which rotates with the spool relative to the first internal member and which is movable upwardly and downwardly relative to the spool and housing; and an interference member which selectively engages the first internal member to prevent upward movement of the first and second internal members.

The present invention further provides a security device comprising: a housing; a first cable; a spool within the housing which is rotatable about a vertical axis in a cable-tightening direction to wind the cable thereon and rotatable in an opposite cable-loosening direction to unwind the cable therefrom; an interference member within the housing; a downwardly facing surface on the interference member; a first internal member within the housing which is movable relative to the housing between a lowered locked position which prevents rotation of the spool in the cable-loosening direction and a raised unlocked position which allows rotation of the spool in the cable-loosening direction; and an upwardly facing surface on the first internal member; wherein the first internal member is rotatable between a first position in which the upwardly facing surface is directly below the downwardly facing surface whereby engagement of the upwardly and downwardly facing surfaces prevents movement of the first internal member from the locked position to the unlocked position and a second position in which the upwardly facing surface is not directly below the downwardly facing surface whereby the first internal member is movable from the locked position to the unlocked position.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 29 is an exploded top view of the housing and the locking disk of the second embodiment.

Similar numbers refer to similar parts throughout the drawings.

DETAILED DESCRIPTION OF THE INVENTION

Figure 1:
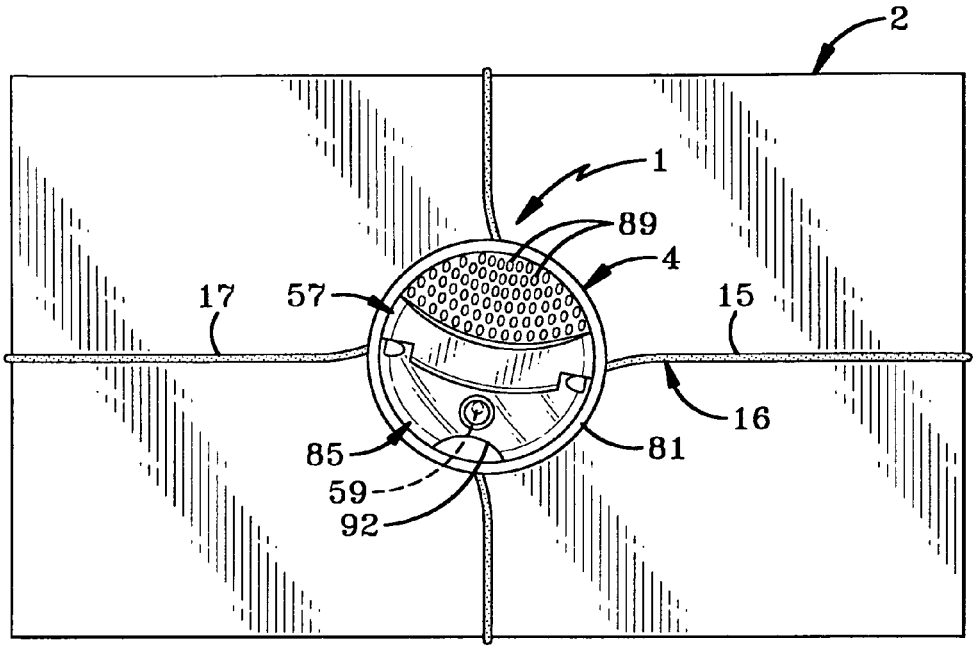
FIG. 1 is a diagrammatic plan view showing the security device of the present invention secured on a package.
Figure 2:
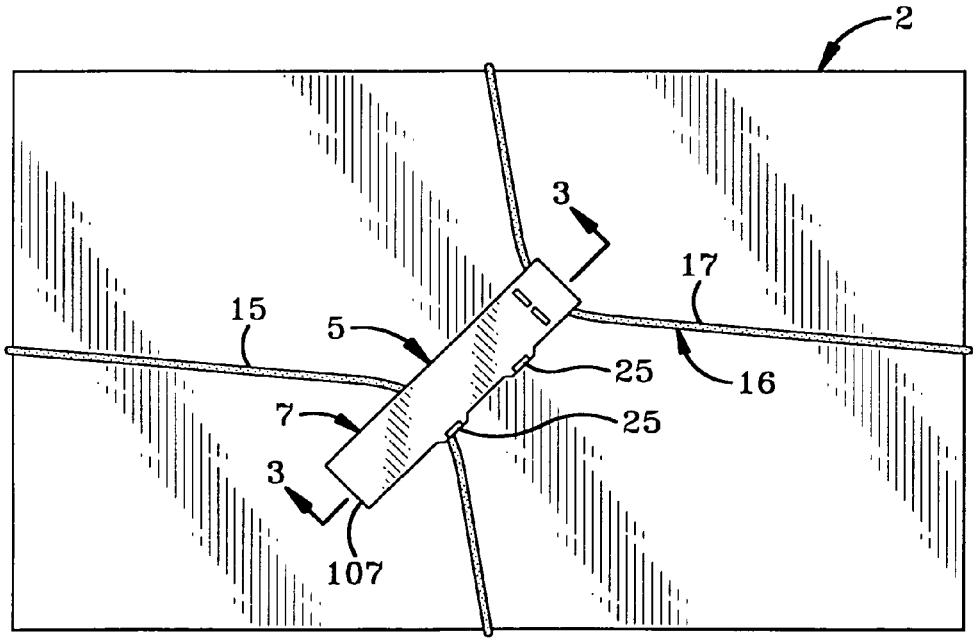
FIG. 2 is a view similar to FIG. 1 showing the locking member of the security device located on the opposite side of the package from that of the ratchet mechanism shown in FIG. 1.
Figure 47:
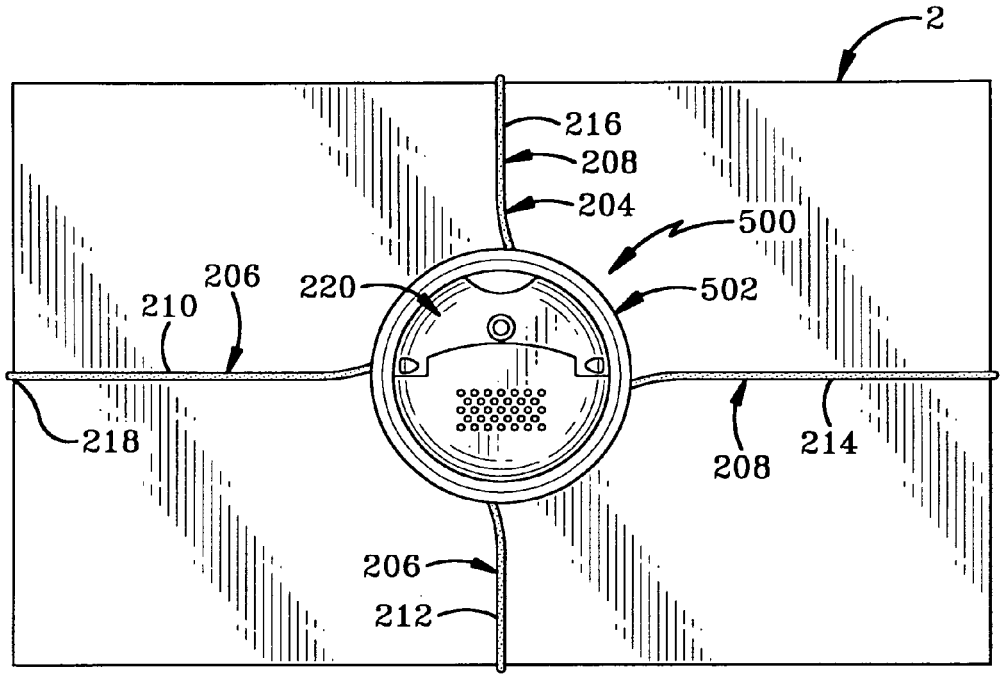
FIG. 47 is a diagrammatic plan view similar the third embodiment of the security device secured on a package showing the tightening mechanism on one side of the package.
Figure 48:
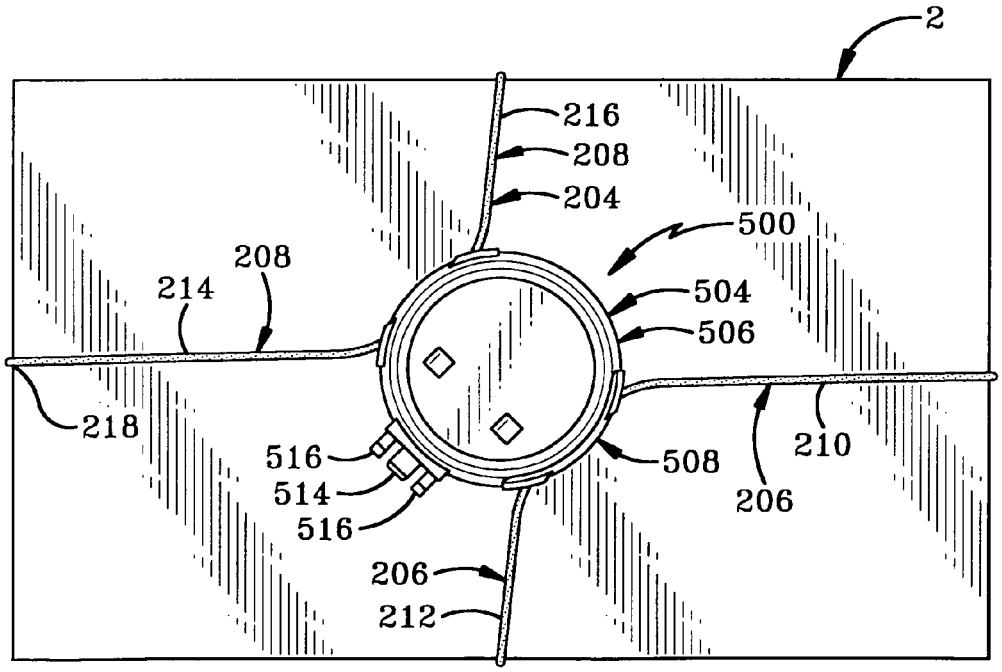
FIG. 48 is a view similar to FIG. 47 showing the key member/lockable cable-linking member on the opposite side of the package from that of the tightening mechanism shown in FIG. 47.
Figure 49:
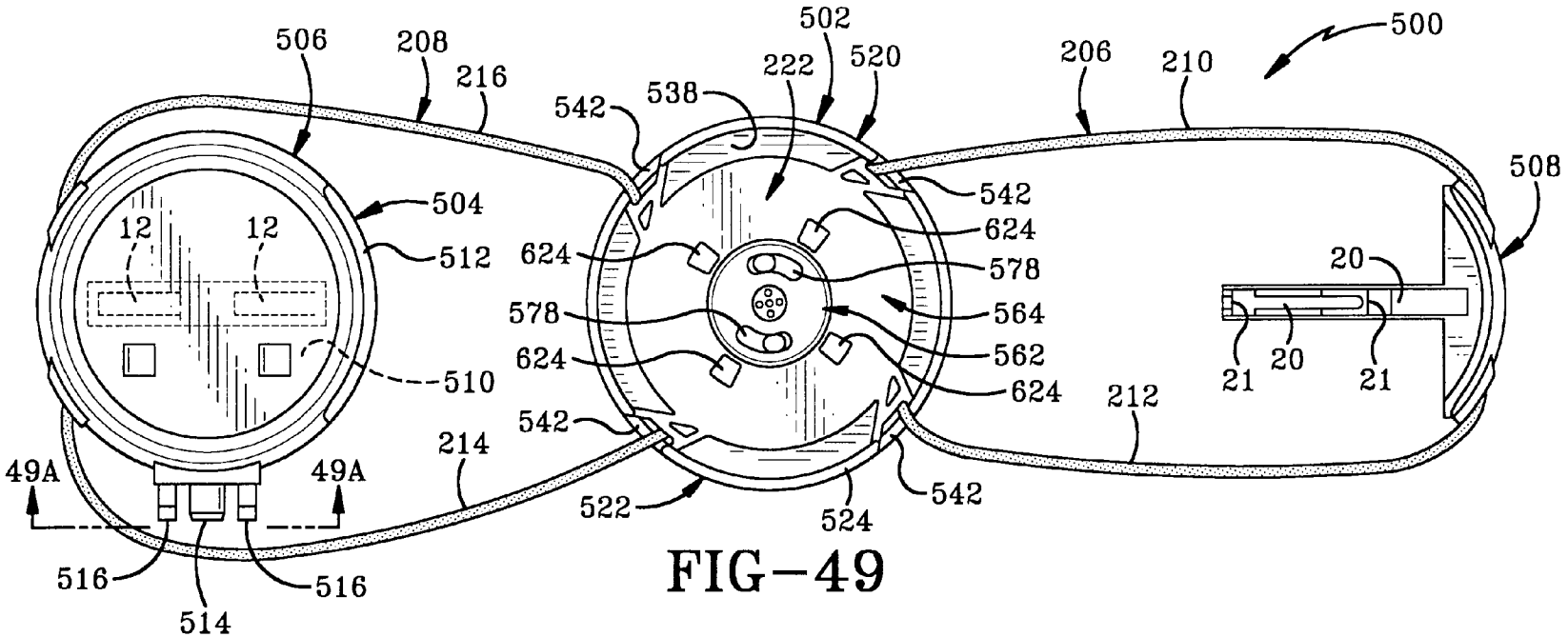
FIG. 49 is a diagrammatic view of the third embodiment in an unsecured position which shows the base and fastener of the cable-linking member unlocked and released from one another.
Figure 49A:
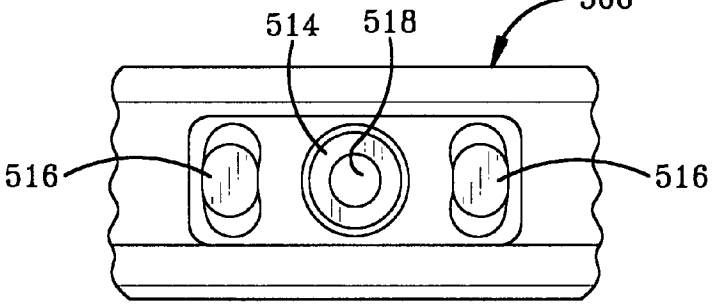
FIG. 49A is a side elevational view of the cable-linking member which serves as an end elevational view of the key member.

A first embodiment of the security device of the present invention is indicated generally at 1, and is shown in FIGS. 1 and 2 secured about a package 2; a second embodiment of the security device is indicated generally at 200 in FIGS. 17-20; and a third embodiment of the security device in indicated generally at 500 in FIGS. 47-49. Security device 1 includes two main components, a ratchet mechanism and a locking member indicated generally at 4 and 5, respectively.

Figure 3:
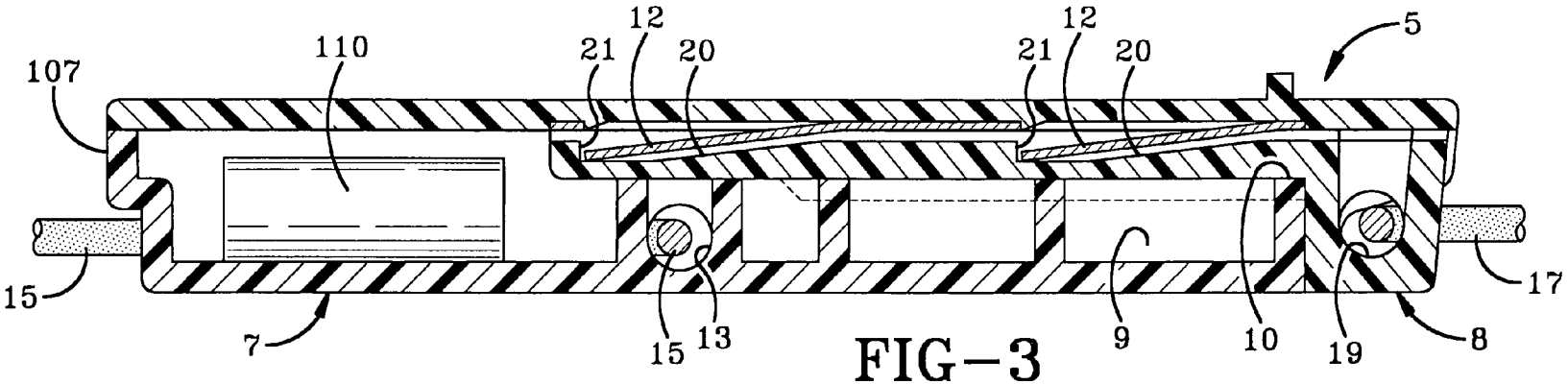
FIG. 3 is an enlarged sectional view taken on line 3-3, FIG. 2 showing the locking member in a locked position.
Figure 4:
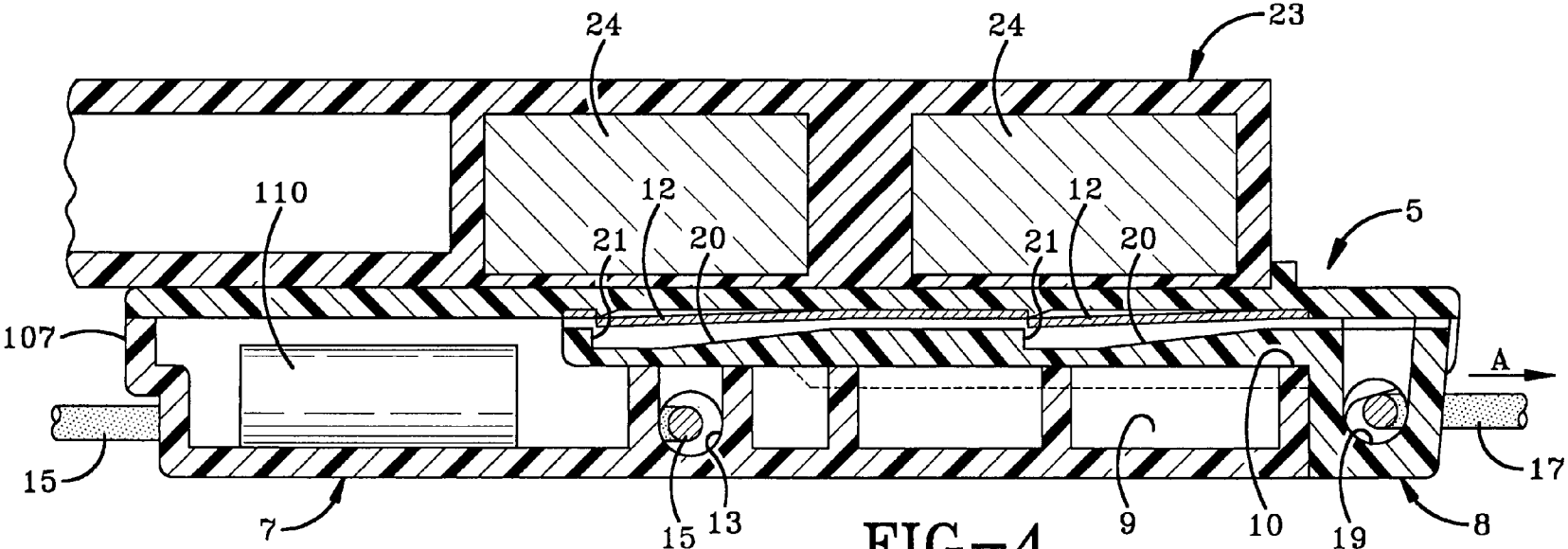
FIG. 4 is a view similar to FIG. 3 showing a magnetic key unlocking the locking member.
Figure 5:
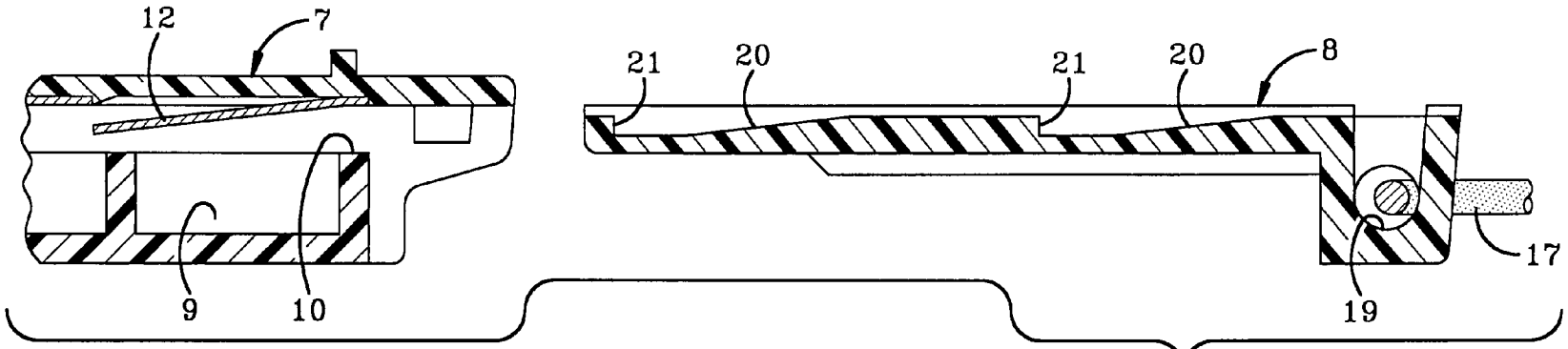
FIG. 5 is a sectional view showing the two-piece locking member in a disengaged unlocked position.

Locking member 5 shown particularly in FIGS. 3-5, is a two-piece member consisting of a base 7 and a fastener 8. Base 7 preferably is an elongated member formed of rigid plastic having an internal chamber 9 and an entrance opening 10. A pair of metal tines 12 are mounted within chamber 9 and are biased inwardly as shown particularly in FIG. 3. Base 7 is formed with a through opening 13 through which extends a first cable loop 15, which is one portion of the securing cable collectively indicated at 16.

Fastener 8 is an elongated member preferably formed of rigid plastic, and has another cable loop 17 extending through an opening 19 formed in one end of the fastener. Fastener 8 is formed with a pair of angled recesses 20 which terminate in shoulders 21 which are engaged by the distal ends of metal tines 12 when fastener 8 is inserted into base 7 as shown in FIG. 3, to secure fastener 8 in a locked position within base 7. Fastener 8 cannot be withdrawn toward the unlocking position as shown in FIG. 5, due to the engagement of the distal ends of metal tines 12 with shoulders 21. However, locking member 5 is opened easily by a clerk at the checkout counter of a retail store by placement of a magnetic key 23 in a controlled position on base 7. Key 23 contains a pair of magnets 24 and are positioned to align with a respective metal tine 12 to move the metal tines out of locking engagement with its respective shoulder 21. This enables fastener 8 to be moved in the direction of Arrow A (FIG. 4) to disengage from base 7 as shown in FIG. 5.

Locking member 5 preferably includes a pair of alignment projections 25 (FIG. 2) which align with projections on key 23 to ensure that magnetic key 23 is properly placed on member 5 so that magnets 24 accurately align with their respective metal tines 12 to move the tines to the unlocked position. This specially positioned pair of magnets 24 in relationship to the spaced tines 12, reduces the possibility of a shoplifter unlocking locking member 5 by use of a single unauthorized magnet.

Ratchet mechanism 4 (FIGS. 7-13) includes a housing 27 which has a cylindrical side wall 28 and a stepped bottom wall 29. Bottom wall 29 (FIG. 9) has a first raised cylindrical surface 30 and a lower concentric cylindrical surface 31, with a plurality of one-way gear teeth 32 being formed on a connecting surface extending between surfaces 30 and 31 and extending circumferentially thereabout. Four openings 34 are formed in side wall 28 and upper cylindrical surface 30 for the passage of securing cable 16 therethrough as discussed further below. A large circular central opening 36 is formed in bottom wall 29 for receiving a pawl release plate 37 therein. Housing 27 preferably is a one-piece member formed of a rugged plastic material.

Ratchet mechanism 4 further includes a spool indicated generally at 40 (FIGS. 12 and 13), which includes a central hub 41 and first and second spaced flanges 42 and 43 extending outwardly therefrom and spaced from each other for capturing cable 16 therebetween when the cable loops 15 and 17 are tightened about package 2. Spool 40 preferably is a one-piece member molded of a rigid plastic material and cable 16 preferably is comprised of the two cable sections or loops 15 and 17. A circular central recess 45 (FIG. 9) is formed in flange 43 and contains a printed circuit board 46 which includes the necessary electronic circuitry (not shown) well-known in the art, for providing an alarm system discussed further below. Four slotted holes 48 are formed in flange 43 and communicate with cable openings 34 for inserting enlarged ends 49 of cable loops 15 and 17 therethrough. Ends 49 are metallic and are received within small compartments 51 formed on circuit board 46, where they are connected to the electric circuitry of circuit board 46 by conductors 52. Three of the four cable enlarged ends 49 are shown seated within their respective compartments 51 and are connected to circuit board 46 by conductors 52.

The alarm system further includes an audible alarm having a speaker 54 (FIG. 9) which is mounted within a complimentary shaped circular recess 55 formed on the inside surface of a top wall portion 57, which is another of the main components of ratchet mechanism 4. Speaker 54 is connected to circuit board 46 by a pair of conductors 58. The alarm system further includes a LED 59 which aligns with a hole 60 formed in top wall portion 57. LED 59 is connected in the alarm circuitry and preferably provides a blinking action which indicates that the alarm system is operating serving as a deterrent to a possible shoplifter.

Figure 14:
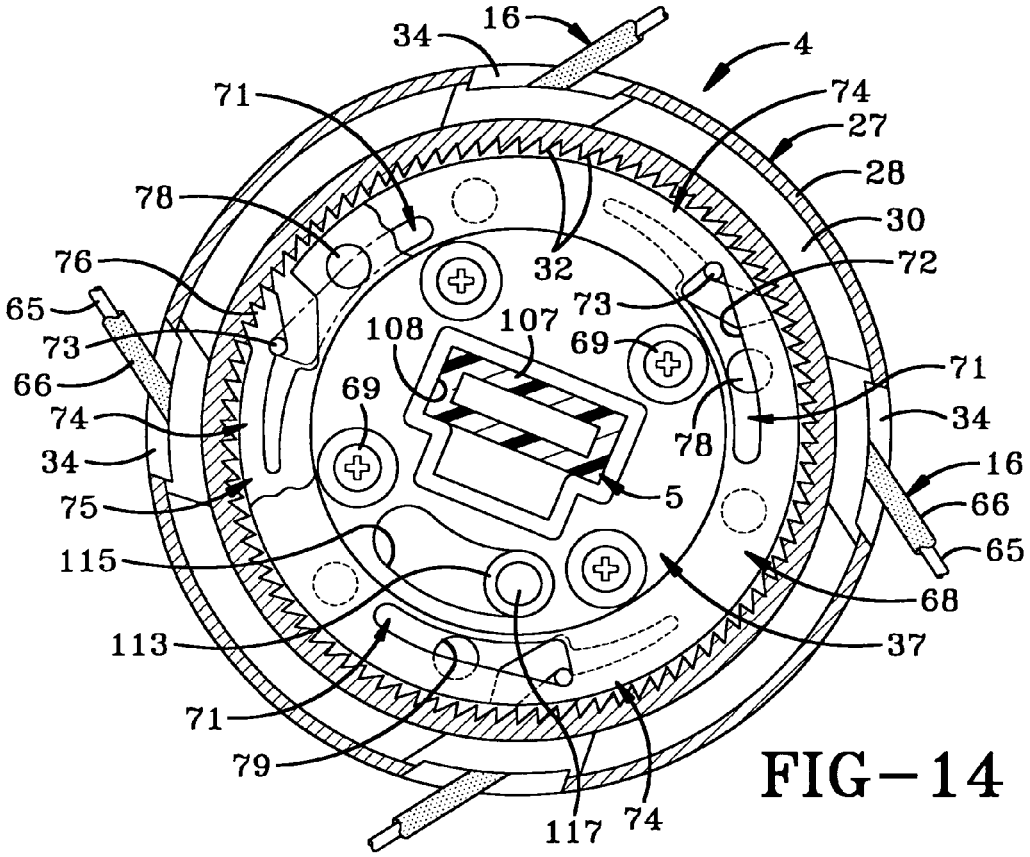
FIG. 14 is a bottom plan view of the ratchet mechanism with portions broken away and in section, showing the end of the locking member base engaged with the pawl release bottom plate of the ratchet mechanism.
Figure 15:
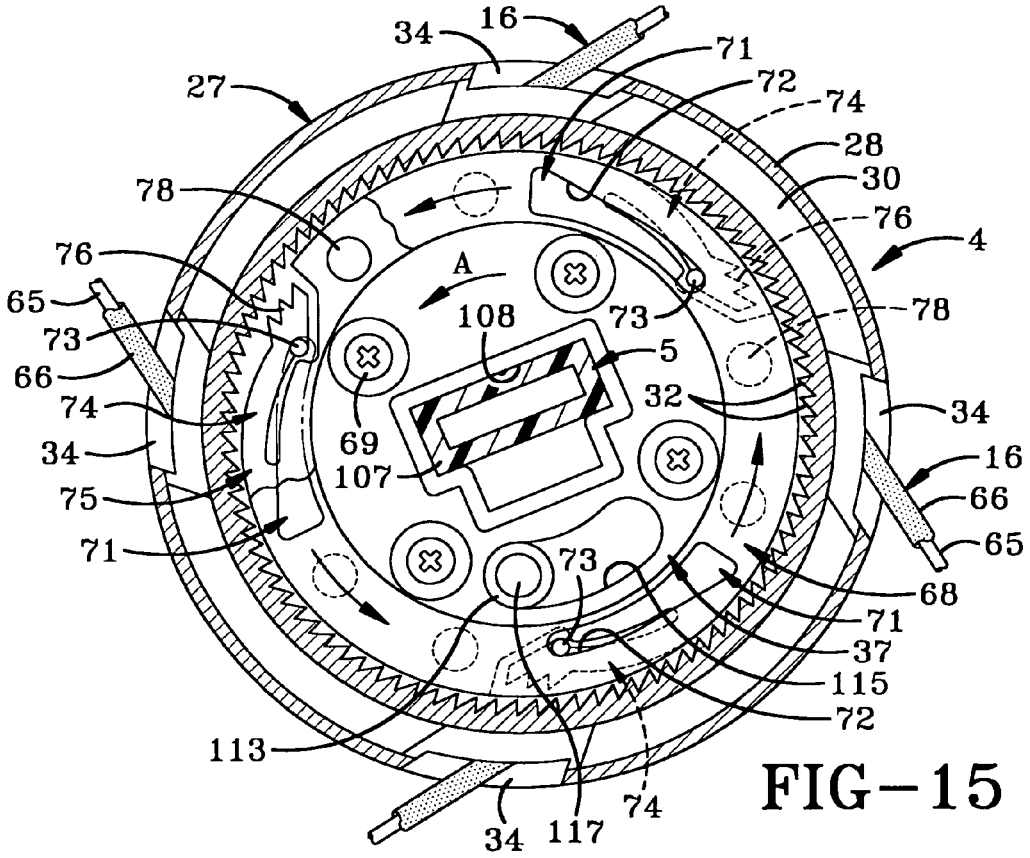
FIG. 15 is a view similar to FIG. 14 showing the bottom plate of the ratchet mechanism moving the locking pawls of the gear disc out of engagement with the gear teeth of the gear housing to place the cable spool in a free wheeling position.

In further accordance with the invention, the alarm system includes a sense loop which extends through the cable loops 15 and 17 by the electrical connection of enlarged ends 49 with circuit board 46 through conductors 52. The alarm system sends a series of pulses or maintains a constant flow of electrical energy through the cables by power supplied by a battery 62 (FIG. 12) which is located within a complimentary shaped recess 63 formed within the central opening of flange 42. Battery 62 is connected to the circuitry of circuit board 46 by a metallic connector 64. Thus, the alarm system contained within ratchet mechanism 4, provides a continuous sensing loop extending through the cables, which as shown in FIGS. 14 and 15, will include an inner metallic conductor 65 covered by a layer of insulation 66. Cable loops 15 and 17 provide the necessary mechanical strength for securing security device 1 about package 2, as well as the electrical circuitry to provide a sensing loop, which if compromised in any manner, such as cutting through one of the cable conductors 65 or pulling it loose from its connection to the printed circuit board, will actuate the audible alarm alerting store personnel of the unauthorized tampering of security device 1.

Figure 12:
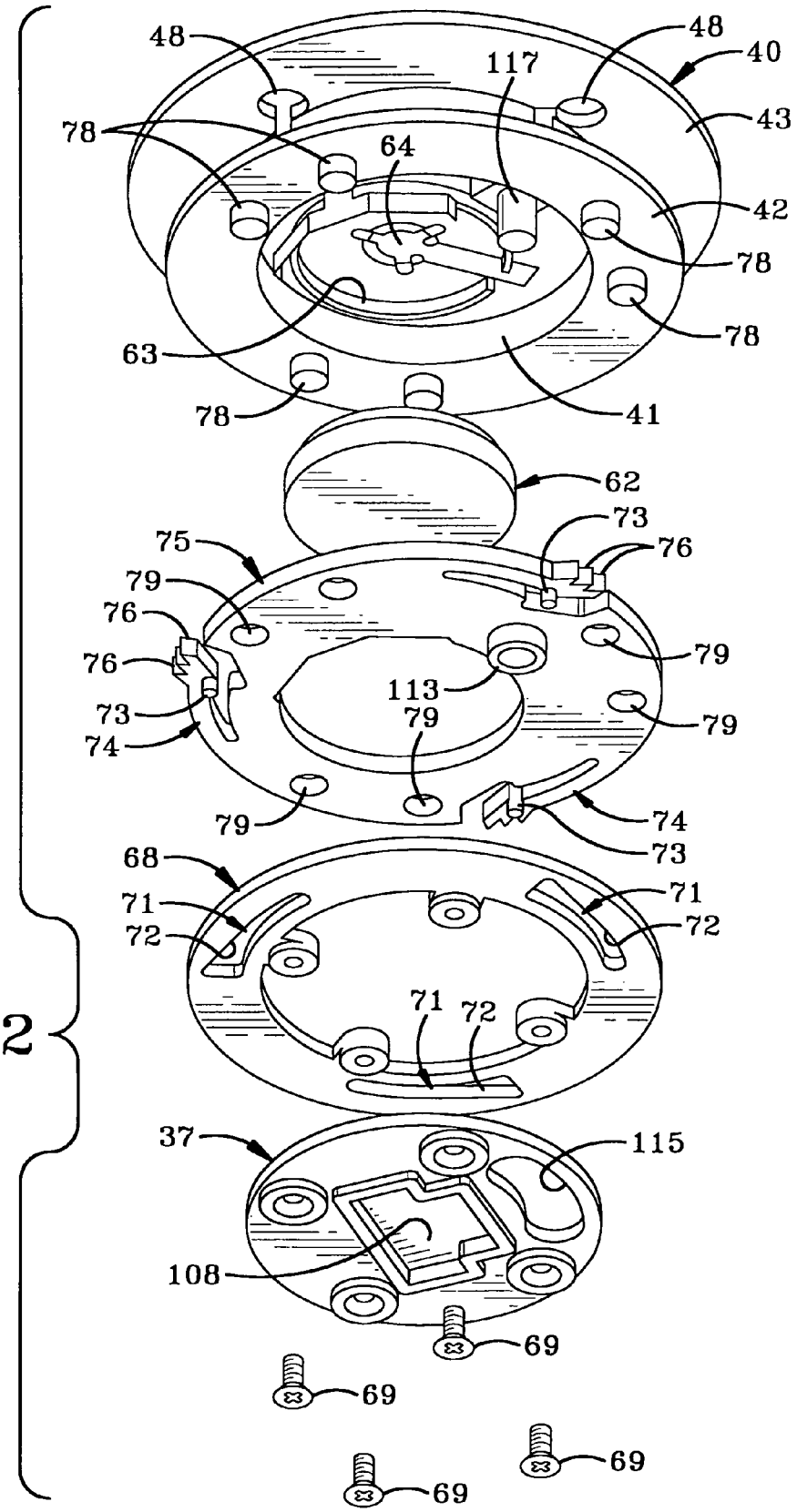
FIG. 12 is an exploded perspective view of various components of the ratchet mechanism.

Ratchet mechanism 4 further includes a locking disc indicated generally at 68 (FIG. 12), which is secured to pawl release plate 37 by a plurality of screws 69 so as to rotate with plate 37. Locking disc 68 is formed with a plurality of arcuate camming slots 71 (FIG. 11) spaced equally circumferentially about disc 68, in which are received a respective camming projection 73 formed on a locking pawl 74, three of which are formed on a gear disc indicated generally at 75 (FIG. 12). Each locking pawl 74 includes one or more locking teeth 76 formed on the distal end of the lever-like arm which forms locking pawl 74. Gear disc 75 is mounted on flange 42 of spool 40 by a plurality of projections or circular tabs 78, six of which are shown in the drawing, which extend through aligned holes 79 formed in gear disc 75, whereby gear disc 75 is rotatable with spool 40. Gear disc 75 is operatively connected to locking disc 68 only through the engagement of camming projections 73 extending into camming slots 71 as discussed further below.

Top wall portion 57 of ratchet mechanism 4 is rotatably mounted within a top opening of housing 27 by a lock ring 81 (FIGS. 7 and 8), which preferably is attached to housing side wall 28 by a sonic weld, an adhesive, etc. Three bosses 83 (FIG. 9) are formed on and extend outwardly from the bottom surface of top wall portion 57 and extend through aligned holes 48 formed in spool flange 43 to operationally connect top wall portion 57 with spool 40, whereby rotation of top wall portion 57 will rotate spool 40 therewith.

Figure 7:
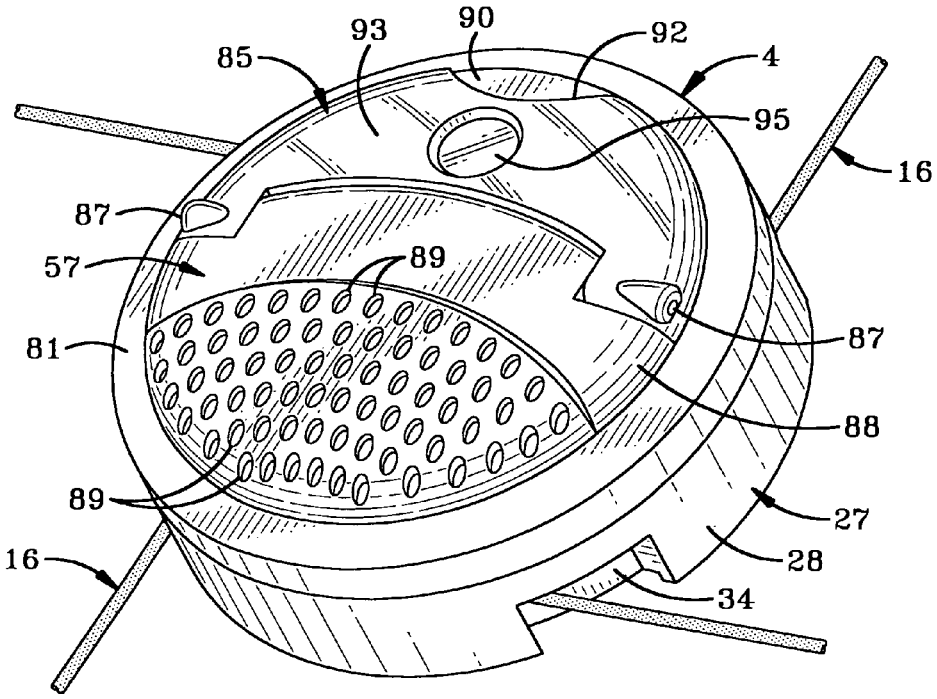
FIG. 7 is a top perspective view of the ratchet mechanism with the flip-up handle in a down inoperative position.
Figure 8:
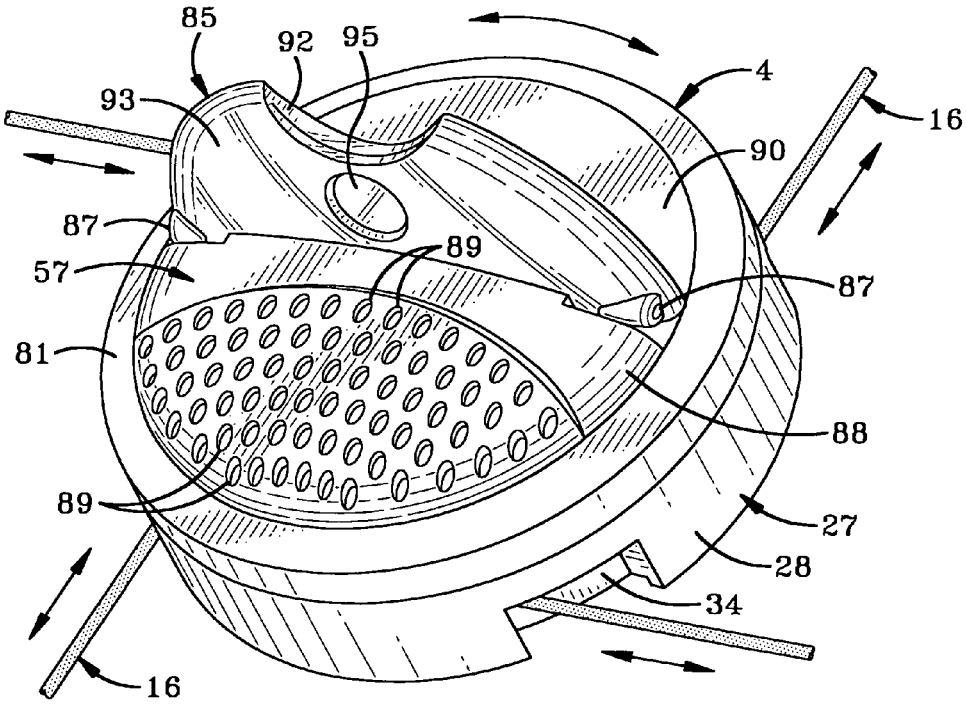
FIG. 8 is a view similar to FIG. 7 with the flip-up handle in a raised operating position.
Figure 9:
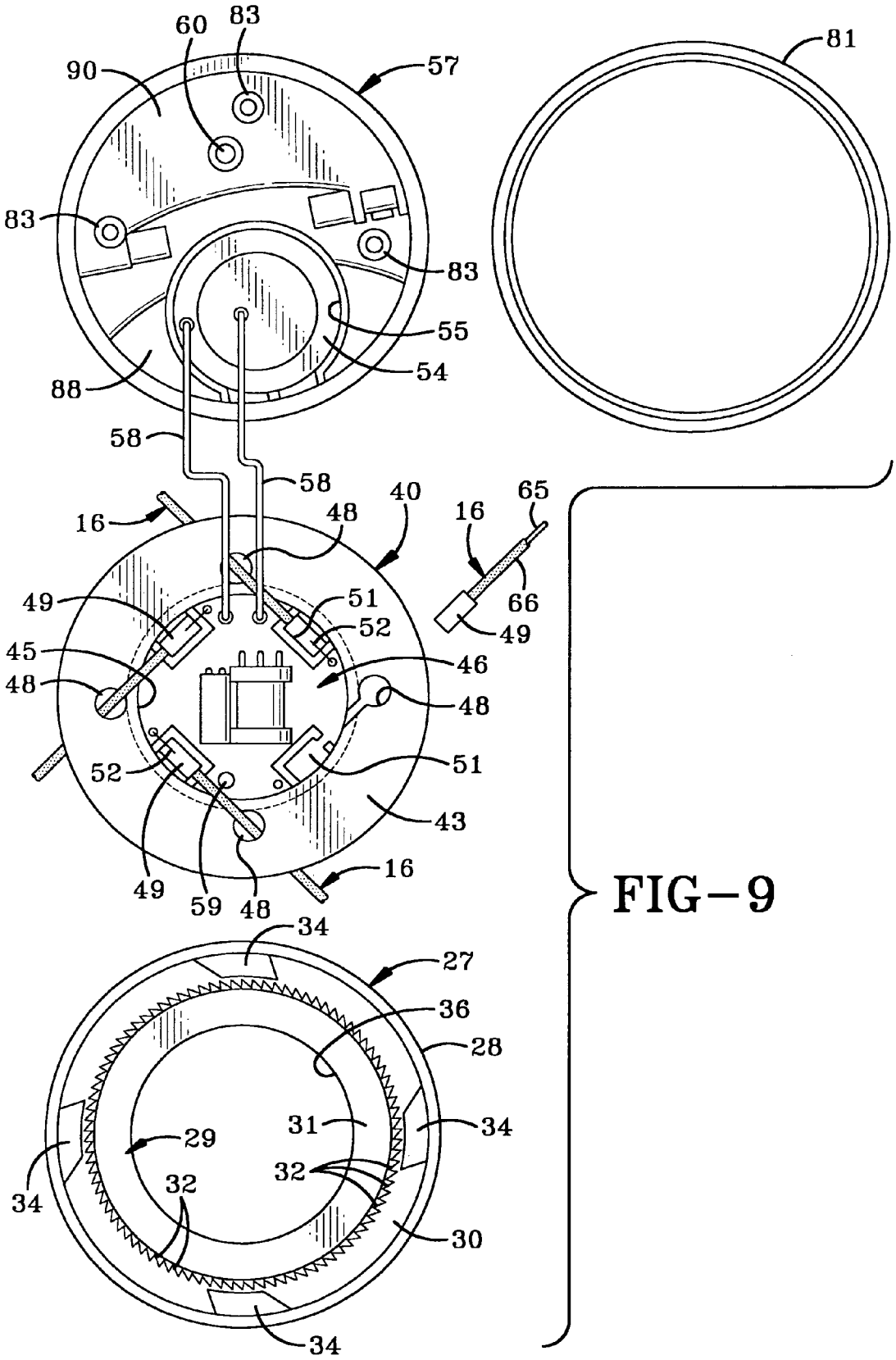
FIG. 9 is an exploded view of portions of the housing, cable spool, top wall cover plate, gear housing and lock ring of the ratchet mechanism.
Figure 10:
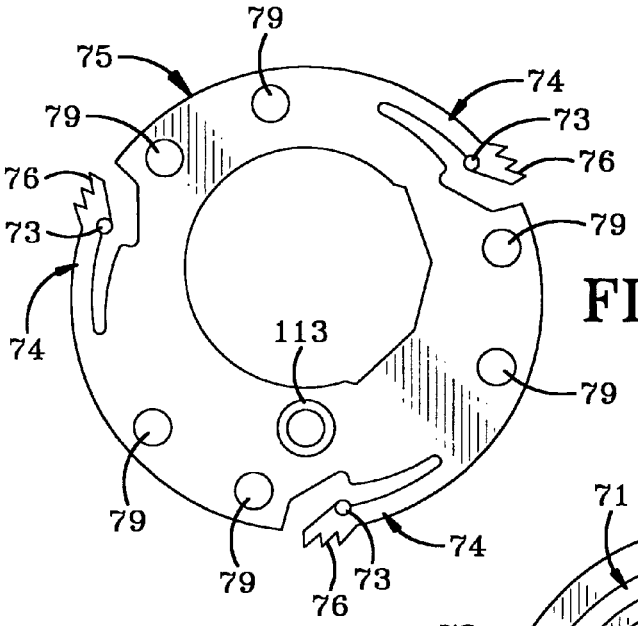
FIG. 10 is a bottom plan view of the gear disc removed from the ratchet mechanism spool.
Figure 11:
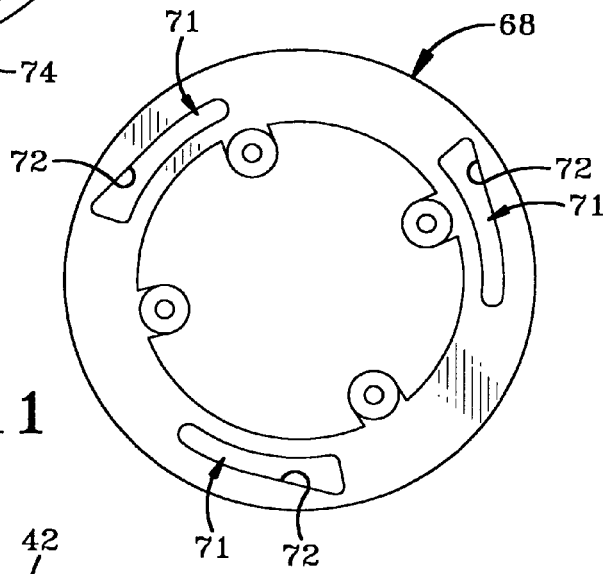
FIG. 11 is a bottom plan view of the locking disc removed from the ratchet mechanism spool.
Figure 13:
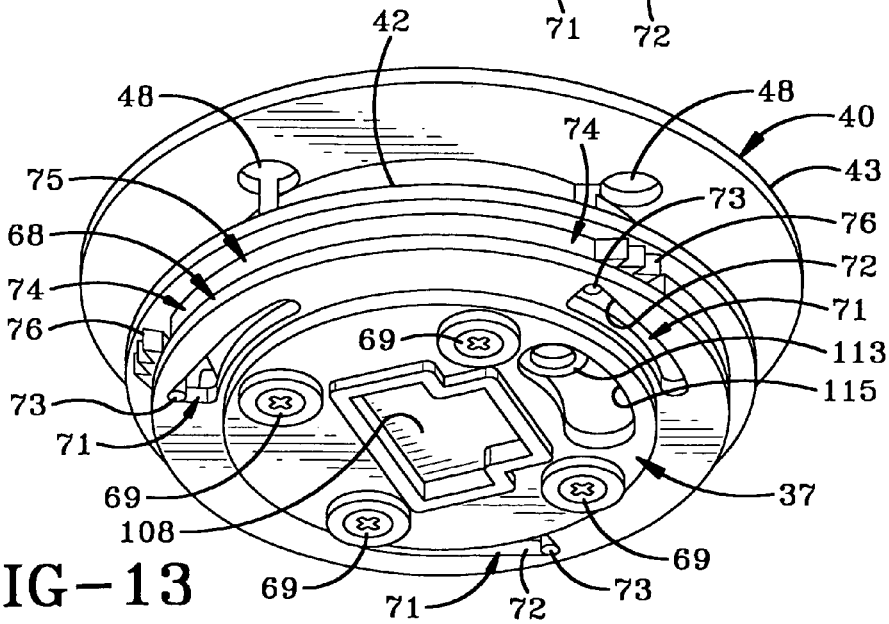
FIG. 13 is an assembled view of the ratchet mechanism components shown in FIG. 12.

In accordance with one of the features of the present invention, a flip-up handle indicated generally at 85, is mounted on top wall portion 57 and is moved from a down generally inoperative position as shown in FIG. 7, to a raised operative position as shown in FIG. 8. Handle 85 is pivotally mounted by a pair of pivot pins 87 to a half dome-shaped portion 88 of top wall portion 57. A plurality of perforations or holes 89 preferably are formed in dome-shaped portion 88 and align with the audible alarm speaker 54 mounted adjacent thereto as shown in FIG. 9. A generally planar semicircular portion 90 forms the other half of top wall portion 57 and receives the flip-up handle 85 when the handle is in the down position as shown in FIG. 7. Handle 45 preferably is formed with a concave finger grasping area 92 so that a user can easily grasp the flip-up handle for moving it between the down position of FIG. 7 to the operable position of FIG. 8. Handle 85 preferably has a smooth curved top surface 93, having a curvature generally matching that of half dome-shaped portion 88, to provide for a smooth attractive appearance to the ratchet mechanism so that it does not distract appreciably from a merchandise display box when secured thereon.

In accordance with another feature of the invention, flip-up handle 85 may be formed of a transparent material and will have a circular lens 95 in the center thereof which aligns with LED 59 when in the down position of FIG. 7. This will help distribute the light of the LED throughout the length of the handle, making it more visible to a perspective shoplifter and to indicate to the store personnel that the alarm system is activated. This translucent or clear plastic construction of handle 85 further increases the esthetics of the ratchet mechanism.

Figure 16:
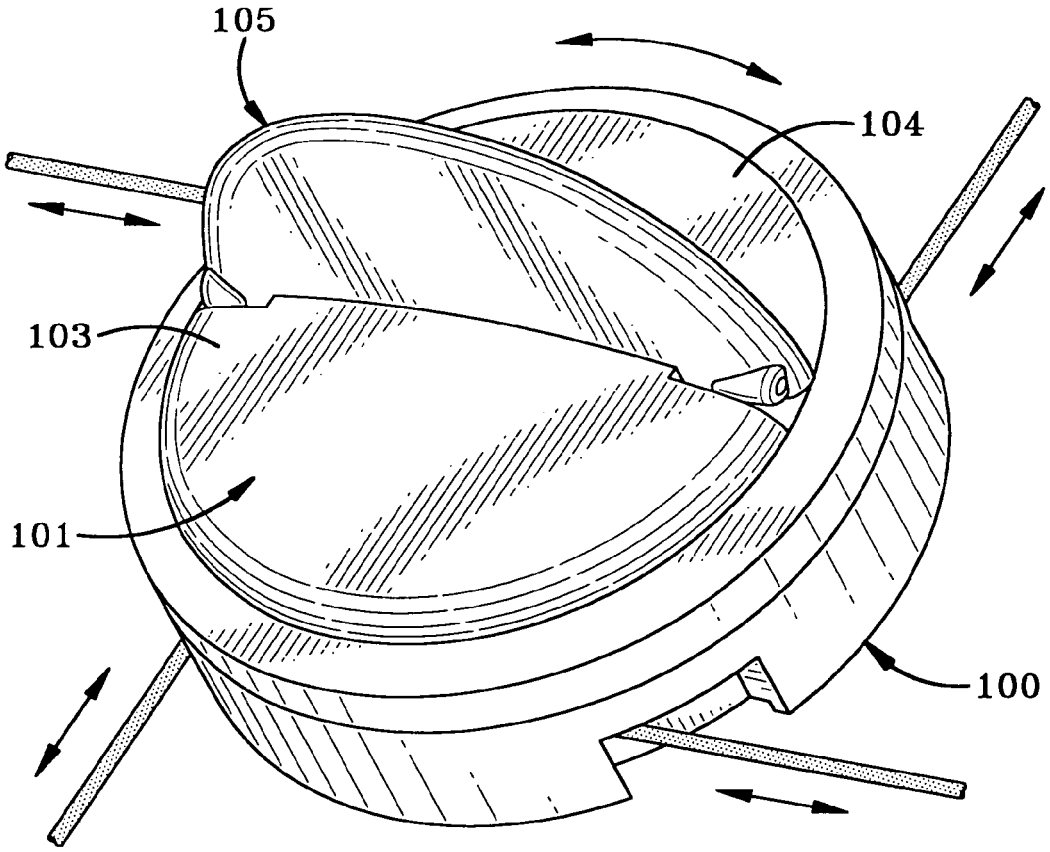
FIG. 16 is a perspective view similar to FIG. 7 of a modified ratchet mechanism with the flip-up handle in a raised operating position.
Figure 17:
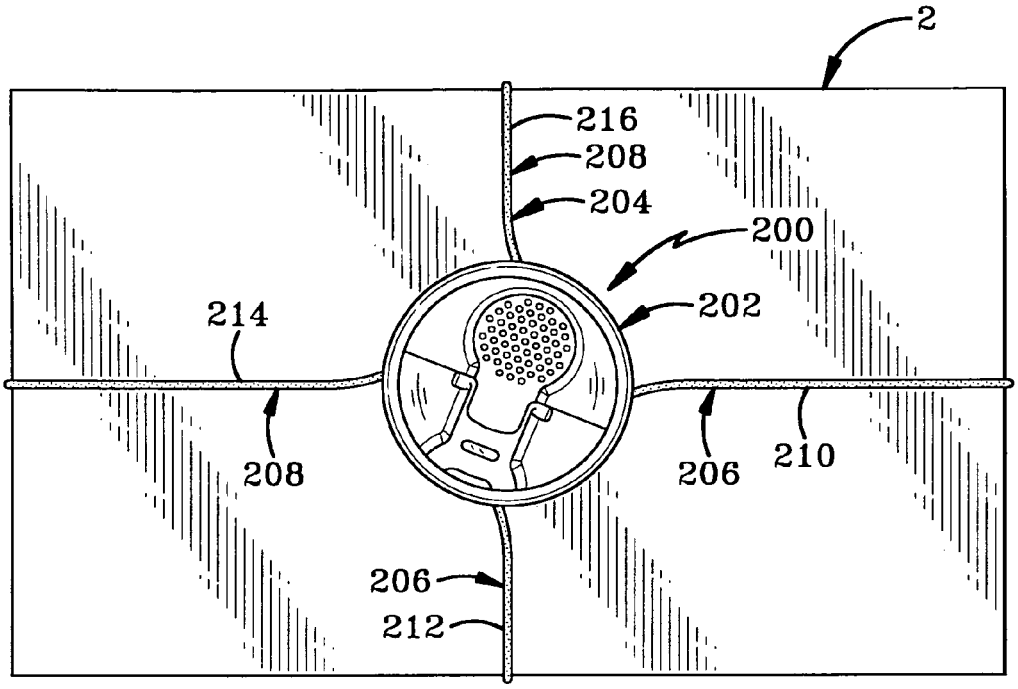
FIG. 17 is a diagrammatic plan view of a second embodiment of the security device secured on a package showing the ratchet mechanism on one side of the package.
Figure 18:
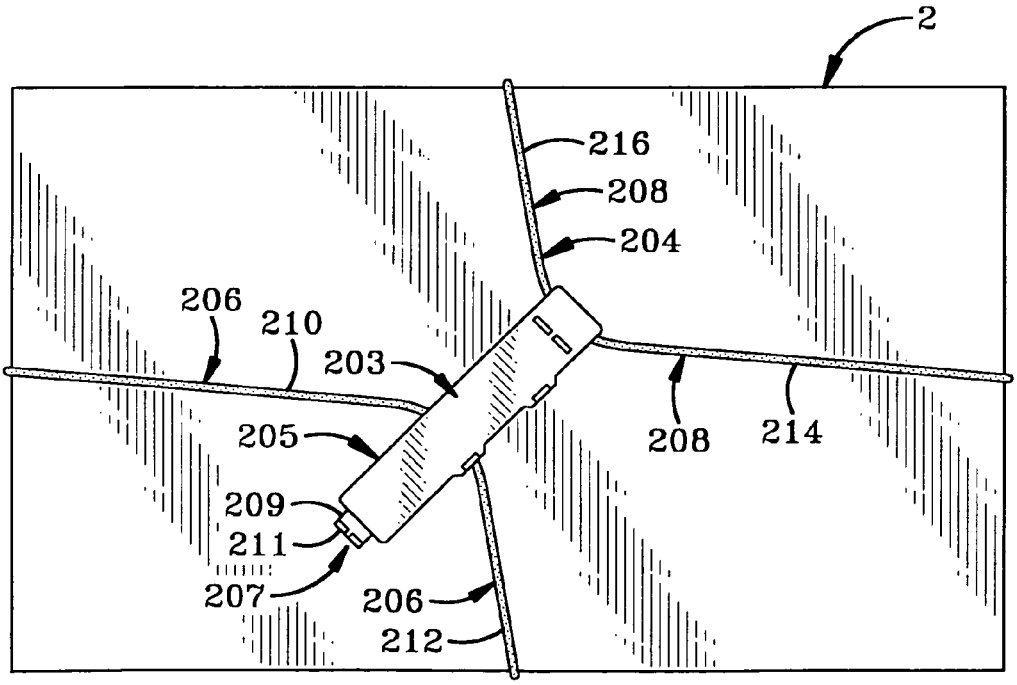
FIG. 18 is a view similar to FIG. 17 showing the locking member located on the opposite side of the package from that of the ratchet mechanism shown in FIG. 17.

FIG. 16 shows a modified ratchet mechanism 100 and is similar to ratchet mechanism 4 discussed above except that it does not contain the alarm system, but provides the mechanical locking and unlocking features thereof discussed above and further below. Top wall portion 101 of mechanism 100 preferably includes a semi dome-shaped portion 103 and a semicircular flat portion 104 against which flip-up handle 105 will rest when in a down position (not shown), similar to that discussed above and shown in FIG. 7.

In accordance with another feature of the invention best illustrated in FIGS. 14 and 15, locking member 5, and in particular base 7 thereof, will be formed with a configured end 107 (FIGS. 3 and 4), which is complimentary to a portion of a recess 108 formed in pawl release plate 37. This enables base 7 to rotate plate 37 from a locked position of FIG. 14 to the unlocked position of FIG. 15. In the locked position of FIG. 14, locking teeth 76 of locking pawls 74 are engaged with ratchet teeth 32 of housing 27 to prevent movement of spool 40 toward an unlocked position, in which position cables 16 can be loosened and removed from package 2. Using a portion of locking member 5 as an unlocking key to place the spool in a free wheeling position eliminates the need for a separate key or mechanism.

The operation of the improved security device is as follows. The device is installed on package 2 by wrapping cable loops 15 and 17 around the package as shown in FIGS. 1 and 2, such that locking member 5 preferably lies on one of the major panels of the package and ratchet mechanism 4 lies on an opposite major panel of the package. Fastener 8 is slidably inserted into base 7 where metal tines automatically snap into locked position against shoulders 21. Handle 85 is then pivoted to the up operating position of FIG. 8 and manually rotated. This rotates top wall portion 57 and correspondingly rotates spool 40 which will wrap the cable about hub 41 until the cables are secured tightly about package 2. Locking teeth 76 of locking pawls 74 automatically engage housing teeth 32 as spool 40 rotates until any excess lengths of cable loops 15 and 17 are wrapped about spool hub 41. The alarm system will be automatically actuated and the sensing loops through cable loops 15 and 17 will be operational due to the contact of enlarged metallic ends 49 with the circuit board 46.

An EAS tag 110 preferably is located within internal chamber 9 of base 7 and will provide the additional security of actuating a secured gate alarm, such as at the exit of a retail store, should an unauthorized person attempt to remove a protected package having security device 1 still wrapped thereabout from the store.

To remove security device 1 from package 2 as at a checkout counter of a retail establishment, magnetic key 23 is placed in the correct position on locking member 5 by use of alignment projections 25 to move tines 12 to the unlocked position as shown in FIG. 4, enabling fastener 8 to be slid from within base 7. The cable loops can then be removed easily from around the package which is then given to a customer after payment, for removal from the retail establishment.

In accordance with another feature of the invention, device 1 is useable on various size packages. Depending upon the size of package 2 from which security device 1 is removed, it can be placed easily around a larger package by placing spool 40 in a free wheeling position. This enables the cable to be unwound easily by rotating spool 40 in an unlocking direction. This is achieved by placement of configured end 107 of locking base 7 in recess 108 of pawl release plate 37 and rotating it from the locked position of FIG. 14 in a counterclockwise direction as shown by Arrow A, to the unlocked position of FIG. 15. This rotational movement will rotate locking disc 68 due to its connection by screws 69 to plate 37, which will cause camming projections 73 of gear disc 75 to move along a surface of camming slots 71. Slots 71 are configured whereby the position of projections 73 will move radially inwardly as they move along slot surfaces 72, moving with them the distal ends of locking pawls 74 radially inwardly which will disengage gear teeth 76 from housing gear teeth 32. This enables spool 40 to rotate freely, enabling the cables to be pulled very easily to a longer length. This is accomplished without the use of a key or other mechanism separate from the security device to disengage the locking pawls from the housing gear teeth. Once the desired length of cable has been pulled outwardly from ratchet mechanism 4 by the free wheeling effect of spool 40, pawl release plate 37 is moved again from the unlocked position of FIG. 15 to the locked position of FIG. 14, by the use of the configured end 107 of locking member base 7. A hollow boss 113 (FIGS. 10, 12 and 13), which is formed on gear disc 75, extends through a curved opening 115 formed in pawl release plate 37, to limit the rotational movement of plate 37 when moving between the locked position of FIG. 14 and the unlocked, free wheeling position of FIG. 15. A plunger switch 117 (FIG. 12) is electrically connected to circuit board 46 and extends into the hollow interior of boss 113 and is used to test the alarm control system after manufacture and by store personnel.

Security device 200 (FIGS. 17-18) is similar to device 1 in that device 200 includes two main components. However, device 200 includes a tightening mechanism in the form of a ratchet mechanism 202 which differs in certain regards from ratchet mechanism 202 and a locking member 205 which is the same as locking member 5 except that member 205 includes a base 203 with a key end 207 having a different configuration than that of key end 107 of locking member 5. More particularly, key end 207 (FIGS. 18, 35 and 35A) includes a hollow cylindrical projection 209 and a cross-shaped projection 211, which is partially disposed within and partially projects outwardly from cylindrical projection 209. Otherwise, locking member 205 is the same as locking member 5, which was previously described with reference to FIGS. 3-5. Locking member 205, like locking member 5, thus doubles as a key member for unlocking ratchet mechanism 202. Device 200 further includes a securing cable 204 which includes first and second cable loops 206 and 208. Cable loop 206 includes first and second cable segments 210 and 212 each extending between and connected to ratchet mechanism 202 and locking member 205. Likewise, cable loop 208 includes third and fourth cable segments 214 and 216 each extending between and connected to ratchet mechanism 202 and locking member 205.

Figure 19:
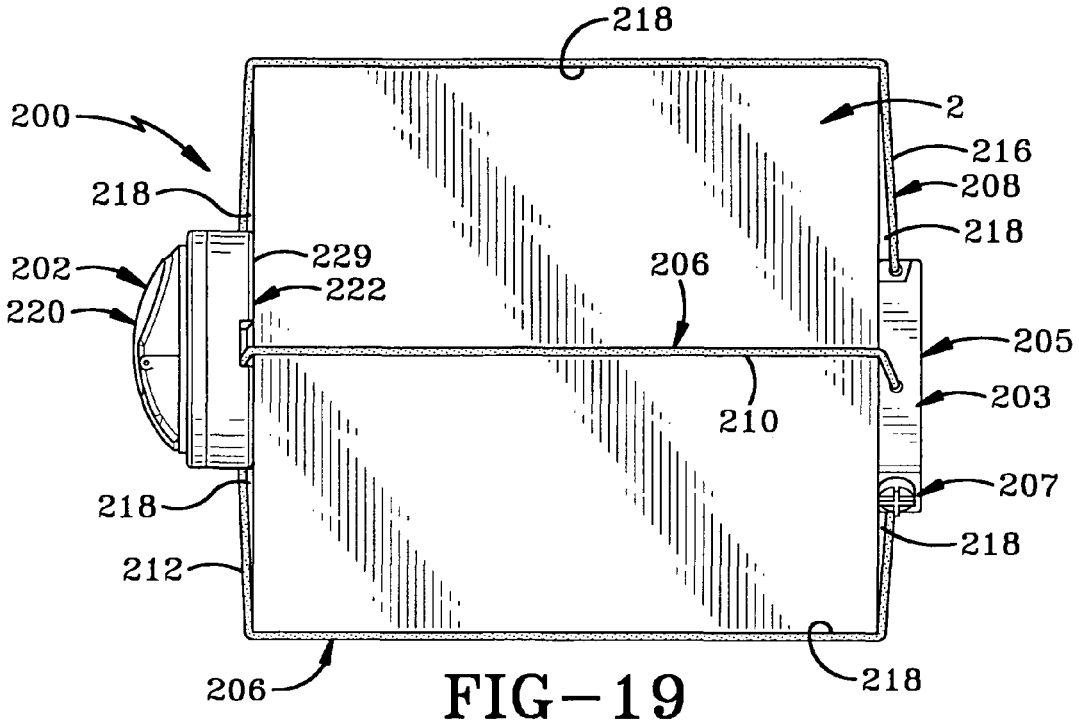
FIG. 19 is an end view of the second embodiment and package shown in FIG. 17.
Figure 20:
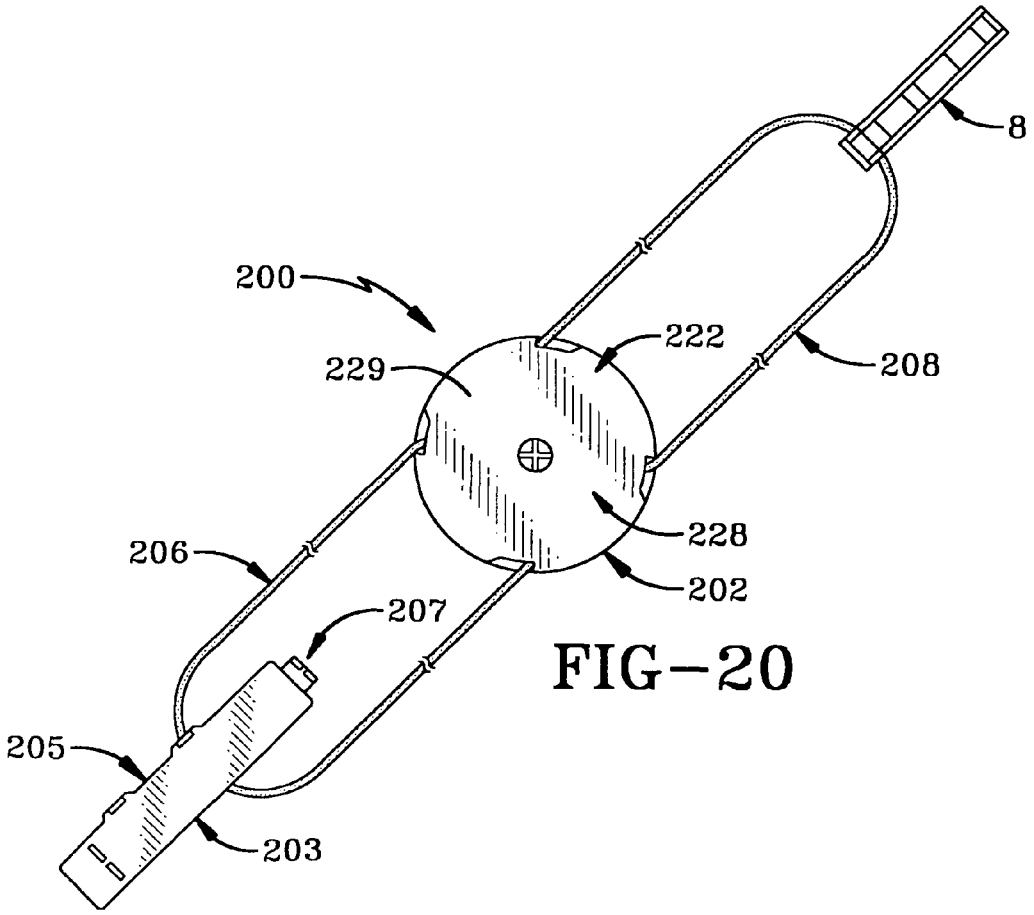
FIG. 20 is a diagrammatic view of the second embodiment in an unsecured position with the base and fastener of the locking member unlocked and released from one another.

Cable 204, and more broadly device 200, is movable between a secured position (FIGS. 17-19) and an unsecured position (FIG. 20). In the secured position, ratchet mechanism 202, locking member 205 and cable 204 define therebetween an object-containing space 218 (FIG. 19) for containing a package 2 or other object to be secured. Ratchet mechanism 202 has a tightening side 220 and an unlocking side 222 which respectively face away from and toward space 218 and package 2 in the secured position. This configuration allows the tightening of cable 204 about package 2 and prevents the unlocking of ratchet mechanism 202 when device 200 is secured about package 2, which blocks or substantially limits access to unlocking side 222 and hides unlocking side 222 from sight to make it more difficult to ascertain how ratchet mechanism 202 is unlocked.

Figure 21:
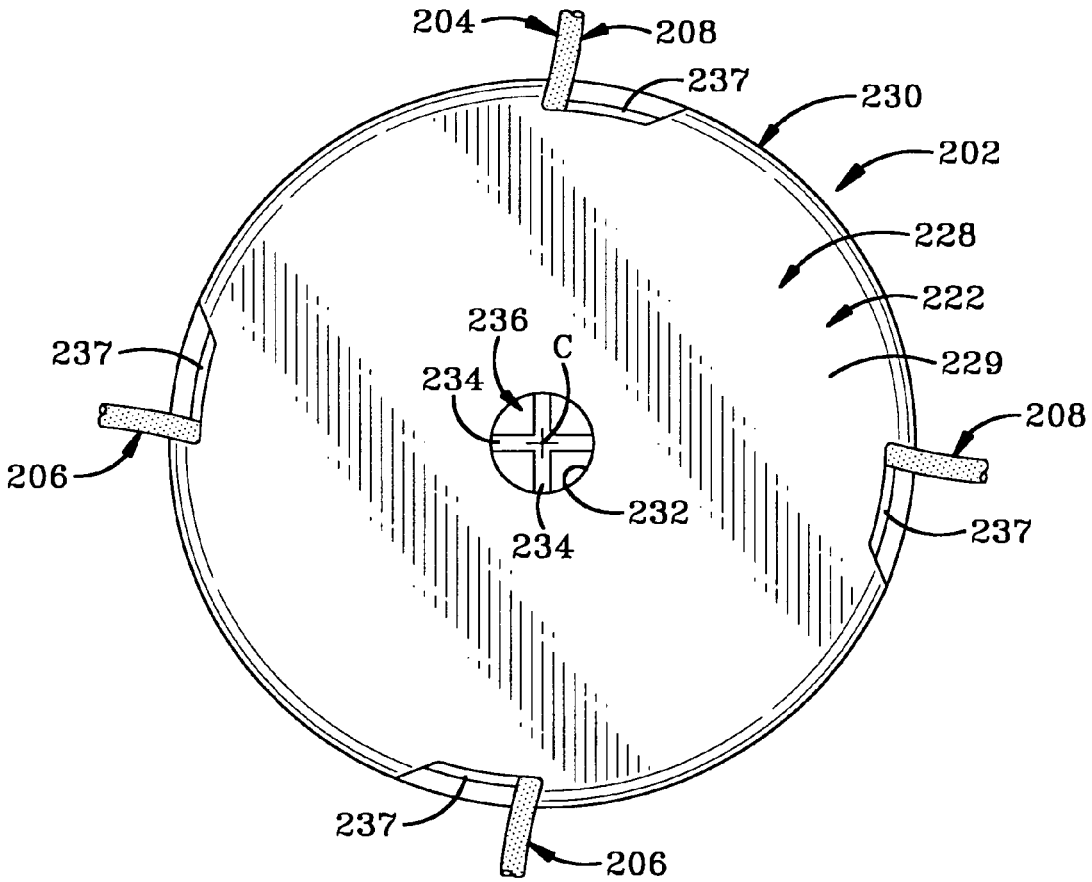
FIG. 21 is a bottom plan view of the ratchet mechanism of FIG. 17 with a fragmentary portion of the securing cables shown extending outwardly therefrom.
Figure 23:
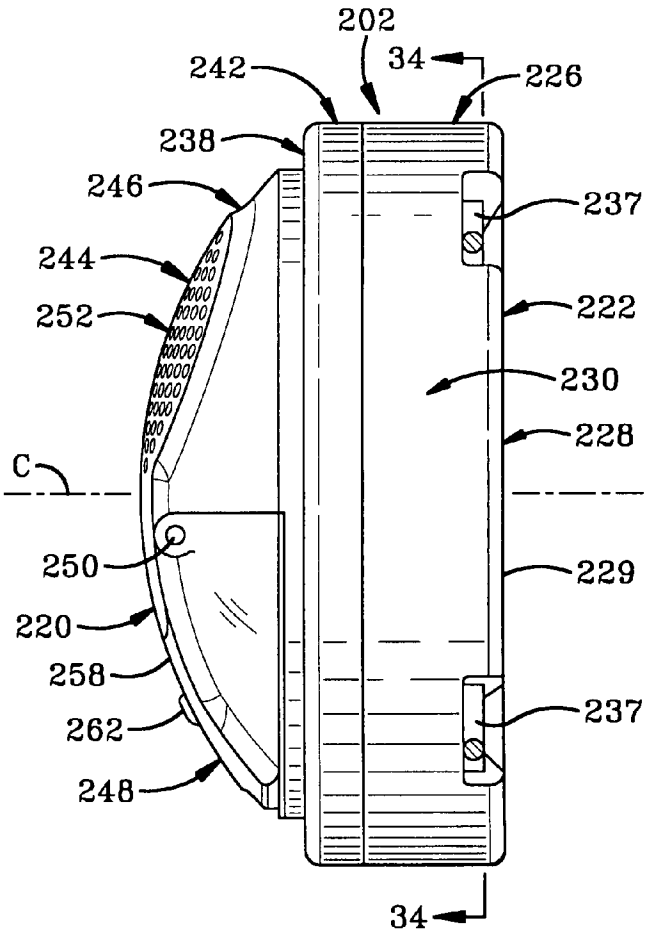
FIG. 23 is a side view of the ratchet mechanism with the flip-up handle in the down position.
Figure 22:
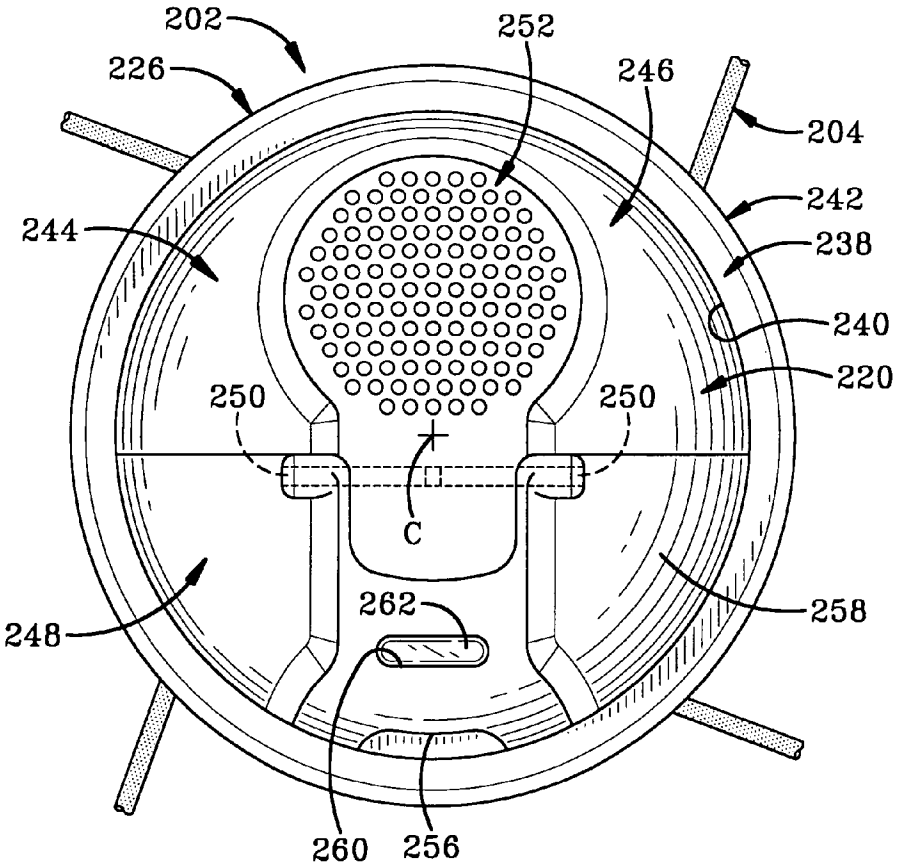
FIG. 22 is a top plan view of the ratchet mechanism with the flip-up handle in a down inoperative position.
Figures 35, 35A:
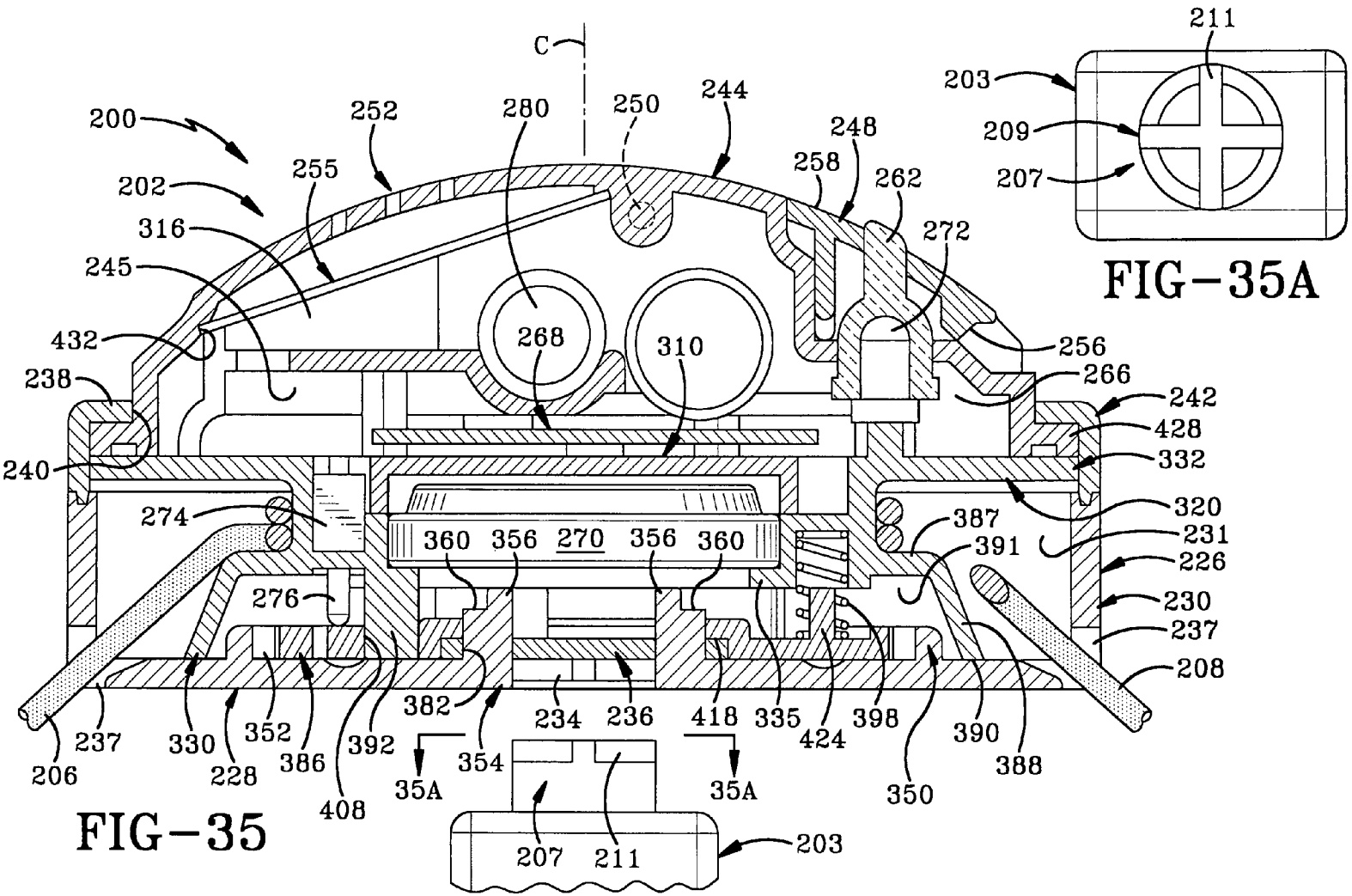
FIG. 35 is a sectional view of the ratchet mechanism taken from the side of the ratchet mechanism in the locked position with the key end of the locking member positioned prior to unlocking of the ratchet mechanism.
FIG. 35A is an end view of the locking member taken on line 35A-35A of FIG. 35.

Ratchet mechanism 202 (FIGS. 21-25) includes a housing 226 which has a substantially flat and circular bottom wall 228 and a cylindrical sidewall 230 which extends upwardly from bottom wall 228 and is concentric about an axis C. Walls 228 and 230 define therewithin a cavity 231 (FIGS. 29, 35). Bottom wall 228 has a substantially flat lower surface 229 which faces object-containing space 218 when device 200 is in the secured position (FIG. 19). Housing 226 preferably is a one-piece member formed of a rugged plastic material. A small downwardly opening circular central opening 232 (FIG. 21) which communicates with cavity 231 is formed in bottom wall 228 for receiving key end 207 of locking member 205. A keying formation 234 (FIG. 21) complementary to key end 207 is visible through opening 232 and is formed in a locking element in the form of a locking disc 236. In the secured position of FIG. 19, formation 234 of disc 236 faces object-containing space 218 and communicates therewith via opening 232. Four cable openings 237 are formed in sidewall 230 adjacent the intersection of sidewall 230 and bottom wall 228 for the passage of securing cable 204 therethrough as discussed further below. Openings 237 open radially outwardly and are preferably spaced circumferentially in a substantially even manner, in the exemplary embodiment being at about 90 degrees to one another with respect to axis C. Housing 226 further includes an annular top wall 238 (FIG. 22) which extends radially inwardly from the top of sidewall 230, is concentric about axis C and defines an upwardly opening circular top entrance opening 240 of cavity 231. Annular top wall 238 and a portion of sidewall 230 are formed by a top ring 242 (FIG. 33) which is fixedly attached to the rest of sidewall 230 by a sonic weld, an adhesive or other suitable means.

Figure 6:
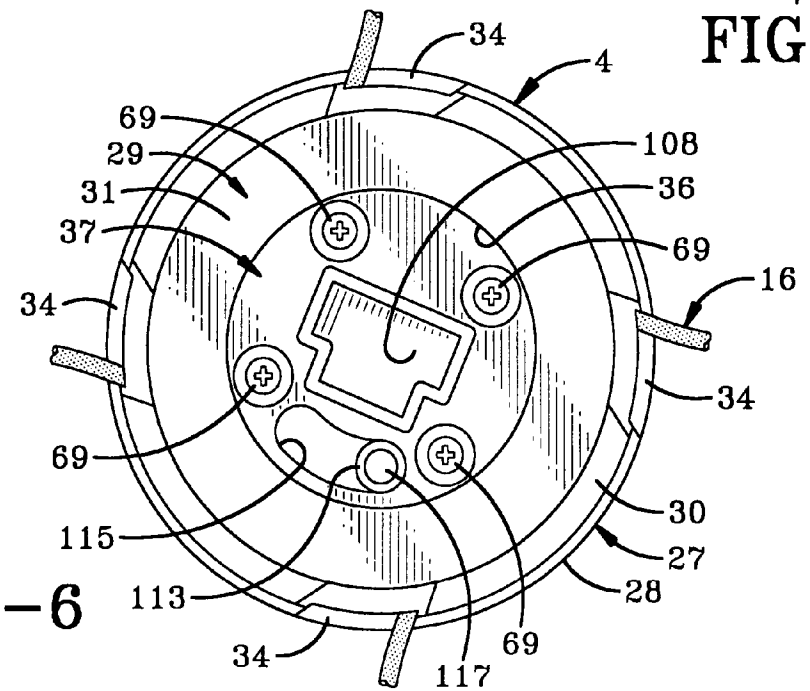
FIG. 6 is a bottom plan view of the ratchet mechanism of FIG. 1 with a fragmentary portion of the securing cables shown extending outwardly therefrom.

Central opening 232 has a diameter which is substantially smaller than the diameter of sidewall 230 and slightly larger than the diameter of cylindrical projection 209 of key end 207. While the dimensions may vary, in one preferred embodiment, sidewall 230 has a diameter of about 22 inches and central opening 232 has a diameter of about ⅜ inch. Small opening 232 makes access to locking disc 236 more difficult when device 200 is secured on package 2 in comparison to access to pawl release plate 37 (FIG. 6) of mechanism 4 of device 1. In addition, the configuration of mechanism 202 eliminates exposure via opening 232 of fasteners such as fasteners 69 of mechanism 4.

Figure 25:
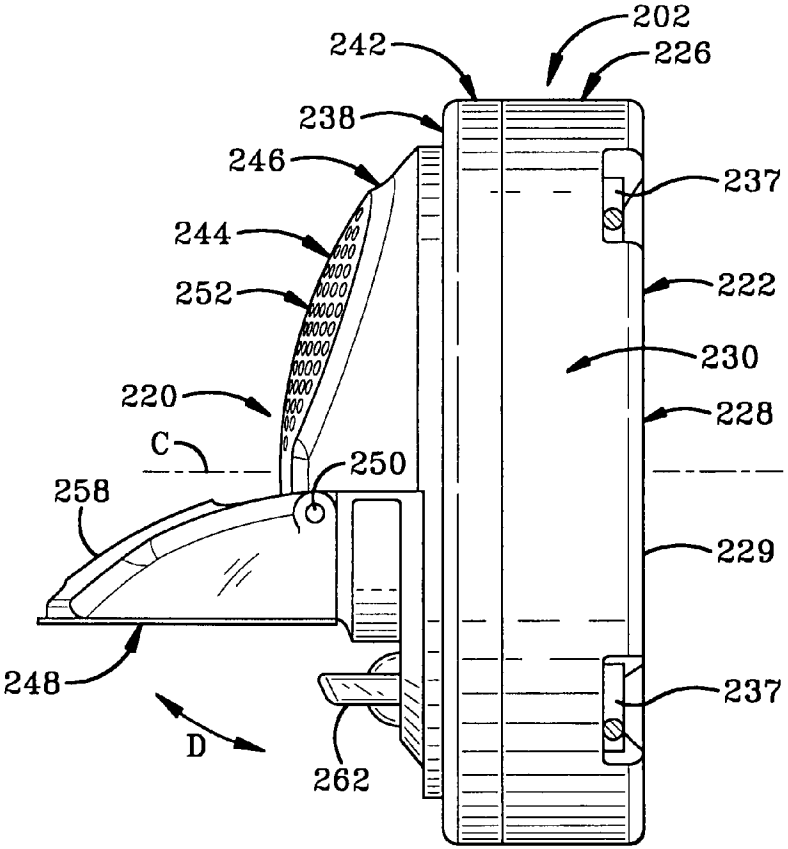
FIG. 25 is similar to FIG. 23 with the flip-up handle in the raised position.
Figure 24:
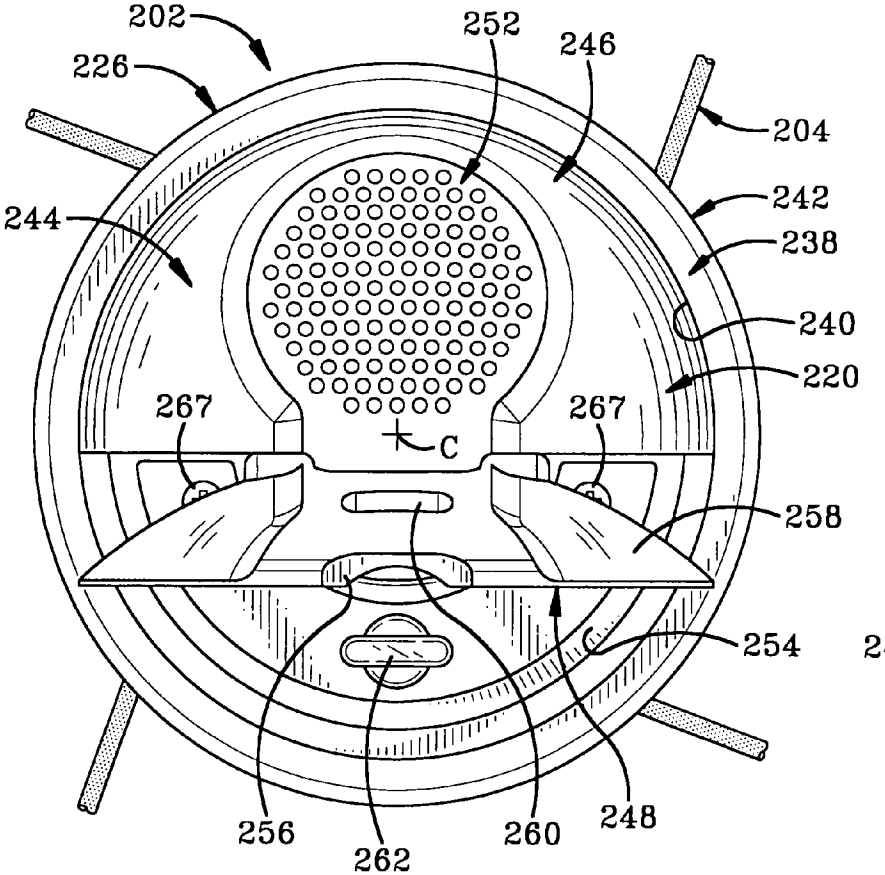
FIG. 24 is similar to FIG. 22 with the flip-up handle in a raised operating position.

Ratchet mechanism 202 further includes a top wall portion 244 which is rotatably mounted within top opening 240 of housing 226 with annular top wall 238 of housing 226 providing an interference to prevent removal of top wall portion 244 upwardly through top opening 240. Top wall portion 244, bottom wall 228 and sidewall 230 define therebetween an interior chamber 245 (FIG. 35) of ratchet mechanism 202. Top wall portion 244 includes a half dome-shaped wall or portion 246 disposed above top wall 238 of housing 226. A flip-up handle 248 is pivotally mounted by a pair of pivot pins 250 on dome-shaped portion 246 and is movable as indicated at Arrow D in FIG. 25 between a down generally inoperative position (FIGS. 22-23) and a raised operative position (FIGS. 24-25). A plurality of speaker holes 252 are formed in dome-shaped portion 246. A generally planar semicircular portion 254 forms the other half of top wall portion 244 and receives the flip-up handle 248 when the handle is in the down position. Handle 248 preferably is formed with a concave finger grasping area 256 so that a user can easily grasp the flip-up handle for moving it from the down position to the raised position. Handle 248 preferably has a smooth half dome-shaped top surface 258, having a curvature generally matching that of half dome-shaped portion 246, to provide for a smooth attractive appearance. Handle 248 defines a through opening 260 for receiving a light pipe 262 which is mounted on portion 254 of top wall portion 244 and extends through an opening 264 formed in portion 254 from above portion 254 into an interior cavity 266 (FIG. 33) of top wall portion 244. Light pipe 262 is a clear or translucent material for transmitting light to the upper surface of top wall portion 244. A pair of mounting screws 267 extend through holes 265 (FIG. 33) formed in portion 254 of top wall portion 244 into interior cavity 266.

Figure 26:
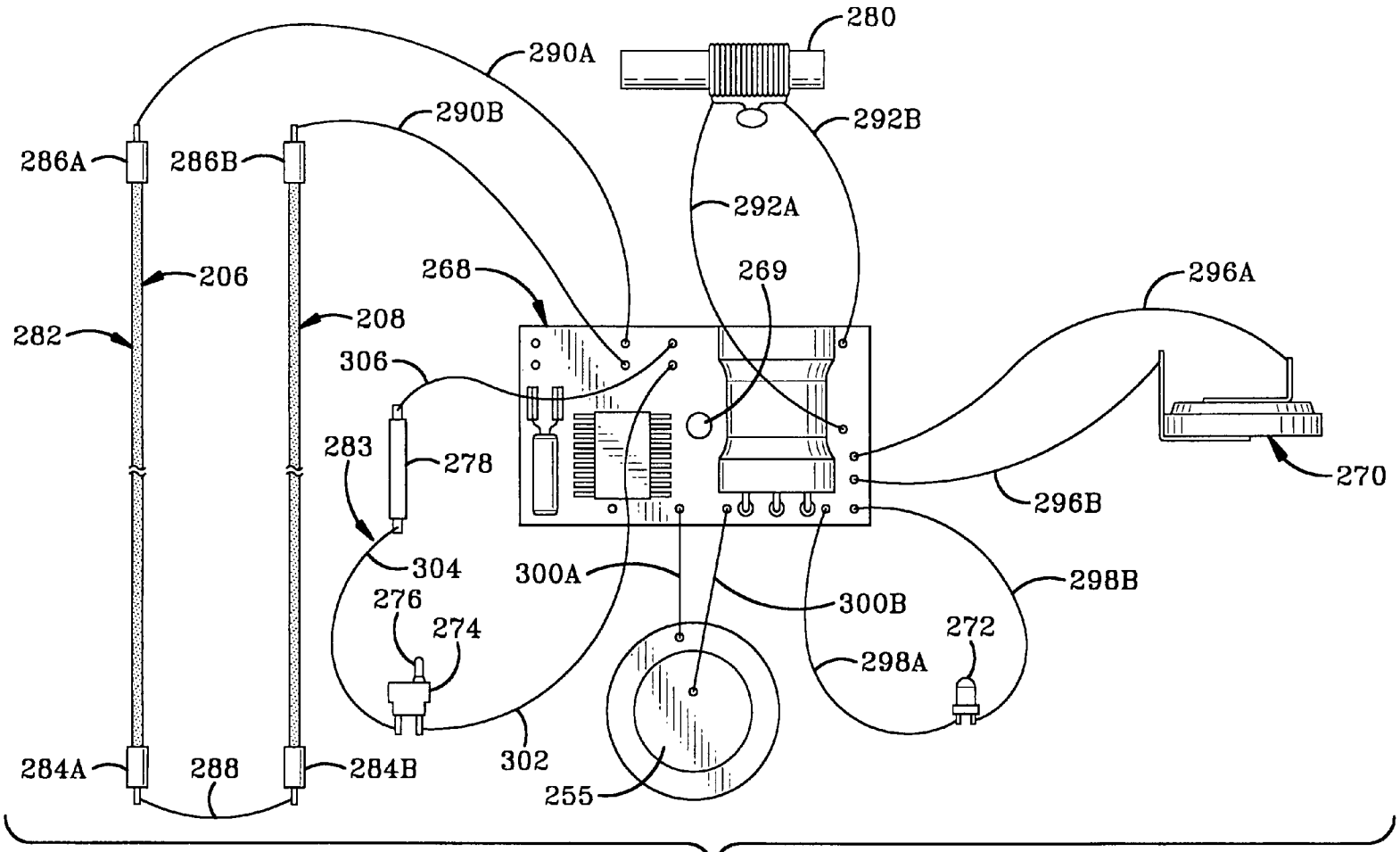
FIG. 26 is a diagrammatic view of the alarming system of the second embodiment.

Device 200 includes an alarm system for producing an audible alarm which sounds under several different circumstances which are described below. Various elements of the alarm system are shown in FIG. 26 and include a printed circuit board (PCB) 268 with which the other alarm elements are in electrical communication. PCB 268 defines an alignment hole 269. The other alarm elements include cable loops 206 and 208, which are electrically conductive, speaker 255, a battery 270 for powering the alarm system, a visual indicating light in the form of LED 272, a pressure switch 274 having a plunger 276, a reed switch 278 and a sensor in the form of an RF or AM coil 280. Cables 206 and 208 respectively include first enlarged metallic ends 284A and 284B and second opposed enlarged metallic ends 286A and 286B. First enlarged ends 284A and 284B are in electrical communication with one another via conductor 288. Second opposed enlarged ends 286A and 286B are respectively in electrical communication with PCB 268 via conductors 290A and 290B. Sensor 280 is in electrical communication with PCB 268 via conductors 292A and 292B; battery 270 via conductors 296A and 296B; LED 272 via conductors 298A and 298B; audible alarm or speaker 255 via conductors 300A and 300B; and switch 274 via conductors 302, 304 and 306 via reed switch 278, which is connected to conductors 304 and 306. In conjunction with PCB 268, cables 206 and 208 along with conductors 288 and 290A and B form a sense loop 282. Another sense loop 283 is formed by PCB 268, switches 274 and 278, and conductors 302, 304 and 306.

Figure 27:
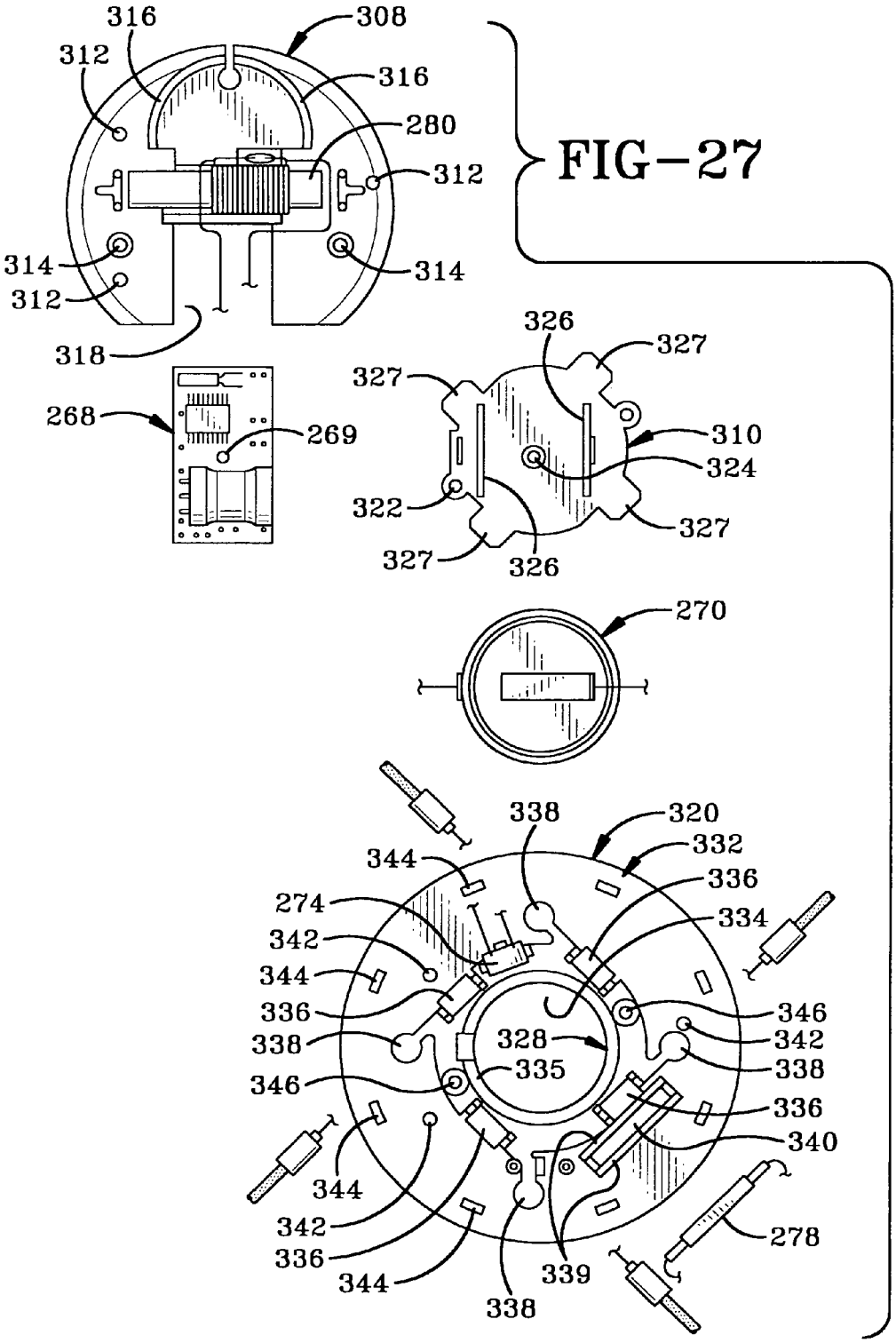
FIG. 27 is an exploded top view of the spool, fragmentary portions of the cable, the battery, the battery cover, the printed circuit board (PCB), and the cover plate.
Figure 28:
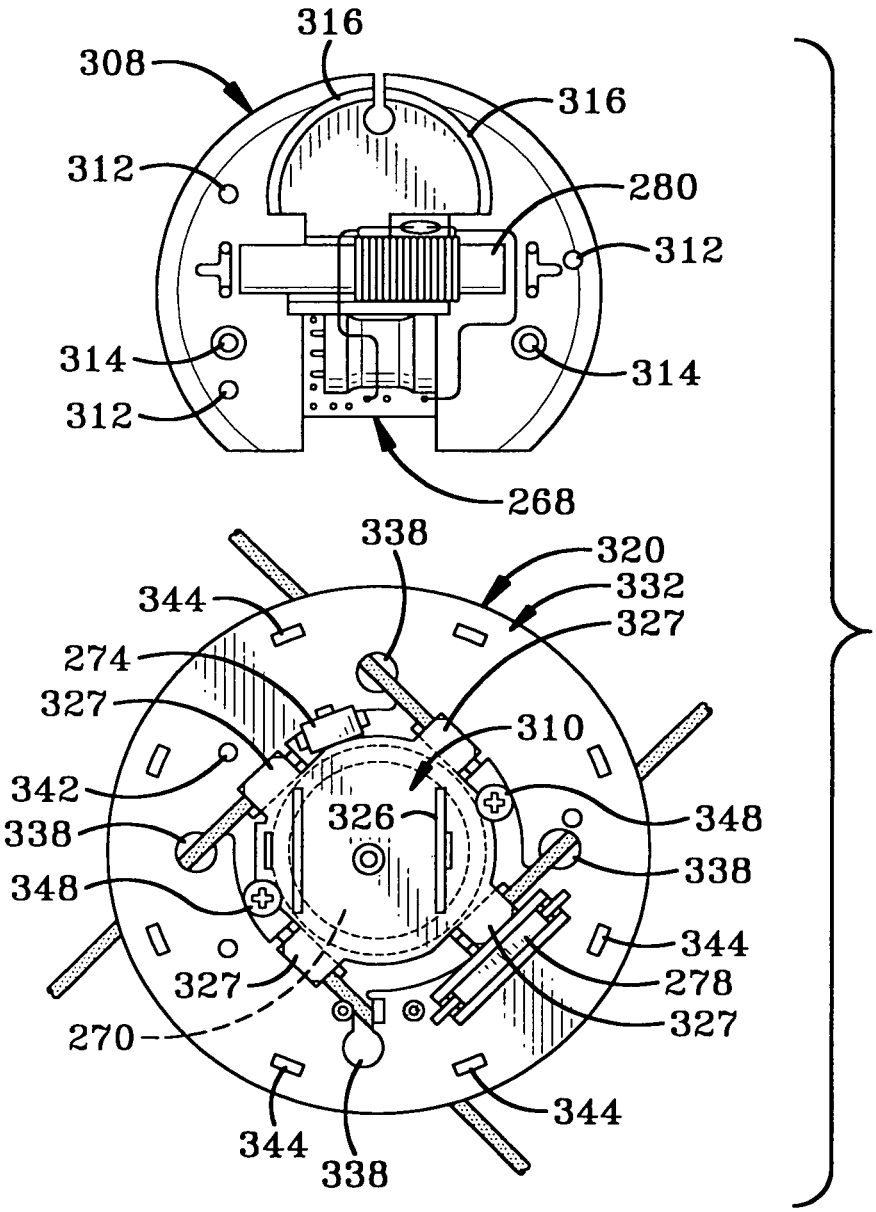
FIG. 28 is an exploded top view showing the elements of FIG. 27 partially assembled wherein the battery, battery cover and cables are mounted on the spool and the PCB is mounted on the cover plate.

With reference to FIGS. 27-28, ratchet mechanism 202 further includes a cover plate 308, a battery cover 310 and a spool 320. Cover plate 308 includes three alignment holes 312 and a pair of mounting holes 314 for receiving screws 267 (FIG. 24) to mount cover plate 308 on top wall portion 244. A pair of upwardly projecting arcuate speaker supports 316 form a substantially semicircular support having a tapered upper surface for supporting speaker 255 in a desired position (FIG. 35) below speaker holes 252. Cover plate 308 further defines a central opening 318 for receiving PCB 268 therein. Battery cover 310 defines a pair of spaced mounting holes 322. Cover 310 includes a central upwardly extending alignment post 324 which is received in alignment hole 269 of PCB 268 when assembled (not shown). Cover 310 further includes a pair of spaced, parallel upwardly extending alignment tracks 326 disposed on either side of post 324 along which sides of PCB 268 are disposed to help align PCB 268 and cover 310 when assembled (not shown). Cover 310 further includes four alignment tabs 327 which project radially outwardly.

Figure 33:
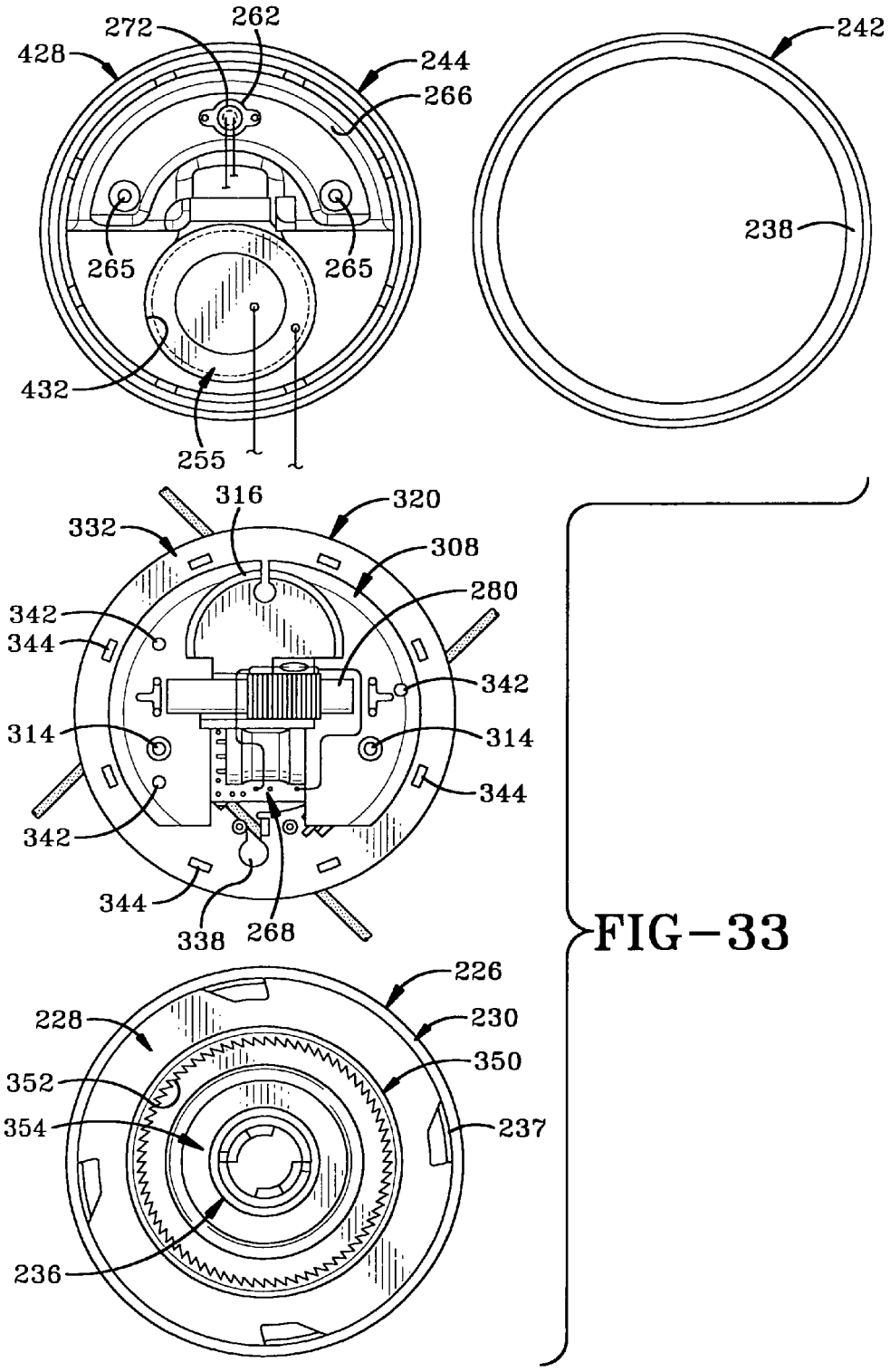
FIG. 33 is an exploded view including a top plan view of the housing with the locking disk mounted therein, a top plan view of the spool with the cover plate and PCB mounted thereon, a bottom plan view of the top wall portion with the speaker and light pipe mounted thereon and a bottom plan view of the lock ring.

Spool 320 (FIGS. 27, 30 and 35) is disposed in cavity 231 of housing 226 and includes a central hub 328 and first and second spaced flanges 330 (FIG. 30, 35) and 332 extending outwardly therefrom and spaced from each other for capturing cable 204 therebetween when the cable loops 206 and 208 are tightened about package 2. First flange 330 is a lower flange which extends radially outwardly and then angles downwardly and outwardly. Second flange 332 is an upper flange which is substantially flat along a plane perpendicular to axis C. Spool 320 preferably is a one-piece member molded of a rigid plastic material. Hub 328 defines a circular central recess 334 into which battery 270 is press fit atop an annular ledge 335. Four slotted holes 338 are formed in flange 332 and communicate with cable openings 237 for inserting enlarged ends 284 and 286 of cable loops 206 and 208 therethrough. Small compartments 336 are formed in spool 320 adjacent the intersection of upper flange 332 and hub 328 for receiving respectively therein enlarged ends 284 and 286 (FIG. 28). Tabs 327 of battery cover 310 are also received in respective upper portions of compartments 336. A pair of spaced tracks 339 extend upwardly from upper flange 332 and define therebetween an elevated compartment 340 for receiving therein reed switch 278. Three alignment projections 342 extend upwardly from flange 332 and are received respectively in holes 312 of cover plate 308 (FIG. 33). Flange 332 defines a plurality of rectangular alignment holes 344 adjacent the outer perimeter thereof. A pair of mounting holes 346 are formed adjacent a respective pair of compartments 336 for receiving a respective pair of screws 348 (FIG. 28) which pass through respective mounting holes 322 of battery cover 310 to mount cover 310 on spool 320 (FIG. 28).

In accordance with a feature of the invention and with reference to FIG. 29, housing 226 is further described. Bottom wall 228 includes a first engaging member in the form of an upwardly projecting annular wall 350 having a plurality of one-way locking gear teeth 352 which extend radially inwardly all along the circumference of annular wall 350. Annular wall 350 is concentric about axis C (FIG. 35) and defines therewithin an upwardly opening cavity 353 bounded by bottom wall 228 and in communication with opening 232. Housing 226 includes a retaining mechanism 354 (FIGS. 33, 35) which includes locking disc 236 and a pair of arcuate retaining projections 356 which are connected to and extend upwardly from bottom wall 228 on opposite sides of and closely adjacent central opening 232, passing through and above cavity 353 (FIG. 35). Arcuate projections 356 are elongated along a circumferential path and have respective opposed lateral ends 355 and 357 which define therebetween a circumferential length E. Projections 356 have respective inner surfaces 358 which extend between the respective ends 355 and 357 concentrically about axis C and have substantially the same diameter as that of opening 232. Retaining mechanism 354 further includes a pair of seating ledges 360 which are connected to and extend radially outwardly a short distance respectively from projections 356 adjacent a respective lateral end 355 thereof. Seating ledges 360 also project upwardly from and are connected to bottom wall 228. Ledges 360 are axially shorter than arcuate projections 356, as best seen in FIG. 35. Each projection 356 and ledge 360 is diametrically opposed to the other.

Figure 40:
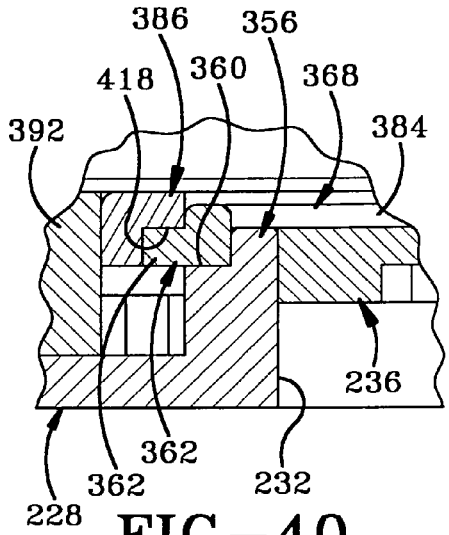
FIG. 40 is an enlarged fragmentary sectional view of a portion of the ratchet mechanism shown in FIG. 38 showing the locking disk in the retained position with the key end of the locking member removed from the ratchet mechanism.
Figure 41:
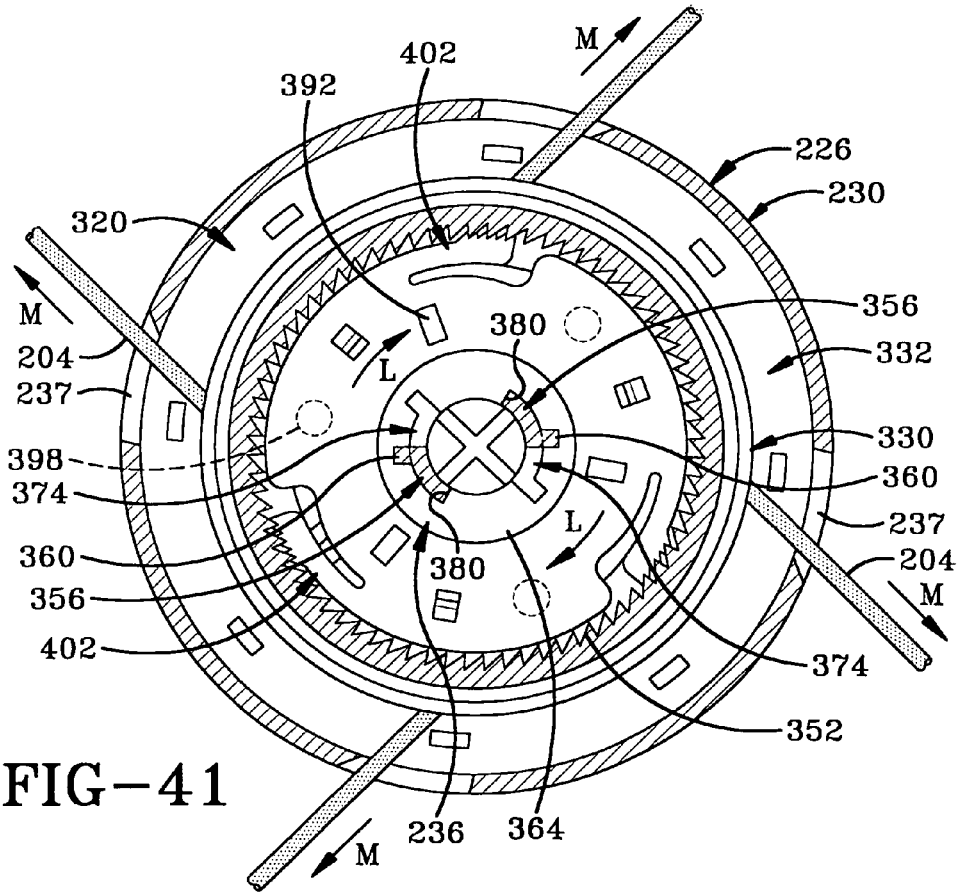
FIG. 41 is similar to FIG. 37 and shows the gear disk and spool in a free wheeling motion to allow the loosening of the cables from the ratchet mechanism.

In accordance with the invention, locking disc 236 (FIGS. 29, 36 and 40) is further described. Disc 236 includes a flat main wall 362 which includes a continuous outer annular wall portion 364 and central wall portion 366. A noncontinuous annular wall 368 projects upwardly from main wall 362 between wall portions 364 and 366. Central wall portion 370 includes a central circular portion 368 and a pair of dovetail portions 372 extending radially outwardly therefrom in opposite directions. Disc 236 defines a pair of diametrically opposed slots 374 each for receiving a respective arcuate projection 356 and ledge 360 therein (FIG. 33). Slots 374 are through slots extending from the top to the bottom of disc 236. Slots 374 include respective arcuate circumferentially elongated slot sections 376 formed in central wall portion 366 for respectively receiving arcuate projections 356 of housing 226. Slot sections 376 are complementary to arcuate projections 356 in that they are concentric about axis C and are slightly radially wider than projections 356 to allow for rotation of disc 236 about axis C with projections 356 in sections 376 when disc is in an unlocked position, as will be detailed further below. Arcuate slot sections 376 are elongated along a circumferential path and are bounded by first and second opposed lateral end surfaces 378 and 380 which define therebetween a circumferential length F which is greater than length E of arcuate projections 356. Length F is longer than length E to a degree sufficient to allow an appropriate amount of rotation of disc 236 in its unlocked position for disc 236 to move to a retaining position which will be detailed further below. Slots 374 further include radial slot sections 382 which are formed in main wall 362 and noncontinuous annular wall 368 for respectively receiving seating ledges 360 therein. Slot sections 382 communicate respectively with slot sections 376 and extend radially outwardly therefrom adjacent respective first lateral end surfaces 378 thereof. Radial slot sections 382 divide noncontinuous annular wall 368 into first and second semi-circular portions 384.

In accordance with the invention and with reference to FIGS. 30-32 and 35, a second engaging member in the form of a gear disc 386 is described and spool 320 is further detailed. Lower flange 330 of spool 320 includes an inner annular wall 387 which extends radially outwardly from hub 328 and is substantially flat along a plane perpendicular to axis C. A frustoconical wall 388 extends radially outwardly and downwardly from annular wall 387 to a lower outer end 390 which abuts the upper surface of bottom wall 228 of housing 226 (FIG. 35) and slidably engages said upper surface during rotation of spool 320. Wall 388 of lower flange 330 guides cable 204 onto hub 328 during tightening of cable 204. Lower flange 330 defines therewithin a flange cavity 391 which when bounded above by battery 270 and below by bottom wall 228 of housing 226 may be considered an interior chamber disposed within interior chamber 245 of ratchet mechanism 202 and within cavity 231 of housing 226 (FIG. 35). Three circumferentially spaced guide bars 392 project axially downwardly from hub 328 within cavity 391 and three circumferentially spaced retaining clips 394 project axially downwardly from hub 328. Guide bars 392 slidably engage bottom wall 228 during rotation of spool 320. Hub 326 defines three circumferentially spaced spring-receiving recesses 396 for receiving respectively therein springs 398.

Referring to FIG. 35, annular wall 350, arcuate projections 356 and seating ledges 360 all project upwardly from bottom wall 228 of housing 226 into cavity 391 of lower flange 330. Thus, cavity 353 of annular wall 350 is disposed within and communicates with cavity 391 and central opening 232 of bottom wall 228 communicates with cavity 391. Locking disc 236 and gear disc 386 are also disposed within cavity 391, and plunger 276 and springs 398 extend downwardly into cavity 391.

Figures 30, 31, 32:
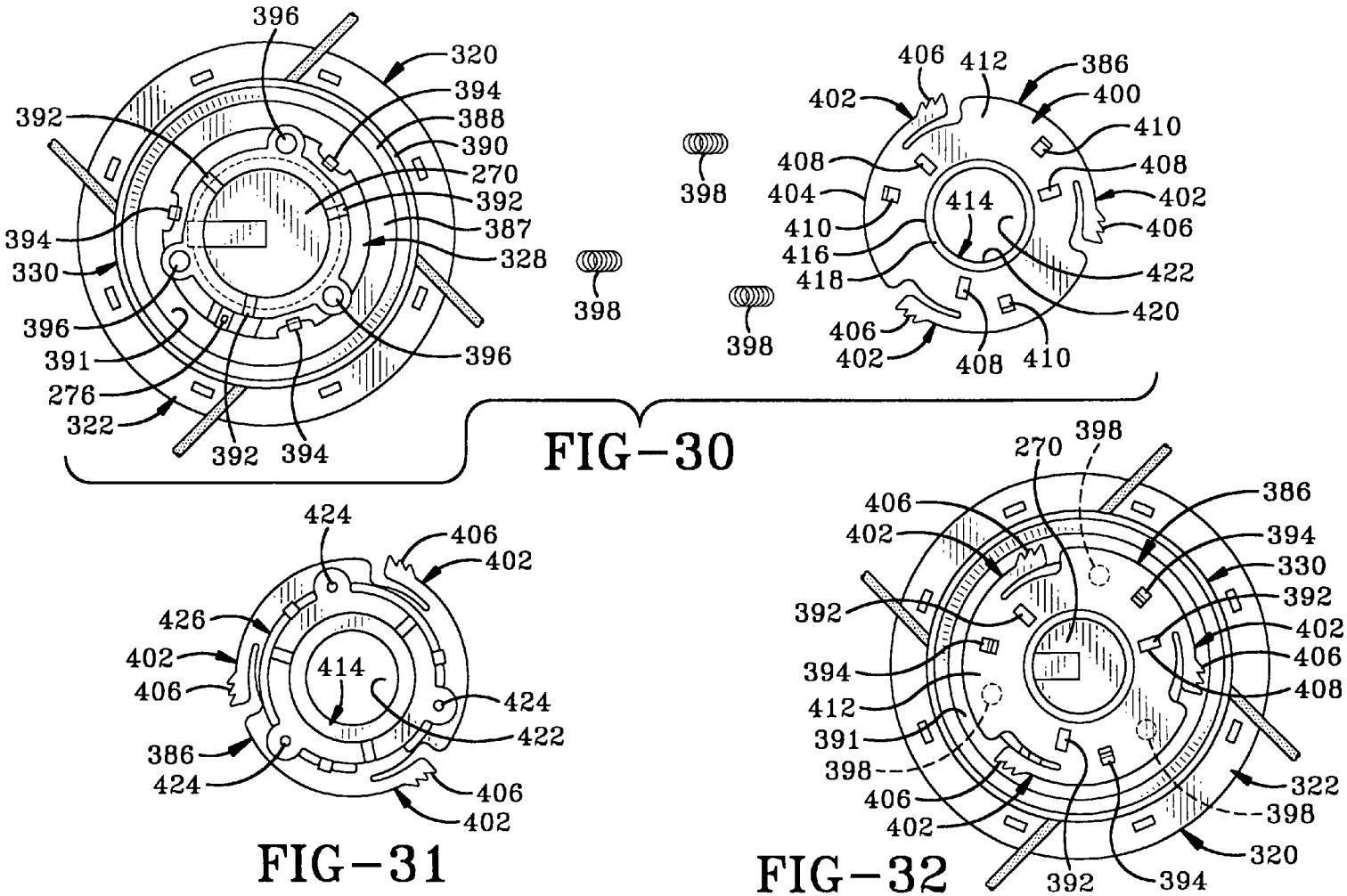
FIG. 30 is an exploded bottom plan view of the spool with the battery mounted thereon with the cables shown in fragmentary extending therefrom, the gear disk and the springs for biasing the gear disk to the locked position thereof.
FIG. 31 is a top plan view of the gear disk.
FIG. 32 is a bottom plan view of the spool with the battery and gear disk mounted thereon.
Figure 36:
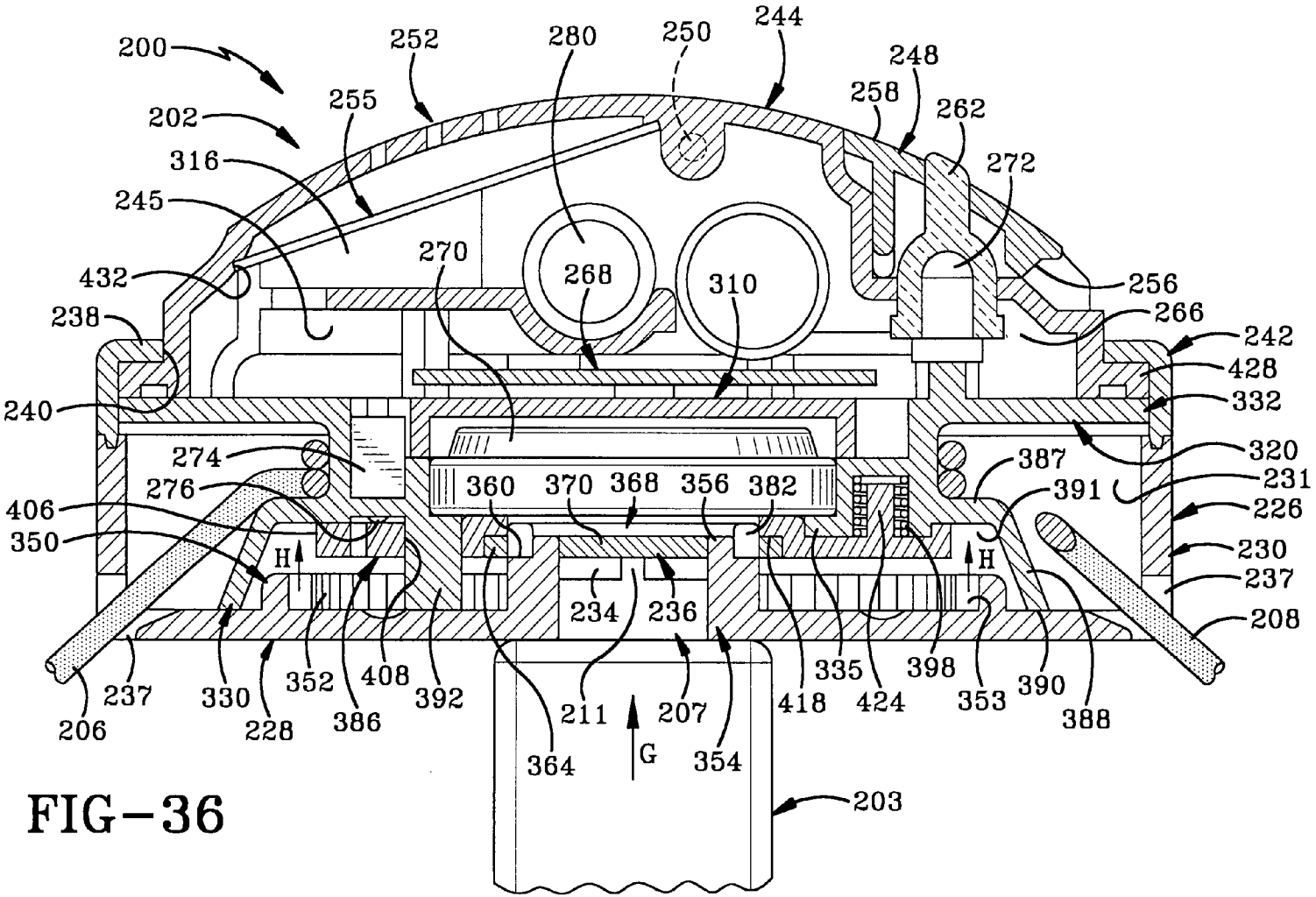
FIG. 36 is similar to FIG. 35 and shows the key end of the locking member moving the locking disk and gear disk to the unlocked position of the ratchet mechanism.

Gear disc 386 is a substantially flat and circular member having a body 400 and three resilient locking pawls 402 which are cantilevered from body 400 along an outer perimeter 404 thereof. Locking pawls 402 are equally circumferentially spaced from one another and include respectively a plurality of locking teeth 406 which extend radially outwardly. The resilient nature of locking pawls 402 allows them and teeth 406 to move radially inwardly and spring back radially outwardly. Body 400 defines three guide holes 408 for respectively slidably receiving therein guide bars 392 of spool 320 whereby gear disc 386 is axially slidable relative to spool 320 and is operationally connected to spool 320 and top wall portion 244 to rotate therewith. Body 400 further defines three clip holes 410 for slidably receiving retaining clips 394 with a snap fit connection therebetween to retain gear disc 386 on spool 320 (FIG. 32) against the downward spring force of springs 398 primarily for purposes of assembly. Body 400 is stepped upwardly from a lower surface 412 thereof to an elevated annular wall 414 via an axially extending annular step 416 which defines a circular recess 418. Annular wall 414 has a circular inner surface or perimeter 420 which defines a central hole 422. As shown in FIG. 36, recess 418 is configured to receive therein outer annular wall portion 364 of locking disc 236 with an outer perimeter of wall portion 364 closely adjacent or abutting axial step 416 and an upper surface of wall portion 364 abutting a lower surface of annular wall 414. Hole 422 receives noncontinuous annular wall 368 of locking disc 236 with an outer perimeter of wall 368 closely adjacent or abutting inner perimeter 420. Ratchet mechanism is free of fasteners which connect locking disc 236 and gear disc 386 to one another. Discs 236 and 386 abut one another via a frictional engagement such that locking disc 236 is able to rotate relative to gear disc 386 when in an unlocked position and gear disc 386 during rotation thereof is capable of causing locking disc 236 to rotate therewith, as detailed further below. Referring to FIG. 31, three spring-positioning projections 424 extend upwardly from body 400 of disc 236 and are insertable respectively into springs 398 (FIG. 35). A broken annular strengthening wall 426 also extends upwardly from body 400.

Referring to FIG. 33, top wall portion 244 further includes an outer annular wall 428 which extends radially outwardly from respective lower ends of half dome-shaped portion 246 and semi-circular portion 254. Annular wall 428 along an upper surface thereof slidably engages a lower surface of annular top wall 238 of top ring 242 of housing 226 (FIG. 35) during rotation of top wall portion 244 about axis C. A plurality of alignment tabs 430 project downwardly from annular wall 428 and are received in alignment holes 344 of upper flange 332 of spool 320 with annular wall 428 seated on upper flange 332 (FIG. 35) so that top wall portion 244 is operationally connected with spool 320 whereby rotation of top wall portion 244 will rotate spool 320 therewith. Annular wall 428 and flange 332 have outer perimeters which have substantially the same diameter and are disposed closely adjacent or in abutment with the inner surface of the ring 242 portion of sidewall 230 of housing 226. A circular recess 432 is formed on the inside surface of top wall portion 244 for mounting therein speaker 255. LED 272 is disposed in a cavity defined by light pipe 262.

Figure 34:
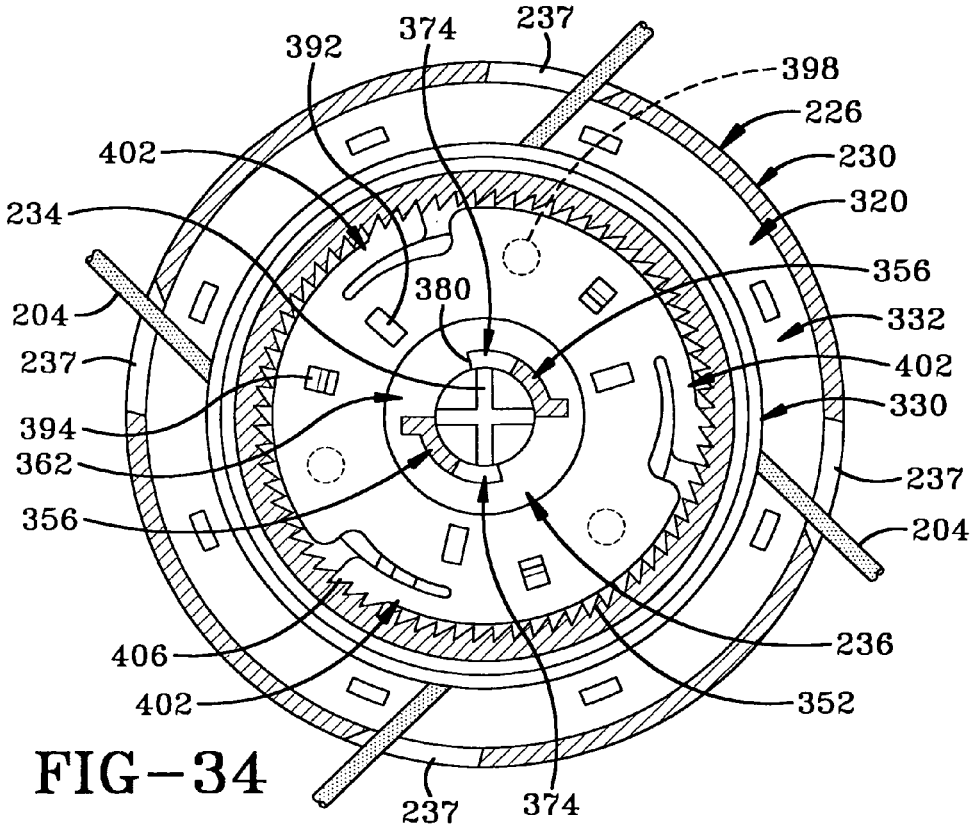
FIG. 34 is a sectional view taken on line 34-34 of FIG. 23 showing the locking disk and the gear disk in the locked position.

The basic operation of device 200 is substantially similar to that of device 1 with regard to installation on package 2 and removal therefrom except for the use of key end 207 and the movement of various elements of ratchet mechanism 202, which is now detailed with reference to FIGS. 34-47 without repeating aspects common to operation of device 1. FIGS. 34-35 show ratchet mechanism 202 in a locked position with locking teeth 406 of gear disc 386 lockably engaging locking teeth 352 of housing 226 to prevent rotation of spool 320 about axis C in a cable-loosening direction which would allow cable 204 to unwind from spool 320. Gear disc 386 is shown in its locked position with gear disc 386 abutting an upper surface of bottom wall 228 (FIG. 35). Locking disc 236 is in its locked position with arcuate retaining projections 356 and seating ledges 360 extending upwardly through respective arcuate and radial slot sections 376 and 382. In the locked position of disc 236, seating ledges 360 serve to prevent rotation of disc 236 due to the interference therebetween when ledges 360 are disposed in radial slot sections 382. Key end 207 of base 203 of locking member 205 is positioned in FIG. 35 just prior to unlocking mechanism 202.

FIG. 36 shows base 203 having moved axially upward in linear fashion as indicated at Arrow G to insert key end 207 into opening 232 to engage keying formation 234 and move locking disc 236 and gear disc 386 axially upward in a single linear direction (Arrows H) from the locked positions thereof (FIG. 35) to their respective unlocked positions. Gear disc 386 thus moves out of cavity 353 to disengage locking teeth 406 from locking teeth 352. Gear disc 386 compresses springs 398 and depresses plunger 276 as it moves to its unlocked position in which gear disc abuts respective lower surfaces of hub 328 and inner annular wall 387 of spool 320. Projections 356 remain within slot sections 376 in the unlocked position, thus ensuring that locking disc 236 never slips out of position. With locking teeth 406 and 352 disengaged from one another, spool 320 is in a free wheeling position in which it is able to rotate in the cable-loosening direction to unwind cable 204 therefrom. However, compressed springs 398 will force gear disc 386 back to its locked position if the upward force applied via base 203 is simply removed with no further action.

Figure 37:
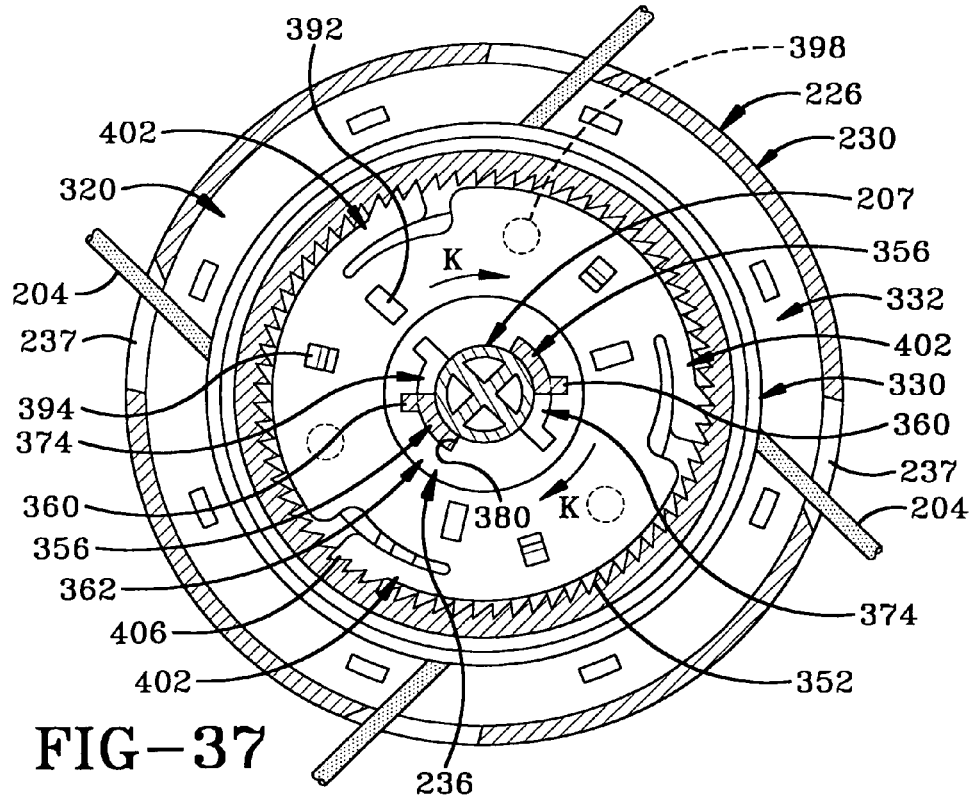
FIG. 37 is similar to FIG. 34 and shows the gear disk and locking disk in a raised unlocked position with the locking disk rotated to the retaining position to prevent the gear disk from returning to the locked position.
Figure 38:
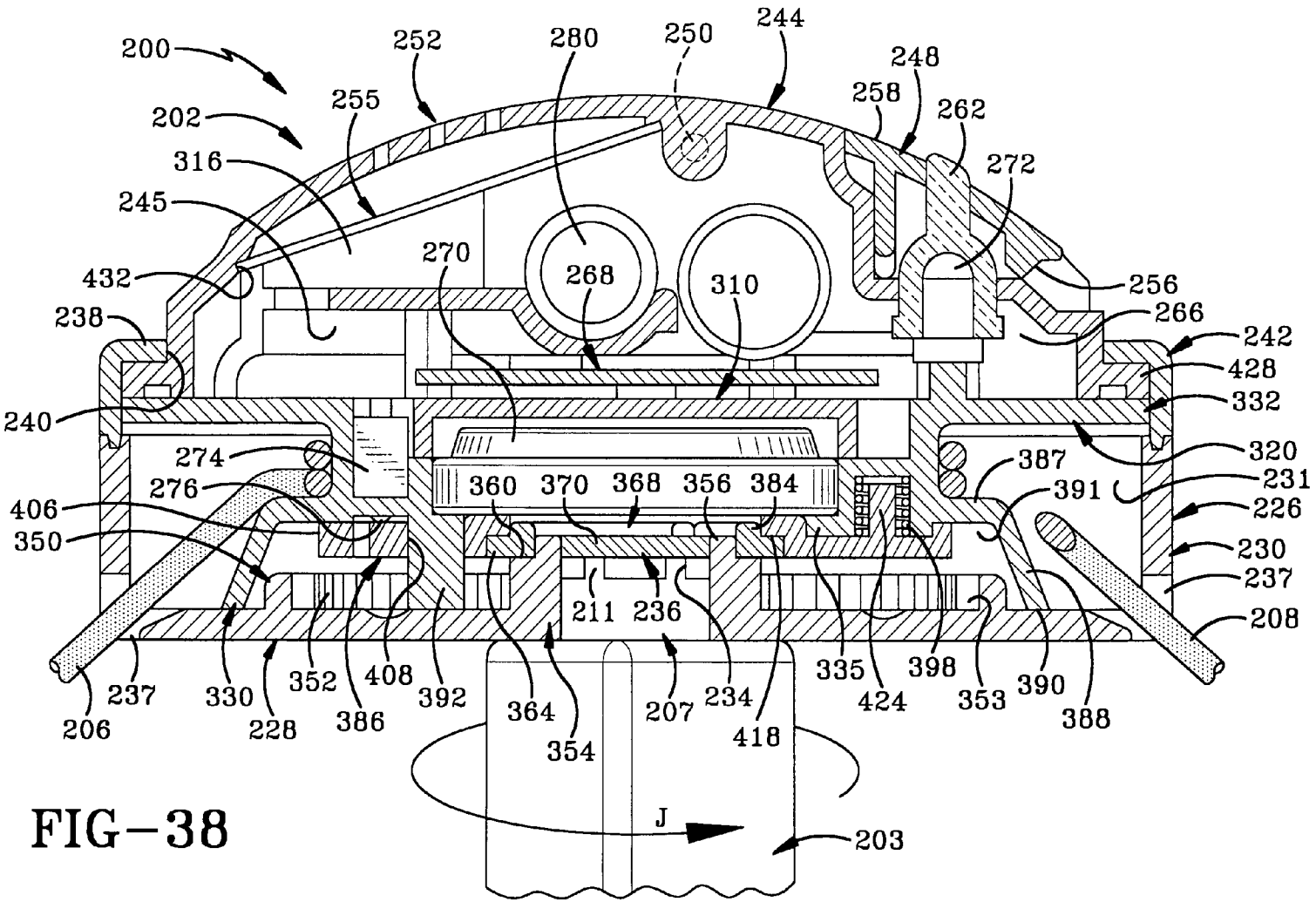
FIG. 38 is similar to FIG. 36 and shows the key rotated to rotate the locking disk to the retaining position.
Figure 39:
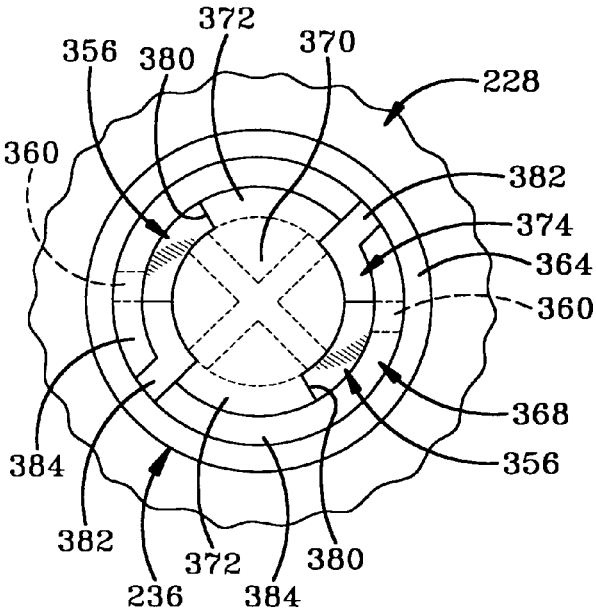
FIG. 39 is a fragmentary top view of the retaining mechanism with the locking disk in the retaining position.

Thus, as shown in FIGS. 37-38, base 203 is rotated (Arrow J in FIG. 38) to rotate locking disc 236 in the cable-loosening direction (Arrows K in FIG. 37) to a retaining position via engagement of key end 207 with keying formation 234. Locking disc 236 rotates relative to gear disc 386 in this process and thus outer annular wall portion 364 of disc 236 slidably engages elevated annular wall 414 of gear disc 386 during rotation of disc 236. In the unlocked position, this rotation is possible because seating ledges 360 are no longer disposed in radial slot sections 382 and disc 236 is able to rotate with arcuate projections 356 within arcuate slot sections 376. When thus rotated, respective portions of locking disc 236 are seated atop seating ledges 360 (FIGS. 38-39) to create an interference therebetween in the retaining position to prevent disc 236 from being forced back to its locked position. Key end 207 of base 203 may then be removed from opening 232 to disengage from locking disc 236 while locking disc 236 and gear disc 386 remain in their unlocked positions (FIG. 40) to allow the free wheeling rotation of gear disc 386 and spool 320 (Arrows L in FIG. 41) in the loosening direction to allow cable 204 to unwind from spool 320 and thus loosen (Arrows M in FIG. 41).

Figure 42:
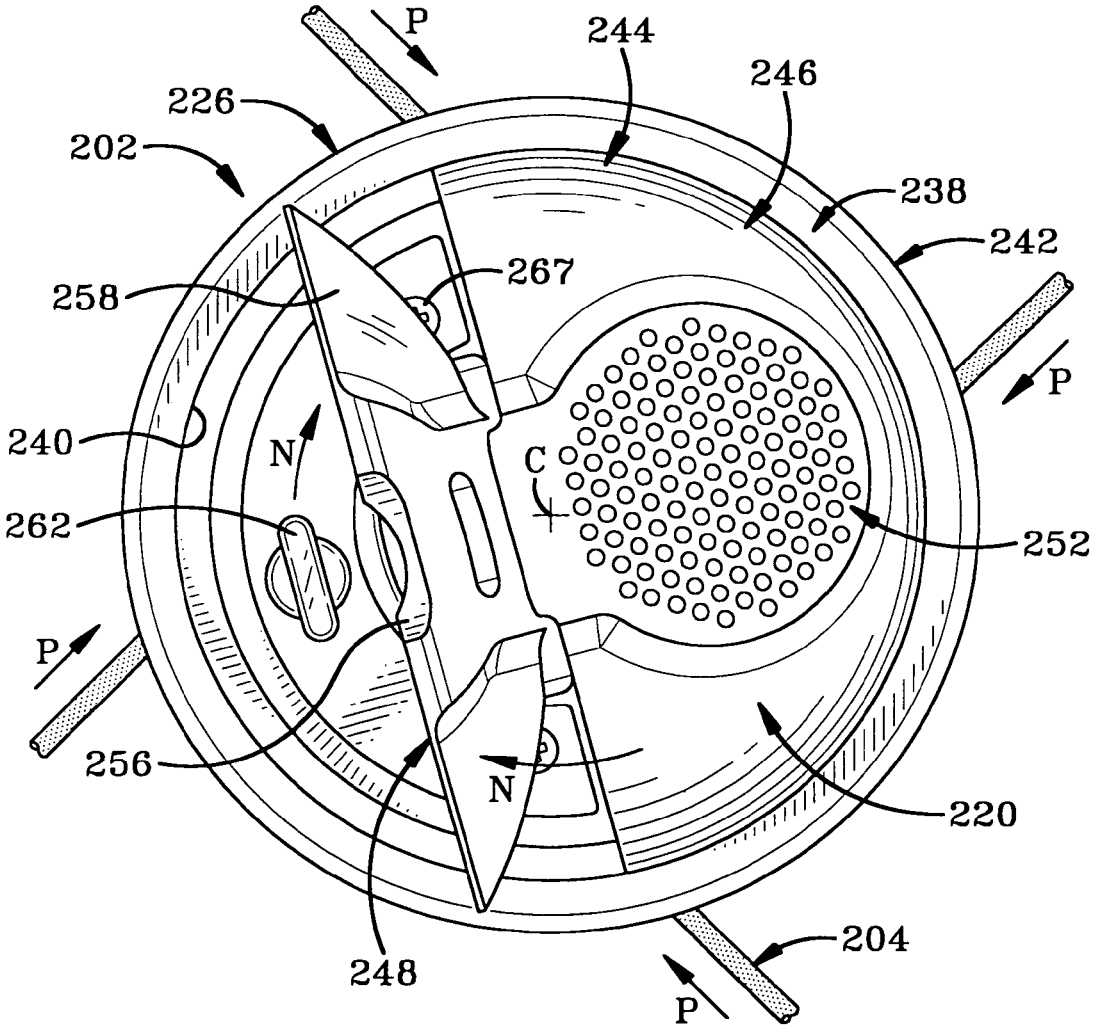
FIG. 42 is similar to FIG. 24 and shows the use of the flip-up handle to rotate the various rotatable members including the spool in order to tighten the cables.
Figure 43:
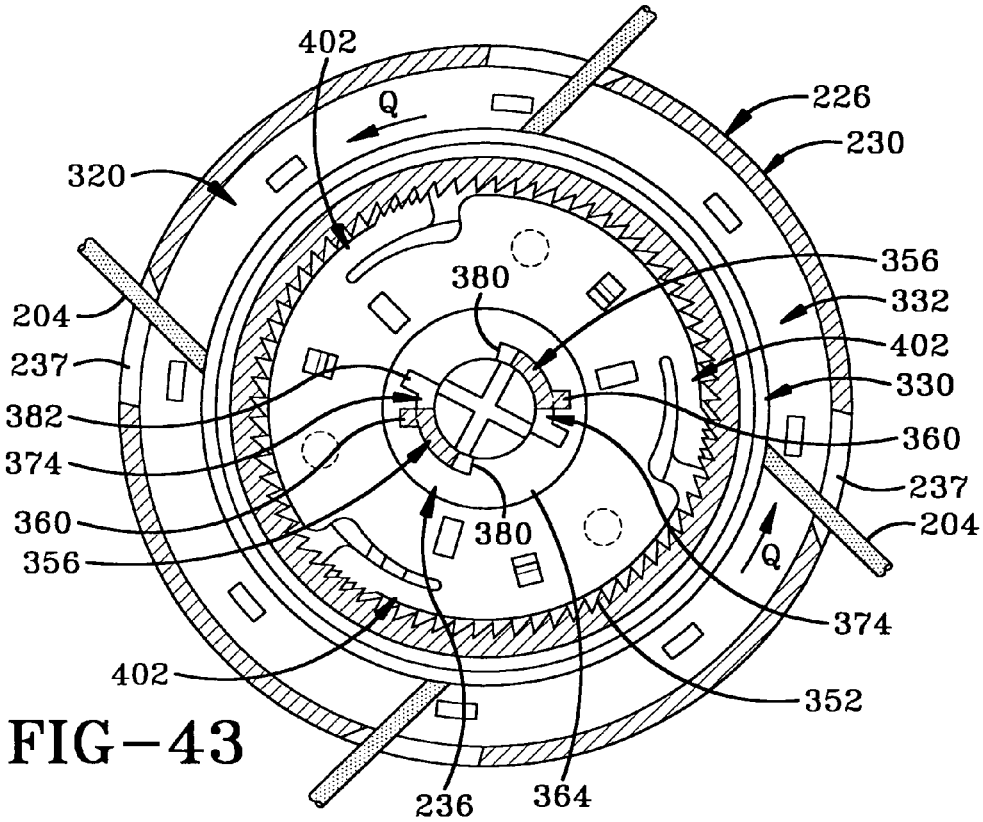
FIG. 43 is similar to FIG. 41 and shows the tightening rotation of the spool, gear disk and locking disk with the locking disk moving away from the retaining position.
Figure 44:
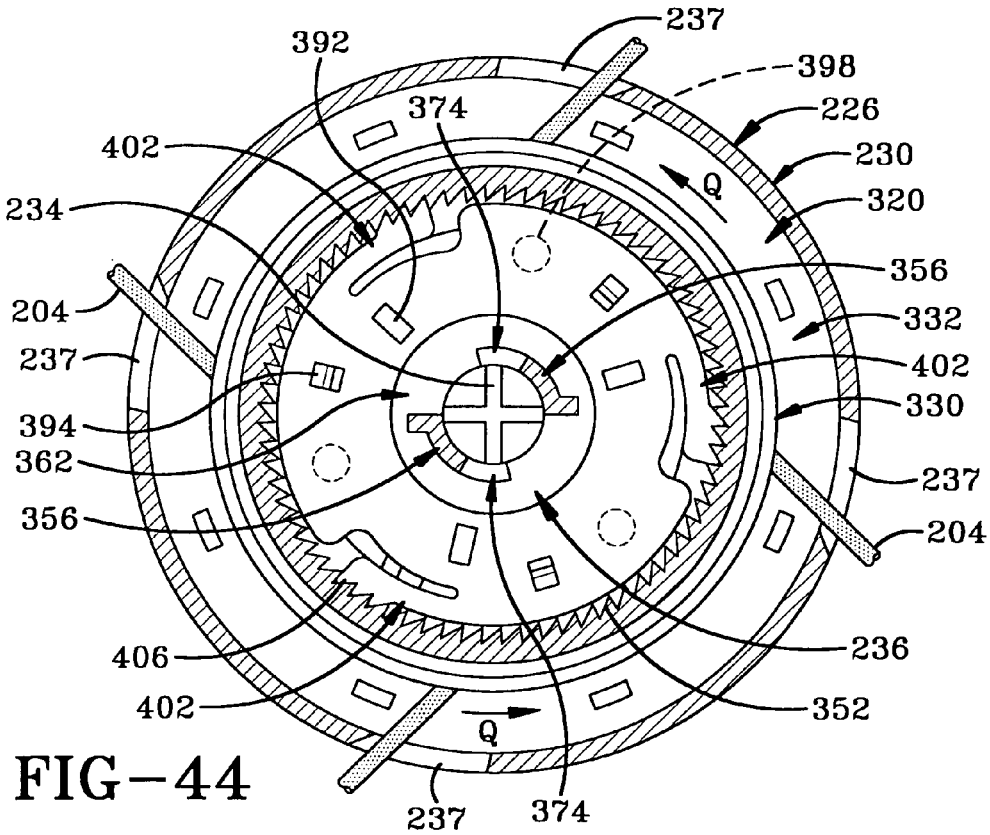
FIG. 44 is similar to FIG. 43 and shows the locking disk having rotated out of the retaining position to allow the locking disk and gear disk to move downwardly to the locked position.
Figure 45:
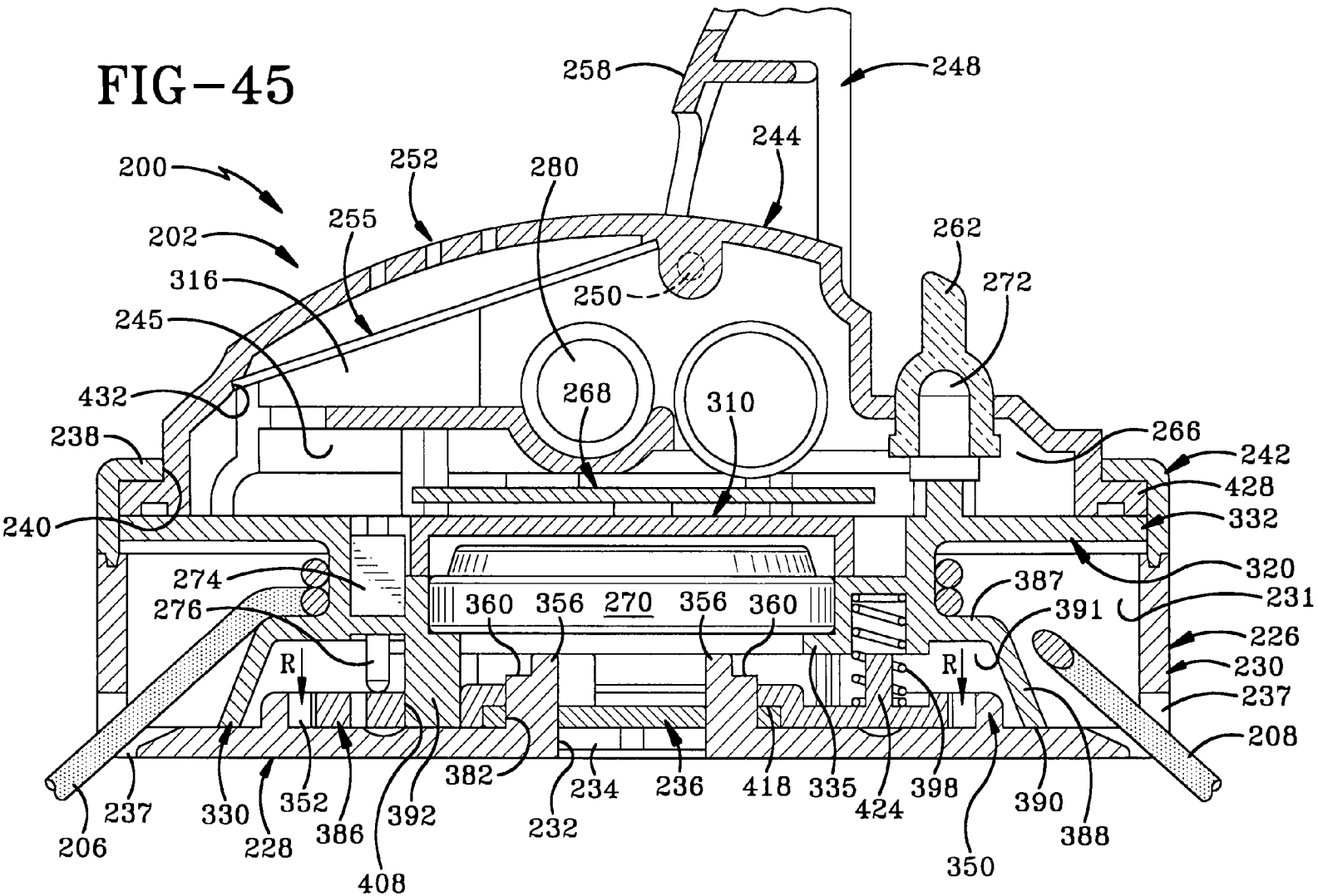
FIG. 45 is similar to FIG. 35 and shows the gear disk and locking disk moving downwardly to the locked position.

In order to tighten cable 204 again for use on another package like package 2, flip-up handle 248 is simply flipped up to the raised position (FIG. 42) and rotated in the cable-tightening direction (Arrows N in FIG. 42) which rotates spool 320 (Arrows Q in FIGS. 43-44) to wind cable 204 thereon to tighten cable 204 (Arrows P in FIG. 42). Rotation of spool 320 causes rotation of locking disc 236 in the cable-tightening direction via the frictional engagement therebetween (FIGS. 43-44). FIG. 43 shows locking disc 236 rotating away from the position shown in FIG. 41 while slidably riding on seating ledges 360 and continuing to retain gear disc 386 in the unlocked position. FIG. 44 shows locking disc 236 having rotated sufficiently to allow seating ledges 360 to align with radial slot sections 382 so that springs 398 force gear disc 386 and locking disc 236 linearly downwardly to their locked positions, as indicated at Arrows R in FIG. 45, with ledges 360 in slot sections 382 and with locking teeth 406 and 352 engaging one another allow rotation of spool 320 in the cable-tightening direction (FIG. 44) and prevent the opposite rotation.

Figure 46:
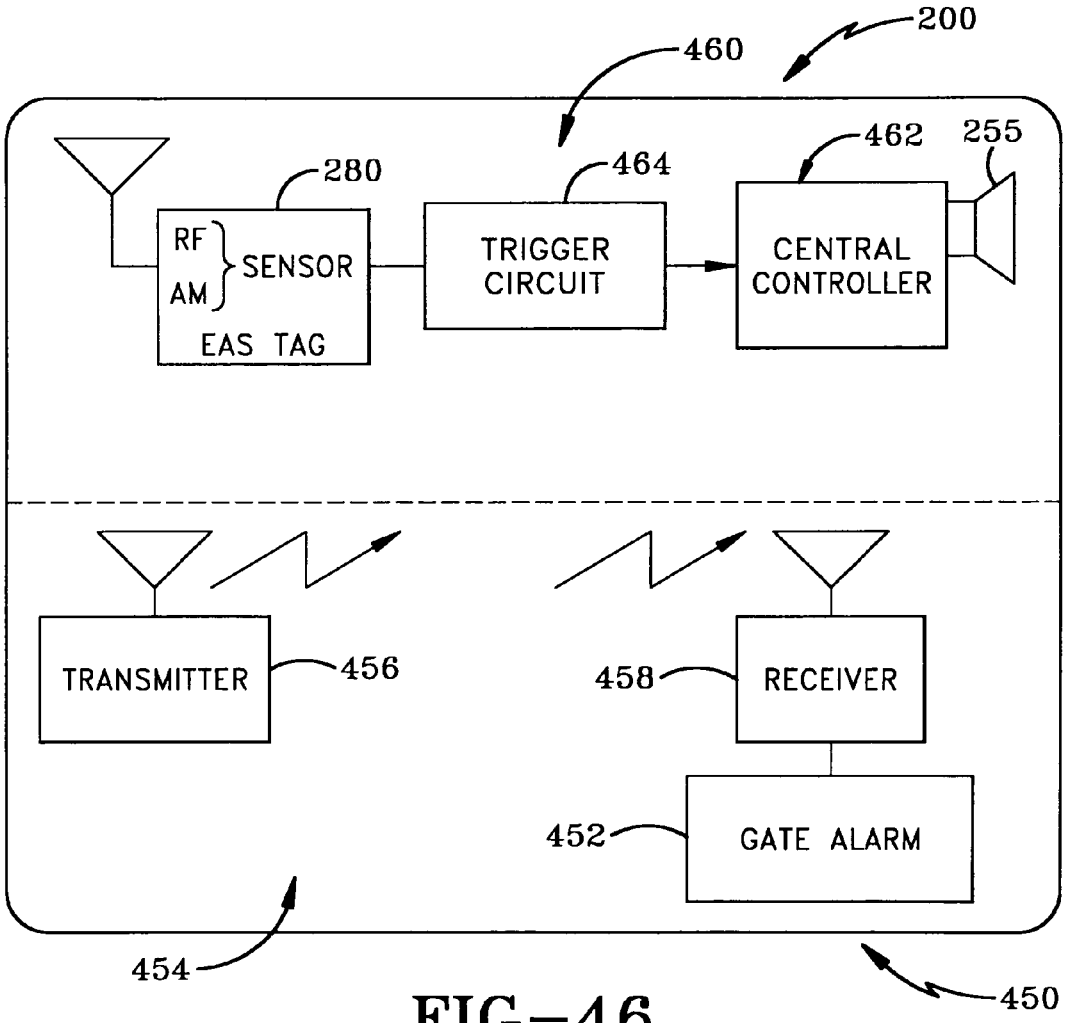
FIG. 46 is a block diagram of the security system of the present invention.

With reference to FIG. 46, security device 200 is part of a security system 450. Security system 450 includes a gate alarm 452 located in close proximity to a security gate 454. Security gate 454 includes a transmitter 456 and a receiver 458 for detecting an active EAS tag 280 upon it passing through security gate 454 by use of radio frequency (RF) or magnetic sensitivity (AM), all of which are well known in the security field, and thus are not described in further detail.

Device 200 is shown diagrammatically in the upper portion of FIG. 46 and includes a main circuit module 460 in the form of PCB 268 (FIG. 26), which includes a central controller 462, a trigger circuit 464 and EAS tag 280. Device 200 includes various sense loops for sounding an alarm if compromised.

When the integrity of the sense loop 282 (FIG. 26) is compromised, such as being cut, disconnected from the merchandise or pulled loose from the physical housing of the security device, it will cause central controller 462 to actuate audible alarm 255. Unless deactivated by store personnel, alarm 36 will continue to sound for a predetermined period of time, for example ten minutes thus increasing the difficulty of the thief concealing the merchandise even after leaving the store from which the merchandise was stolen. Central controller 462 sends pulses out periodically through sense loop 282 to ensure the sense loop is operating and that its integrity has not been compromised.

Sense loop 283 (FIG. 26) monitors an internal switch, such as reed switch 278, to determine if it has been actuated such as by use of a key to unlock or deactivate the protected display assembly or other protected device. Reed switch 278 can be either normally open or normally closed, to determine the condition thereof. For example, switch 278 (FIG. 2) can be actuated when a magnetic release key is placed on the security device to disarm the alarming circuit or to physically open and unlock the security device to remove it from the protected merchandise. Pressure switch 276 will actuate alarm 36 if unauthorized tampering depresses plunger 278 in response to unauthorized movement of locking disc 236 and gear disc 386 (FIG. 36). Controller 462 preferably provides a blinking on/off effect to LED 272 to advise store personnel that the security device is activated and to warn a potential thief that the merchandise is protected by an active security device which may help deter shoplifting.

Trigger circuit 464 works in conjunction with a security gate system external to security device 200 and in particular transmitter 456. The excitation level of trigger circuit 464 increases as EAS tag 280 approaches transmitter 456, and is adjusted by the selection and values of various resistors and capacitors therein to actuate alarm 255 when a specific level of excitation is reached. This correlates to a specific distance from security gate 454, and is usually closer than the authorized checkout counter and areas of a retail store. Thus, should a shoplifter attempt to steal package 2 with device 200 attached thereto without compromising the integrity of any of the sense loops, audible alarm 255 will still sound and remain audible for a specific period of time upon the shoplifter even approaching security gate 454 due to the RF or AM sensor 280 and trigger circuit 464 through central controller 462. Also as noted earlier, upon the shoplifted merchandise passing through security gate 454, EAS tag 250 will actuate the security gate alarm 452. This provides an additional security feature since at certain times, the security gate system may not be activated to sound its alarm due to the reduced sensitivity thereof but security device 200 would actuate internal alarm 255 that would remain audible on the stolen merchandise as it is removed from the premises, alerting personnel in the parking lot, adjacent streets, etc. that the item has been stolen since the alarm is still sounding.

In short, security system 450 provides for the sounding of an alarm should sense loops be compromised or device 200 be removed in an unauthorized manner from package 2; the sounding of a security gate alarm upon passing through the gate; and the sounding of the alarm contained in device 200 upon reaching a predetermined distance from the security gate, thus providing an alarm even though device 200 has not been removed from the protected merchandise.

Figure 68:
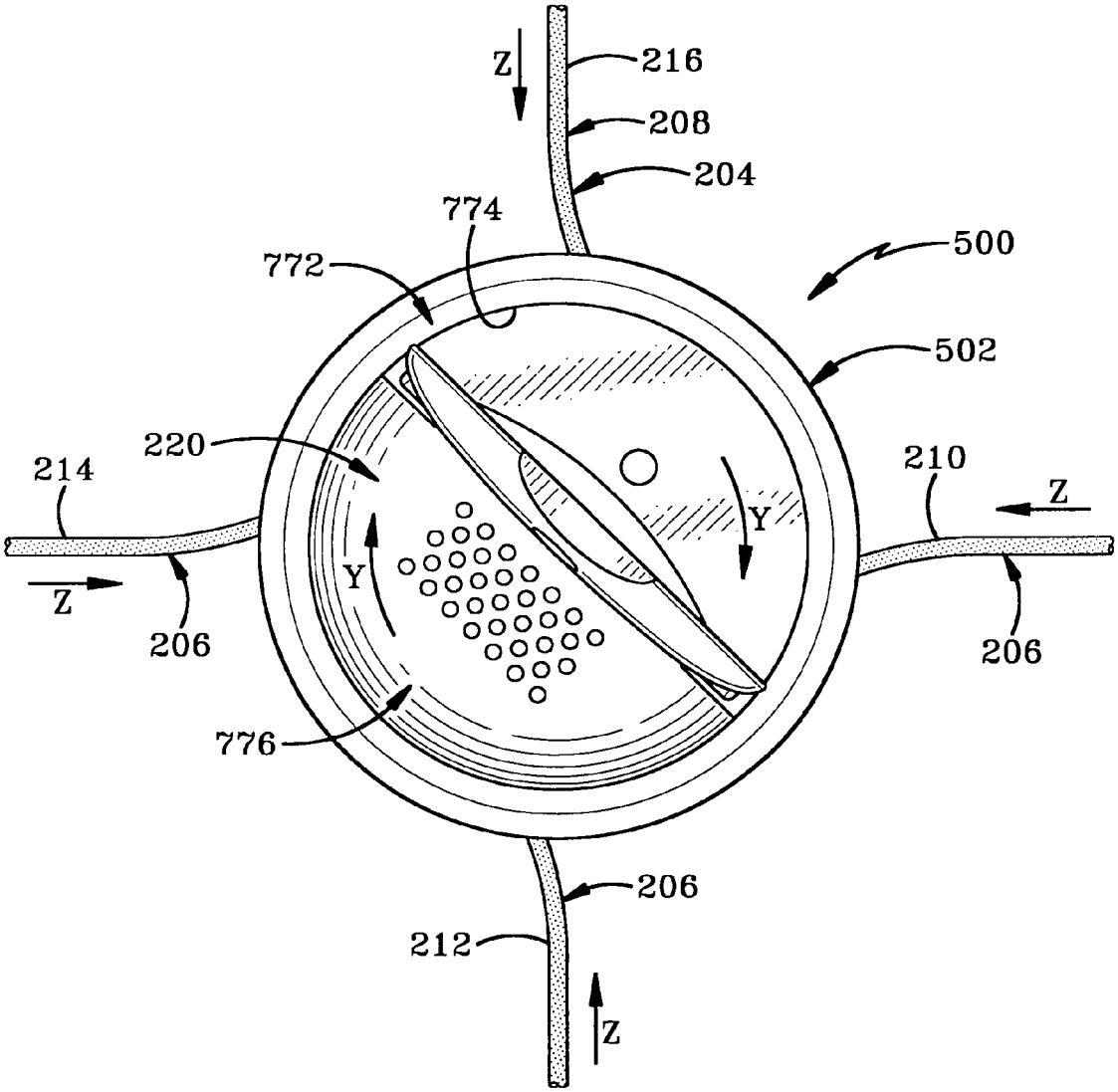
FIG. 68 is a top plan view of the tightening mechanism of the third embodiment showing the handle rotating in the tightening direction in order to wind the cables onto the spool.

The third embodiment of the security device of the present invention is indicated generally at 500 in FIGS. 47-49. Device 500 is similar to device 200 in a variety of ways, including the ability to be used as a part of security system 450 (FIG. 46) and thus operates in the same manner as device 200 with respect to gate alarm 452, security gate 454, transmitter 456 and receiver 458. Device 500 includes a tightening mechanism 502 which is a ratchet mechanism generally similar to those of the previous embodiments with several distinctive features. Device 500 also includes a locking member or cable-linking member 504 which is analogous to those of the previous embodiments as well. Device 500 is similar to the previous embodiments inasmuch as it includes a pair of cable loops 206 and 208 with the respective cable segments 210, 212, 214 and 216 such that the cable loops are connected to tightening mechanism 502 and member 504 for securing a package or object within an object-containing space 218. The configuration and operation of cables 206 and 208 illustrated were previously described with respect to security device 200. Like tightening mechanism 202, tightening mechanism 502 has a tightening side 220 which serves as its top and unlocking side 222 which serves as its bottom for purposes of the present description. As described further below, tightening side 220 utilizes a flip-up handle for rotating the internal spool and faces away from package 2 while unlocking side 22 faces and is closely adjacent object 2 in the secured position of device 500 shown in FIGS. 47 and 48. FIG. 49 shows device 500 in its unsecured position removed from package 2. The flip up handle is shown in its down position in FIG. 47 and in its up position in FIG. 68.

Member 504 includes two primary components, a base 506 and a fastener 508 which is lockably and removably secured to base 506. Base 506 is similar to that of the earlier embodiments except that it is a generally flat circular disc shape which provides additional stability once secured on package 2. Base 506 defines an interior chamber 510 having an entrance opening 512 for receiving the elongated leg of fastener 508. A pair of metal tines 12 are disposed within chamber 510 which are respectively received within angled recesses 20 such that the distal ends of metal tines 12 abut shoulders 21 at the terminal ends of recesses 20 in the locked position of member 504. Key 23 (FIG. 4) may be used in the same manner as previously described such that its magnets 24 may magnetically attract tines 12 in order to unlock member 504 such that fastener 508 may be removed from interior chamber 510 to separate from base 506. Base 506 serves as a key member having a 3-prong key end comprising a central cylindrical prong or projection 514 and a pair of lateral cylindrical or oval projections 516 which are spaced from central projection 514 on opposite sides thereof such that the three projections or prongs are aligned with one another. A circular or cylindrical opening 518 is formed in the center of central prong 514 extending inwardly from its terminal end.

Figure 50:
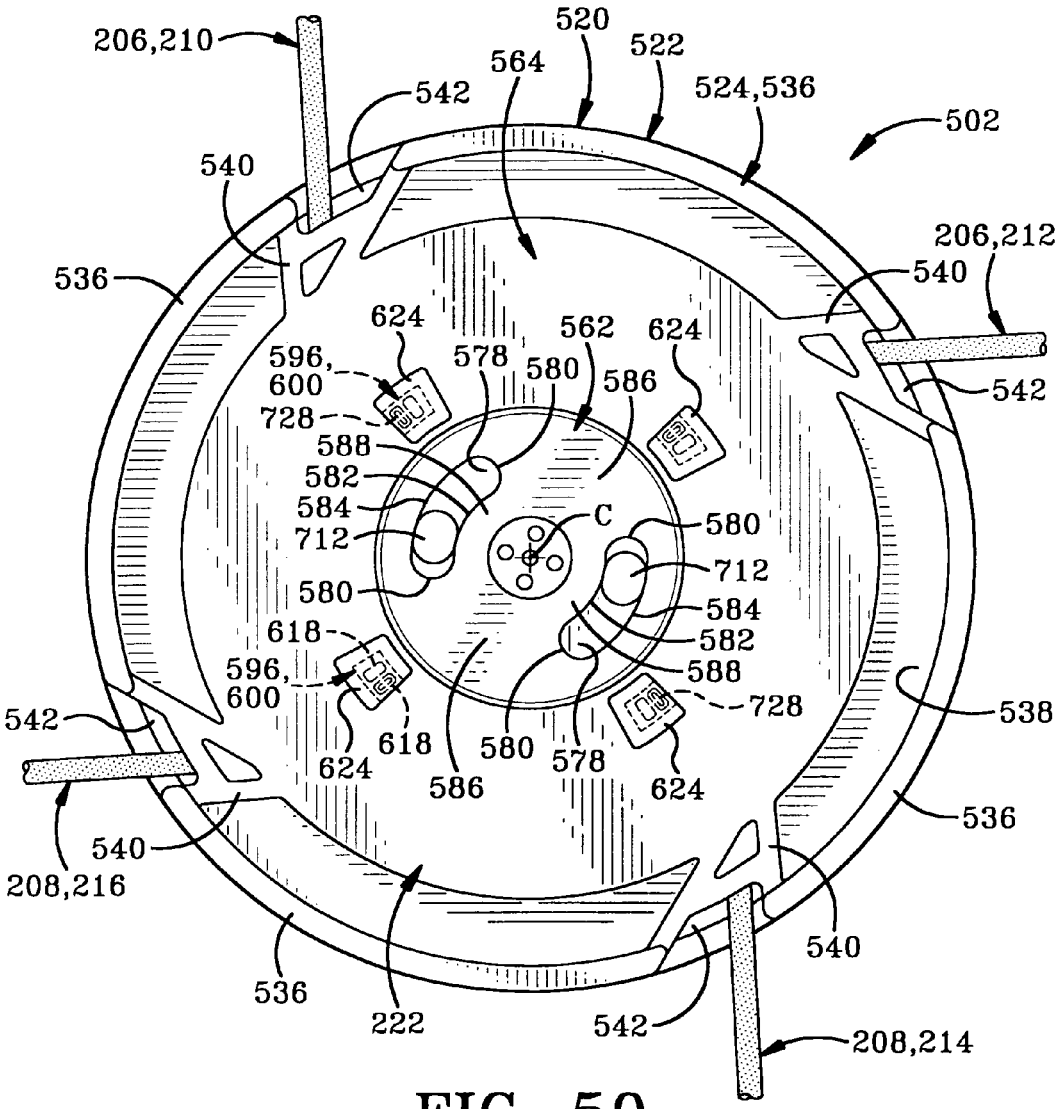
FIG. 50 is a bottom plan view of the tightening mechanism of the third embodiment.
Figure 51:
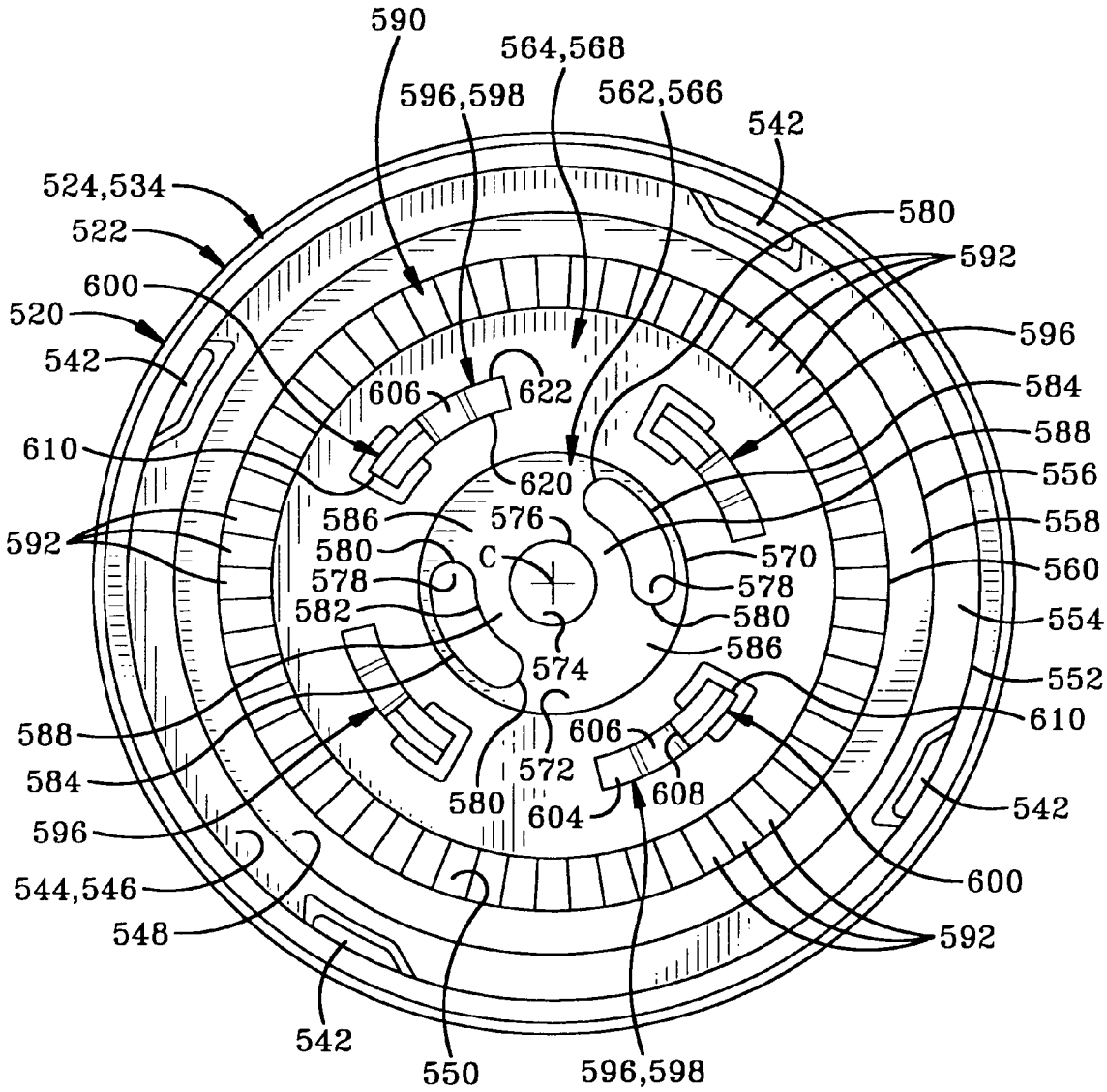
FIG. 51 is a top plan view of the bottom component of the housing.
Figure 52:
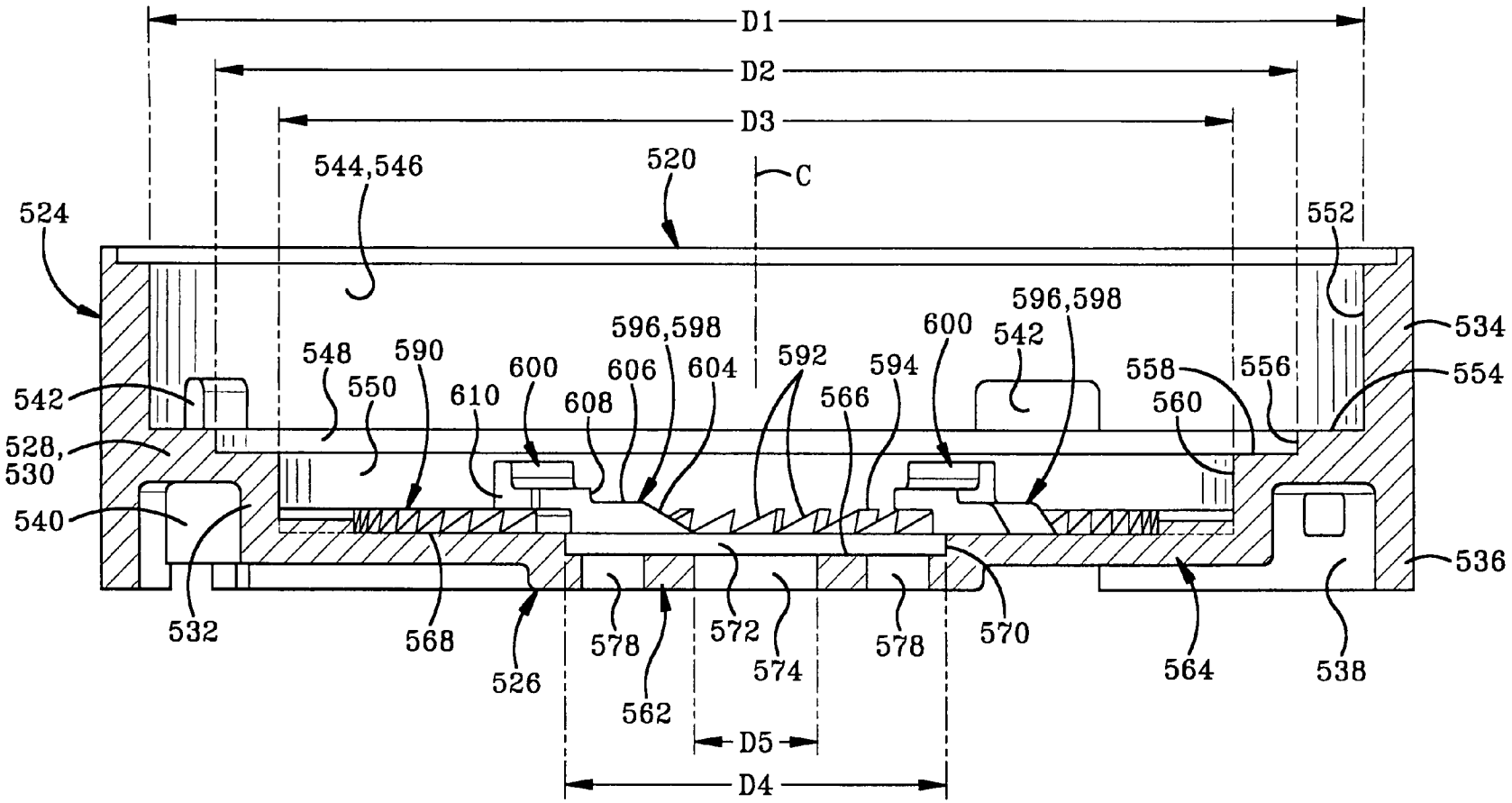
FIG. 52 is a sectional view of the bottom component of the housing showing some of the ratchet teeth, interference members and ramps from the side.

Referring now to FIGS. 50-52, a bottom component 520 of a housing 522 of tightening mechanism 502 is described in greater detail. Component 520 is typically formed of a substantially rigid material, which in the exemplary embodiment is a rigid plastic which is molded as an integral one-piece member. Component 520 includes an annular side wall 524 which in the exemplary embodiment is substantially cylindrical or circular as viewed from above. A substantially circular and flat horizontal bottom wall 526 is secured to side wall 524 via an annular circular step wall 528 which includes an annular horizontal wall 530 and an annular vertical wall 532. Horizontal wall 530 is rigidly secured to and extends radially inwardly from side wall 524 towards central vertical axis C, about which these various circular walls are concentric. Vertical wall 532 is rigidly secured to the radially inward end of horizontal wall 530 and extends vertically downward therefrom to a rigid connection with the radially outer edge of bottom wall 526. Side wall 524 thus includes an upper segment 534 which extends upwardly from horizontal wall 530 to the top of side wall 524 and a lower segment 536 which extends downwardly from horizontal wall 530 to a bottom terminal end of side wall 524. Lower segment 536 and vertical wall 532 define therebetween a circular annular space 538 which extends downwardly from the bottom of horizontal wall 530 and has a bottom entrance opening at the bottom of component 520. Four sets of generally radially extending sets of ribs or walls 540 (FIG. 50) extend between and are rigidly connected to vertical wall 532 and lower segment 536, and are rigidly secured to and extend downwardly from horizontal wall 530. Sets of ribs 540 are generally at 90° relative to one another such that annular space 538 is divided into four arcuate sections. Four cable receiving openings 542 are formed through upper segment 534 of side wall 524 respectively directly above sets of ribs 540 to receive-therethrough the respective cable segments of cable loops 206 and 208.

Bottom component 520 is a generally cup shaped structure which defines therein a main interior chamber or cavity 544 having upper, intermediate and lower portions 546, 548 and 550 such that intermediate portion 548 is narrower than upper portion 546, and lower portion 550 is narrower than intermediate portion 548. More particularly, upper segment 534 has a vertical circular inner surface or perimeter 552 which defines a diameter D1 of upper portion 546. Inner perimeter 552 extends downwardly from adjacent the top of component 520 to a top step of step wall 528 which has an upwardly facing top surface 554 which defines the bottom of upper portion 546. Annular circular top surface 554 extends radially inwardly from the bottom of inner perimeter 552. Another vertical circular inner perimeter 556 steps downwardly from top surface 554 and defines a second diameter D2 of intermediate portion 548 which is smaller than diameter D1. Inner perimeter 556 steps downwardly to a second lower step of step wall 528, and more particularly to a horizontal annular circular upper surface 558 which extends radially inwardly from inner perimeter 556 to another smaller inner perimeter 560, which steps downwardly therefrom and defines a diameter D3 of lower portion 550 which is smaller than diameter D2. Upper and intermediate portions 546 and 548 serve as a spool receiving space which receives the vast majority of an internal spool 551 (FIGS. 57A, 59) of the tightening mechanism, which will be described in greater detail further below. Intermediate portion 548 serves as a flange receiving space which receives the lower flange of said spool. In the exemplary embodiment, side wall 524 and step wall 528 are concentric about central vertical axis C, as are the various inner perimeters 552, 556 and 560, as well as the upwardly facing surfaces 554 and 558.

With continued primary reference to FIGS. 50-52, bottom wall 526 and the internal and external structures attached thereto are described in greater detail. Bottom wall 526 includes an annular circular central lower wall section 562 and an outer annular circular wall section 564 which is stepped upwardly slightly from and is rigidly connected to the outer perimeter of central section 562 and extends radially outwardly therefrom to a rigid connection with the bottom of vertical wall 532. Each of sections 562 and 564 is flat and horizontal whereby sections 562 and 564 have respective flat upwardly facing top surfaces 566 and 568. Outer section 564 defines a circular inner perimeter 570 which steps downwardly from top surface 568 to top surface 566 and defines a diameter D4 of a flat horizontal circular space or chamber 572 the top of which communicates with lower portion 550 of chamber 544 and the bottom of which is bounded by top surface 566 of central section 562. Diameter D4 is substantially smaller than diameter D3. A circular central through hole 574 is formed in the center of section 562 defined by a circular inner perimeter 576 defining a diameter D5 which is smaller than diameter D4 and which extends from the top surface to the bottom surface of section 562. Hole 574 thus communicates with space 572 and the outside of component 520 and serves as a bottom entrance opening to the interior chamber of component 520 and also serves as a prong receiving hole for receiving therein central prong 514 of the key member 504.

A pair of arcuate and generally kidney shaped openings 578 is also formed through section 562 on opposite sides of and radially spaced from central hole 574. Openings 578 serve as prong receiving openings or holes respectively for the lateral prongs 516 of the key member. Each opening 578 is defined by an inner perimeter having circumferentially opposed ends 580, an inner convexly curved edge 582 which is concentric about axis C and an outer concavely curved edge 584 which is also concentric about axis C. Each end 580 of one opening 578 and the adjacent or nearest end 580 of the other opening 578 define therebetween a circumferentially extending arcuate segment 586 which extends in a continuous fashion therebetween and also between perimeter 576 of hole 574 and perimeter 570. A pair of arcuate bridges 588 are disposed on opposed sides of hole 574 and bounded by inner perimeter 576 and respectively by inner edges 582. Each bridge 588 is concentric about axis C and extends between and is connected to arcuate segments 586.

A set 590 of internal one-way ratchet teeth 592 is arranged in a circular pattern and extends upwardly from top surface 568 of outer wall section 564. FIG. 52 illustrates that as viewed from the side along a radius perpendicular to axis C, each tooth 592 is triangular and has a wider base which narrows upwardly to a pointed tip 594 which is horizontal and radially elongated along a respective radius perpendicular to axis C. Set 590 is thus formed or lies along a circle which is concentric about axis C. Each tooth 592 and its tip 594 is connected to and extends radially inwardly from inner perimeter 560 of vertical wall 532. Set 590 is thus spaced radially outwardly from holes 574 and 578 and space 572, and lies along the outer perimeter of top surface 568.

With primary reference to FIGS. 50-52 and 61, four circumferentially spaced rigid projections 596 are rigidly secured to and extend upwardly from outer wall section 564 and are spaced radially inwardly of set 590 of teeth 592 and radially outwardly of inner perimeter 570, space 572 and holes 574 and 578. As most easily seen in FIG. 61, projection 596 includes a base 598 which is rigidly secured to and extends upwardly from top surface 568, and an overhanging finger or interference member 600 which is rigidly secured to the top of base 598 adjacent one 614 of its circumferential ends and extends circumferentially outwardly from said circumferential end 614 whereby it overhangs a space or undercut 602. The opposed circumferential end of base 598 forms a ramp 604 or angled surface which angles circumferentially upwardly from top surface 568 to a horizontal seating ledge 606 which is the upwardly facing horizontal top surface of base 598 and which serves as a retaining surface as discussed further below. Interference member 600 has circumferentially opposed ends 608 and 610 wherein end 608 extends upwardly from ledge 606 opposite ramp 604 and serves as a stop. Finger 600 is secured to base 598 adjacent end 608 and extends circumferentially away from ramp 604 in a cantilever fashion such that end 610 is a vertical free end of finger 600.

Figure 60:
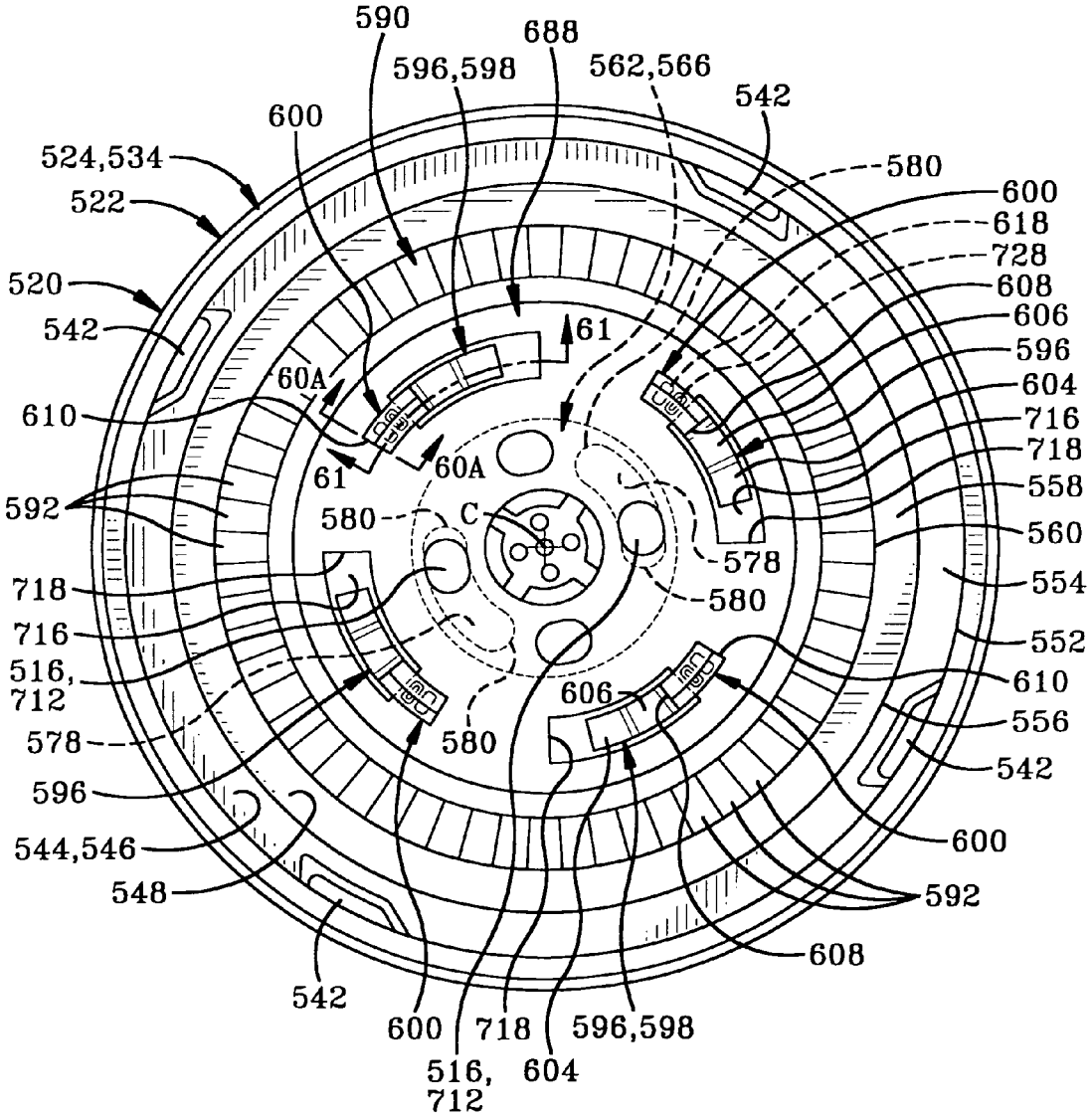
FIG. 60 is a top plan view of the bottom component of the housing and the locking disc with the other components removed showing the locking disc in the locked position.

Interference member 600 has a horizontal downwardly facing bottom surface 612 which extends from free end 610 toward base 598 to circumferential end 614 of base 598 opposite ramp 604. End 614 faces away from ramp 604 and extends downwardly from bottom surface 612 and is thus lower than surface 612 and ends 610 and 608 of finger 600. Finger 600 has a generally L-shaped configuration (FIGS. 52, 60A, 60B) as viewed from its end, that is, along a horizontal tangent to its radially inner or outer surfaces. Thus, the L-shaped finger includes a horizontal leg 601 and a vertical leg 603 rigidly secured to the radial outward edge of leg 601 and extending upwardly therefrom. End 614 is a vertical surface which serves as a stop and faces circumferentially away from end or stop 608 in the opposite direction therefrom. Each of ends or stops 608 and 614 extend radially substantially along a respective radius perpendicular to axis C. Undercut 602 is thus bounded at its top by bottom surface 612 and at its closed end by end or stop 614. Undercut 602 is disposed entirely above top surface 568 and has an entrance opening 616 directly below free end 610, and thus circumferentially opposite end 614. Undercut 602 also opens radially inwardly and radially outwardly. A pair of circumferentially spaced shallow indentations or detents 618 are formed in interference member 600 extending upwardly from bottom surface 612. FIG. 51 shows that the four projections 596 form arcs of a common circle which is concentric about axis C. More particularly, each of the projections 596 has respective inner concavely curved edges 620 which lie along a common circle concentric about axis C. Likewise, the projections 596 have respective outer convexly curved edges 622 which are arcs lying along a common circle which is concentric about axis C. Four circumferentially spaced holes 624 are formed in outer wall section 564 extending from its top surface to its bottom surface so that holes 624 are positioned directly below interference members 600. Holes 624 do not affect the function of device 500, but do allow for bottom component 520 to be molded as an integral one-piece member.

Figure 53:
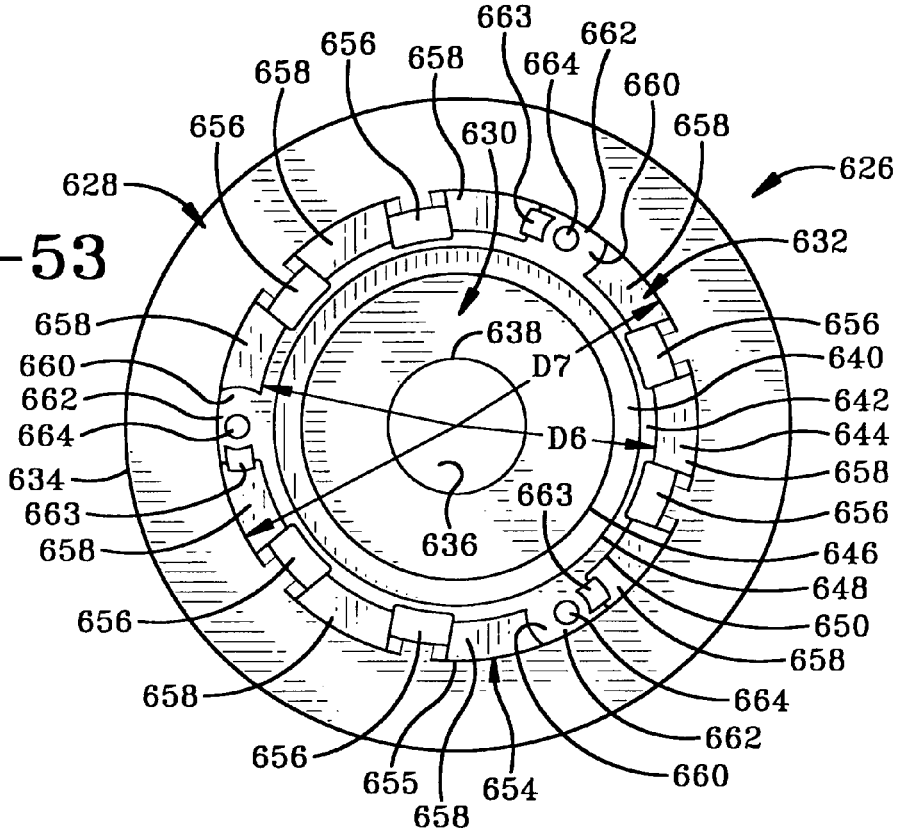
FIG. 53 is a top plan view of the gear disc of the third embodiment.
Figure 54:
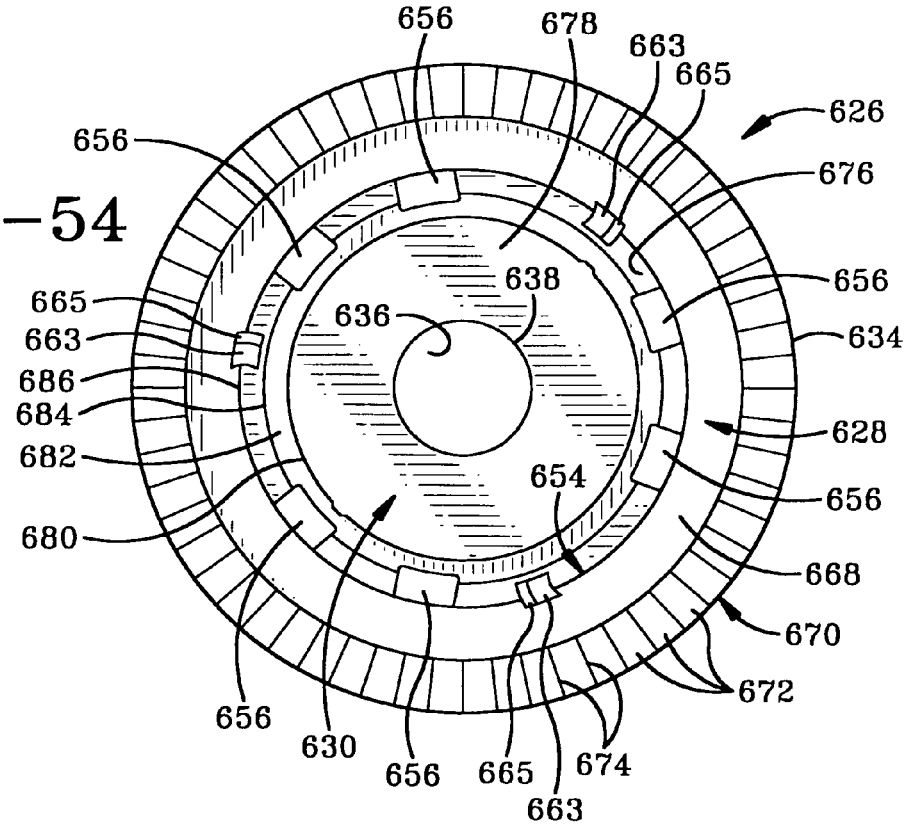
FIG. 54 is a bottom plan view of the gear disc of FIG. 53.
Figure 55:
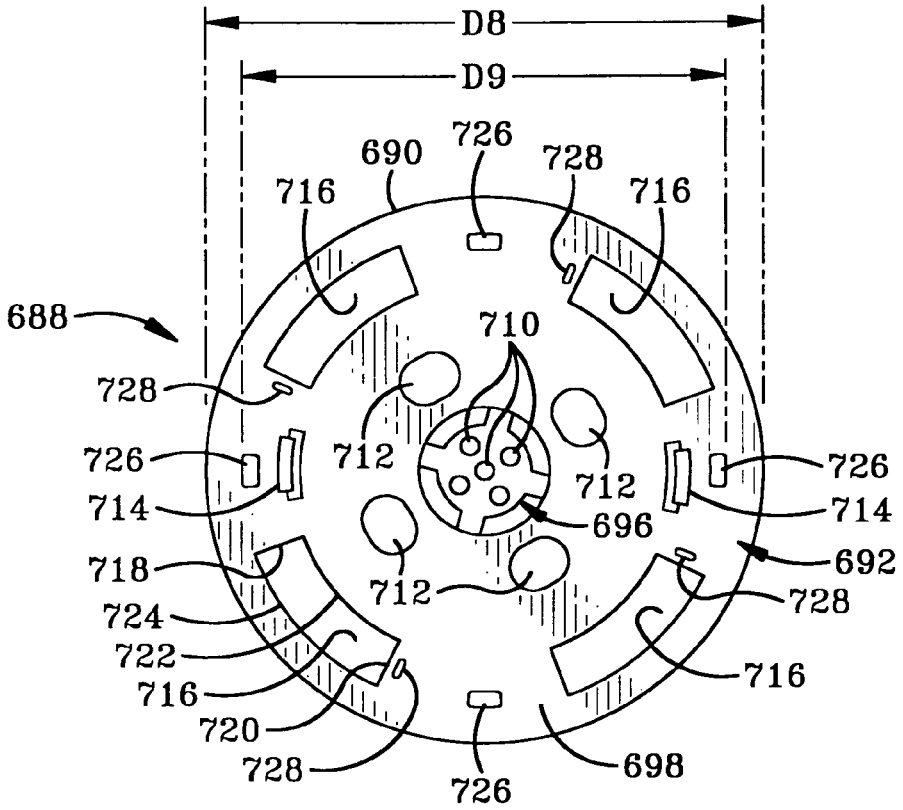
FIG. 55 is a top plan view of the locking disc or retaining member of the third embodiment.
Figure 59:
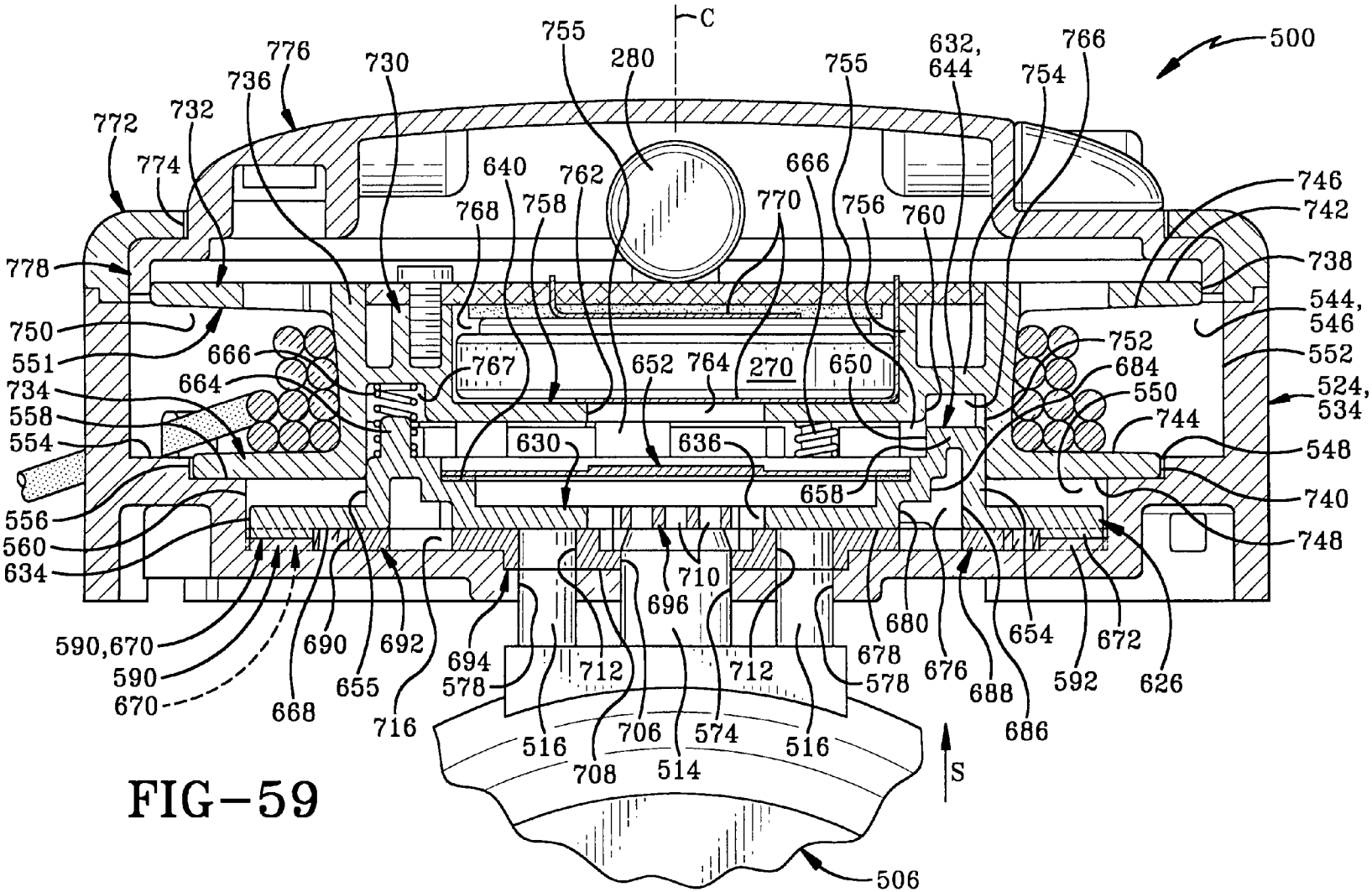
FIG. 59 is a sectional view of the tightening mechanism from the side in the locked position showing the key member inserted through the bottom openings and applying an upward force on the locking disc.

Device 500 further includes a rigid gear disc 626 which is one of several internal members and which is described with primary reference to FIGS. 53, 54 and 59. In part, gear disc 626 rotates with spool 551 (FIG. 59) when device 500 is assembled as will be described in greater detail further below. It also serves as one of two engaging members which engage one another to prevent rotation of gear disc 626 and spool 551 in a cable loosening direction and disengage from one another to allow such rotation. Disc 626 is typically formed of a rigid plastic and includes a flat horizontal circular outer annular wall 628, a horizontal flat circular inner annular wall 630 which is coplanar with and at the same height of outer wall 628, and a circular annular ridge 623 which is rigidly connected to and extends upwardly between the inner and outer walls 628 and 630. Outer wall 628 has an outer perimeter 634 which serves as the outer perimeter of disc 626. A central hole 636 is formed in inner wall 630 and bounded by or defined by a circular inner perimeter 638 which serves as the inner perimeter of gear disc 626. These various circular walls and perimeters are concentric with one another about axis C when device 500 is assembled. Annular ridge 632 includes a step wall which steps upwardly and radially outwardly from inner wall 630. More particularly, this step wall includes horizontal circular annular bottom, intermediate and top steps 640, 642 and 644 which respectively are concentric about axis C when device 500 is assembled. More particularly, the step wall steps upwardly from the top surface of inner wall 630 at a circular vertical inner perimeter 646 to bottom step 640, then steps upwardly from bottom step 640 at another circular vertical inner perimeter 648 to intermediate step 642, and then again upwardly from intermediate step 642 at a third vertical circular inner perimeter 650 to top step 644. The step wall thus defines therewithin an interior chamber or cavity the bottom of which is defined by the top surface of inner annular wall 630, which opens upwardly at a top entrance opening and which has a smaller diameter portion defined by inner perimeter 646, an intermediate diameter portion defined by perimeter 648 and a larger diameter D6 (FIG. 53) top portion defined by inner perimeter 650. The intermediate portion of this cavity receives therein a piezo speaker 652 (FIG. 59) which is a generally flat horizontal disc with its outer perimeter seated atop bottom step 640.

Annular ridge 632 further includes a vertical circular outer annular wall 654 which is secured to and extends downwardly from the outer perimeter of top step 644 to a rigid connection with the inner perimeter of outer annular wall 628. Outer annular wall 654 has a vertical circular outer perimeter 655 defining an outer diameter D7 of wall 654. A series of circumferentially spaced post receiving holes 656 are formed in top step 644 and outer annular wall 654 so that step 644 and annular wall 654 are non-continuous or interrupted annular walls which are thus divided into upwardly projecting arcuate segments 658. Some of these segments 658 are defined between a respective adjacent pair of holes 656. However, there are also three spring receiving openings 660 formed in top step 644 and outer annular wall 654 whereby some of arcuate segments 658 are defined between one of holes 656 and one of openings 660. The bottom of each opening 660 is defined by a horizontal radial extension 662 which is a part of intermediate step 642 and extends radially outwardly beyond inner perimeter 650. Three vertical openings 663 are formed respectively through extensions 662 and respective portions of the arcuate segments 658 bounding one side of the respective extension 662. Openings 663 communicate respectively with openings 660 and are bounded by a respective downwardly facing latch ledges 665 (FIG. 54). A post 664 is secured to and extends upwardly from each extension 662 generally in the center of the corresponding opening 660. A coil spring 666 (FIG. 59) is received within each opening 660 with its lower end seated on the respective extension 662 and with respective post 664 extending upwardly therein when device 500 is assembled.

As shown in FIG. 54, outer annular wall 628 has a flat horizontal downwardly facing annular bottom surface 668 from which a set 670 of locking teeth 672 extend downwardly to respective sharp tips 674. Set 670 is arranged in a circular pattern in the same manner as set 590 (FIG. 51) of teeth 592 of bottom component 520. Teeth 672 are also one-way ratchet teeth which are identical to teeth 592 except that they are inverted or upside down relative thereto such that teeth 672 and teeth 592 serve as the engaging members previously noted which when engaged prevent rotation of gear disc 626 and spool 551 (FIG. 59) in the cable loosening direction while allowing rotation in the cable tightening direction as teeth 672 slide over teeth 592. When teeth 672 and 592 are disengaged from one another, gear disc 626 and spool 551 are rotatable about axis C in the cable loosening direction to unwind the cable therefrom. Teeth 672 extend radially inwardly from outer perimeter 634 such that each horizontal tip 674 lies substantially along a radius perpendicular to axis C.

Figure 60A:
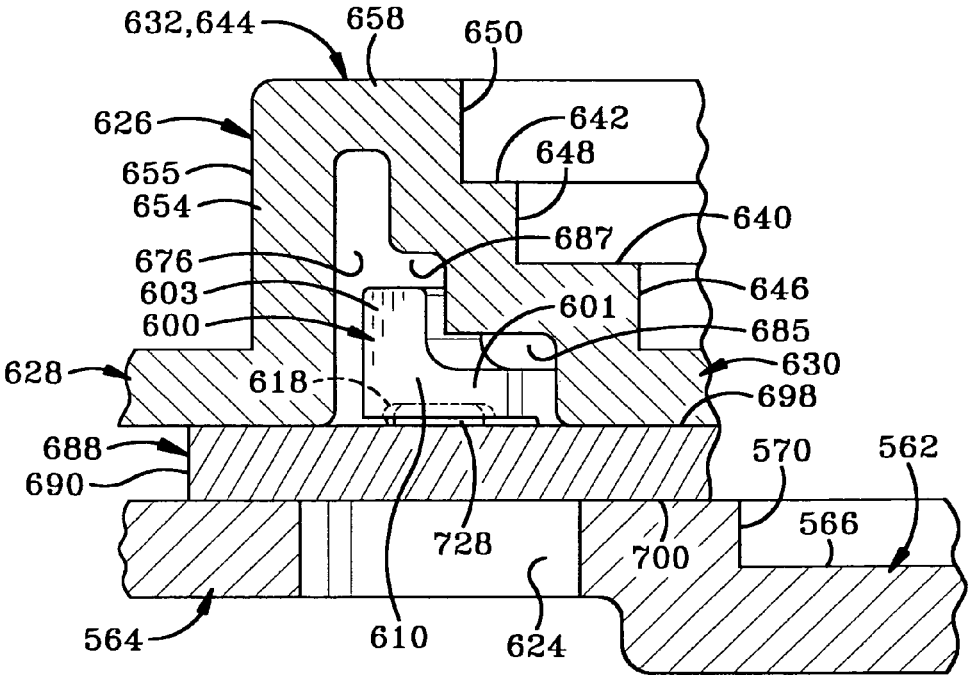
FIG. 60A is an enlarged sectional view showing a portion of the bottom wall of the housing with one of the interference members extending upwardly above the locking disc and into the annular cavity of the gear disc in the locked position.
Figure 60B:
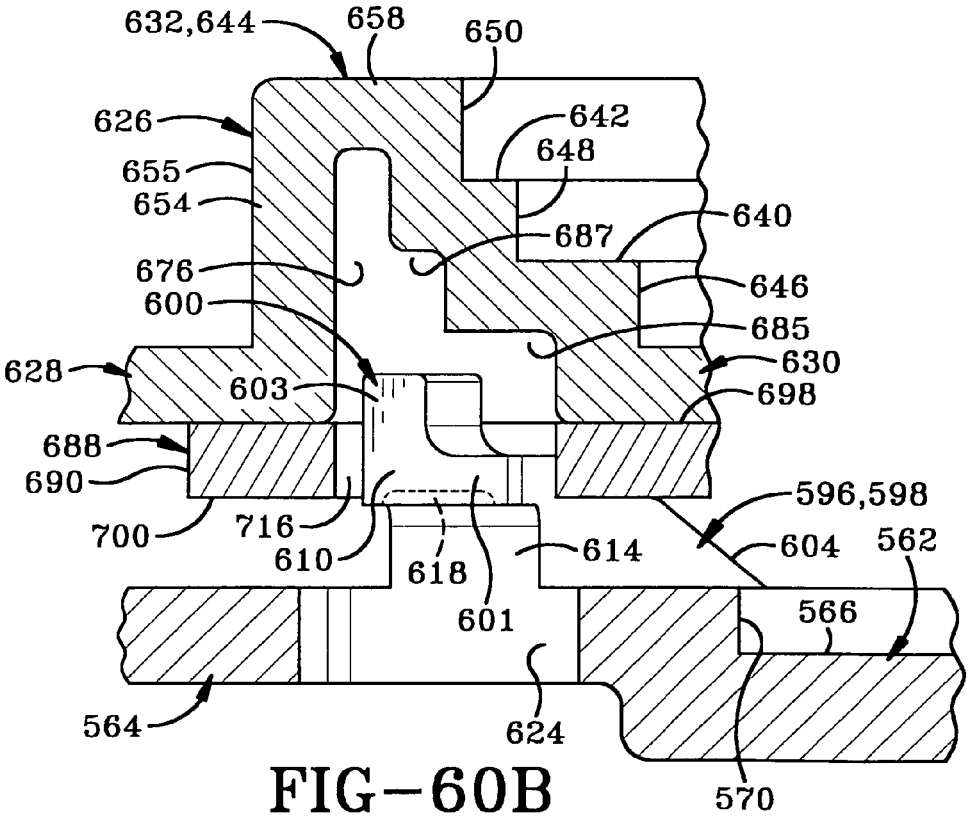
FIG. 60B is similar to FIG. 60A in the unlocked position.

A continuous circular annular cavity 676 (FIGS. 54, 59) is formed within annular ridge 632 extending upwardly from the bottom surface of gear disc 626 whereby cavity 676 opens downwardly at a bottom entrance opening. More particularly, annular cavity 676 is defined between outer annular wall 654 and the stepped wall of annular ridge 632 and is concentric about axis C. As shown in FIGS. 54 and 59, inner annular wall 630 has a circular flat horizontal annular bottom surface 678 which steps upwardly at a circular outer perimeter 680 of wall 630 to another horizontal circular annular bottom surface 682 extending below bottom and intermediate steps 640 and 642. Another larger diameter outer perimeter 684 of step 640 steps vertically upwardly from bottom surface 682. Thus, annular cavity 676 includes a generally L-shaped cross-sectional portion such that a radially wider lower or bottom portion 685 (FIGS. 60A, 60B) of cavity 676 is defined between outer perimeter 680 and inner perimeter 686 of outer annular wall 654, and a radially narrower upper portion 687 is defined between outer perimeter 684 and inner perimeter 686. As shown in FIG. 60A, the L-shaped finger 600 of the interference member is received in this L-shaped cross-sectional portion such that vertical leg 603 of the finger is received in narrower upper portion 687 and horizontal leg 601 of the finger is received in wider bottom portion 685 when gear disc 626 and locking disc 688 are in the lowered locked position. When gear disc 626 and locking disc 688 are in the raised unlocked position (FIG. 60B), horizontal leg 601 of this finger is typically completely removed from cavity 676 while vertical leg 603 is completely removed from upper portion 687 and is disposed in wider bottom portion 685, or may also be completely removed from cavity 676.

Device 500 further includes another rigid internal member in the form of a locking disc 688 which is described in greater detail with primary reference to FIGS. 55-57 and 59. Locking disc 688, which is typically formed of a rigid plastic, may also be referred to as an unlocking disc or a retaining member inasmuch as disc 688 serves as part of a locking or unlocking mechanism as well as serves to retain the gear disc in its unlocked position as will be discussed in greater detail further below. Locking disc 688 is a substantially flat horizontal circular disc having a circular outer perimeter 690 defining an outer diameter D8 which is less than the diameter defined by the respective inner perimeters of sets 590 of teeth 592 and 670 of teeth 672. Diameter D8 is also greater than that defined by inner perimeter 686 of outer annular wall 654 of gear disc 626. Outer perimeter 690 is concentric about axis C, which passes through the center of disc 688, and about which disc 688 is rotatable relative to the housing, gear disc and spool.

Locking disc 688 includes a main radially outer and vertically intermediate or middle circular wall or disc 692 which defines outer perimeter 690, a lower flat circular annular wall or disc 694, and an upper flat horizontal annular wall or disc 696. Main wall 692 has flat horizontal top and bottom opposed surfaces 698 and 700 which respectively face upwardly and downwardly. Lower wall 694 is secured to and extends downwardly from bottom surface 700 while upper wall is secured to and extends upwardly from top surface 698. Lower wall 694 has an outer perimeter 702 which defines a diameter which is slightly less than diameter D4 (FIG. 52) of space 572. When assembled, lower wall 694 is disposed in space 572 such that outer perimeter 702 is in contact or closely adjacent inner perimeter 570 of space 572, thus typically providing a sliding engagement between said inner and outer perimeter during rotation of locking disc 688. Lower wall 694 also has an inner perimeter 704, which like perimeter 702 is concentric about axis X and which defines a prong receiving opening 706 having a diameter slightly greater than that of prong 514 of key member 506. Lower wall 694 has a flat horizontal bottom surface 708 which is seated atop top surface 566 whereby said surfaces slidably engage one another during rotation of disc 688. Upper wall 696 is received within central hole 636 of gear disc 626 when device 500 is assembled. Upper wall 696 defines a plurality of small speaker holes 710 which extend from its bottom surface to its top surface whereby holes 710 communicate with opening 706 therebelow and space 572 of cavity 544 of gear disc 626. Speaker holes 710 are positioned directly below and adjacent speaker 652.

Figure 57:
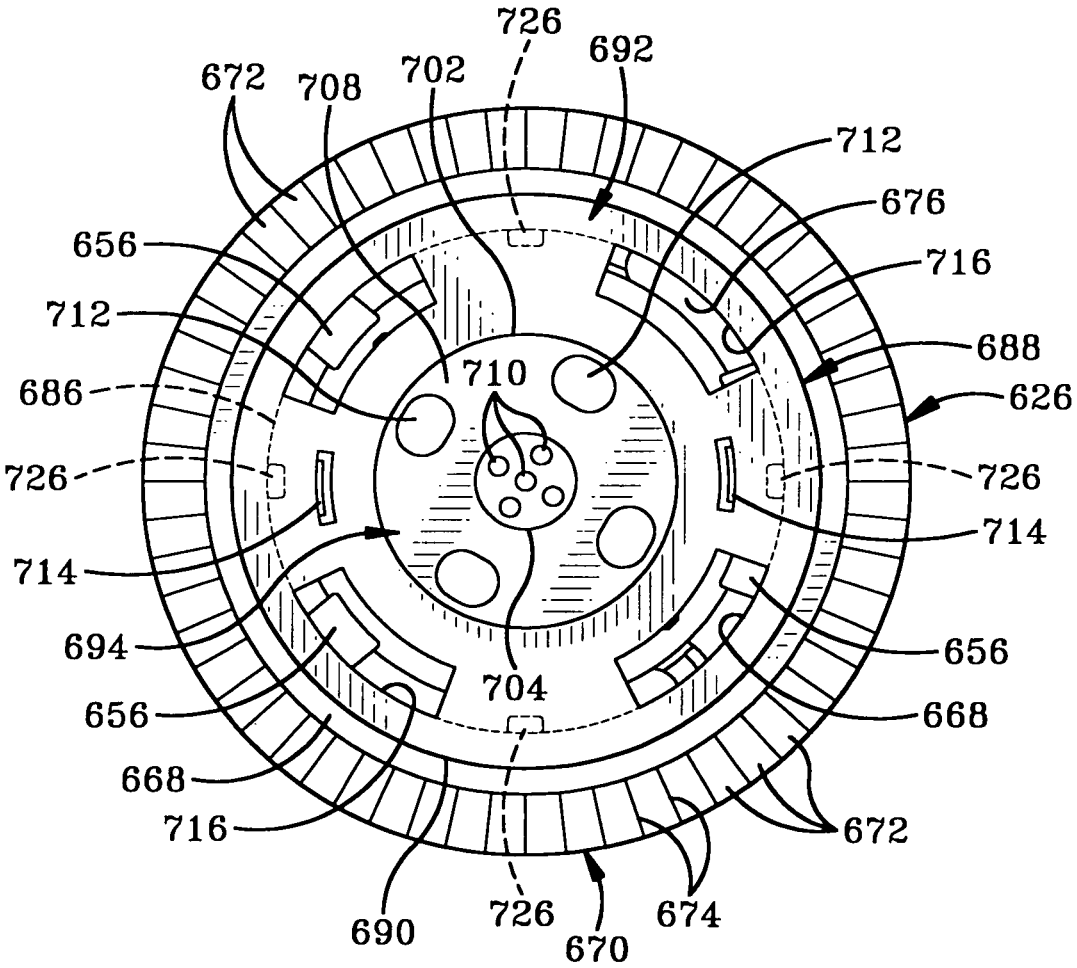
FIG. 57 is a bottom plan view of the gear disc seated atop the locking disc as they would appear when the tightening mechanism is assembled.
Figure 58:
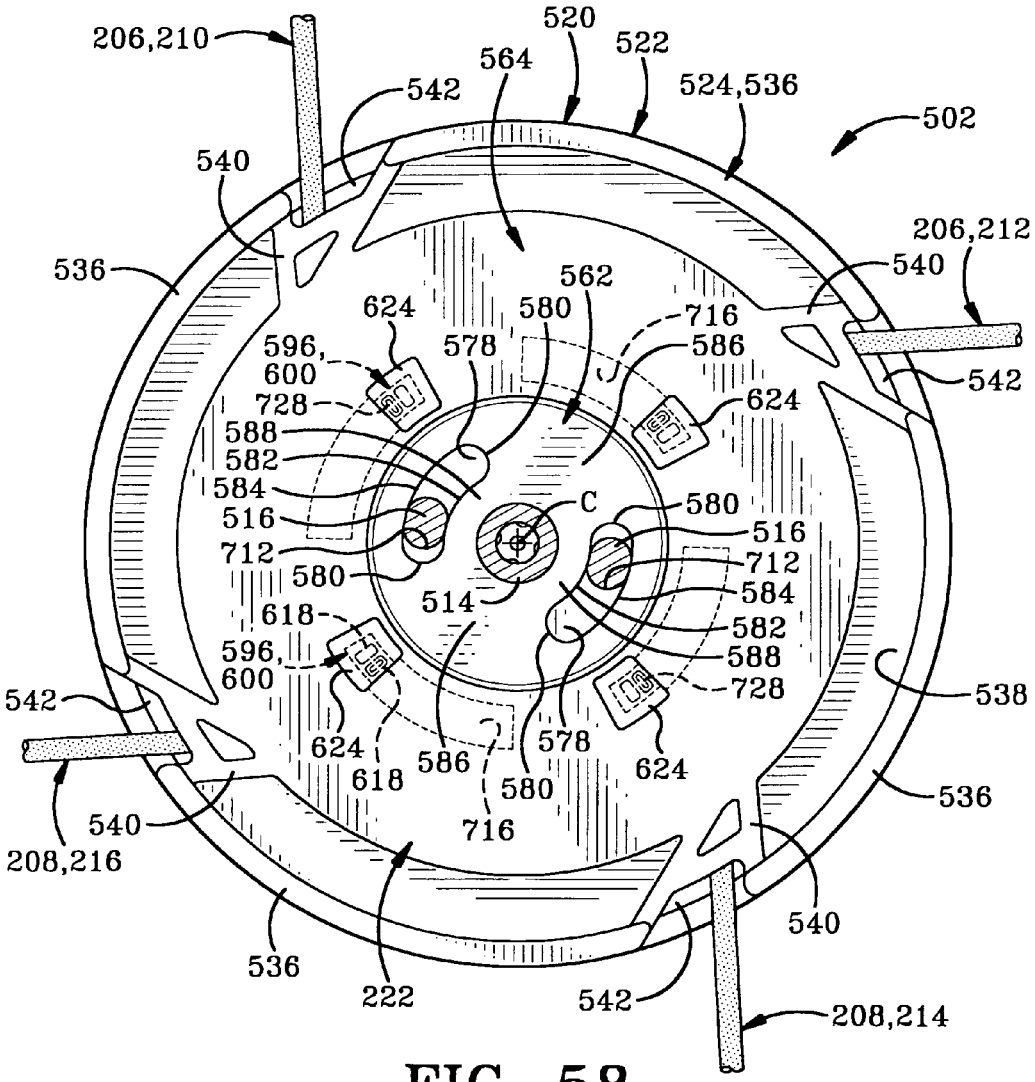
FIG. 58 is a bottom plan view of the tightening mechanism with the end of the key member shown in section inserted into the bottom openings of the housing in the locked position.
Figure 61:
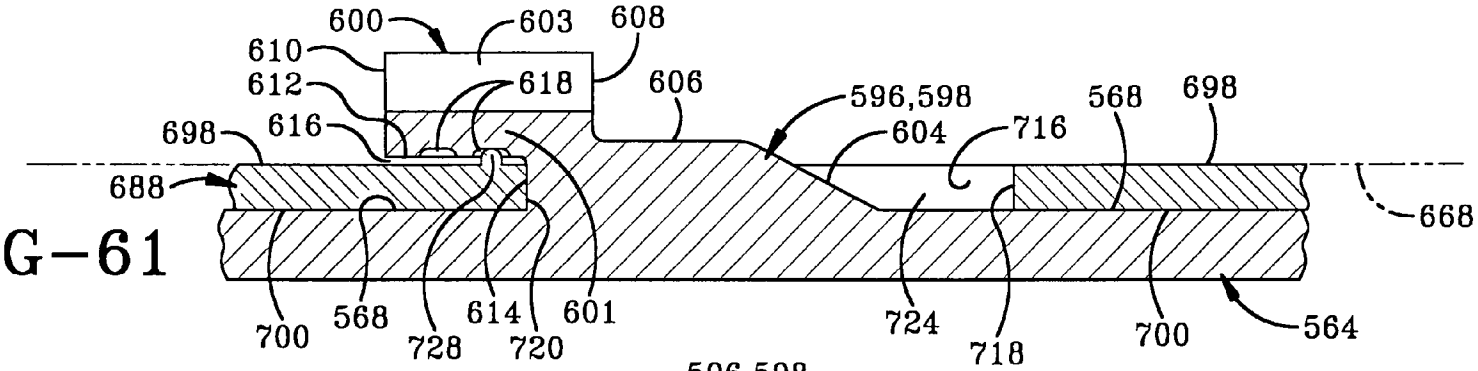
FIG. 61 is a sectional view taken on line 61-61 of FIG. 60 showing one of the interference members, one of the ramps and a portion of the locking disc in the locked position.

A plurality of prong receiving holes 712 is formed in disc 688 extending upwardly from bottom surface 708 of lower wall 694 to top surface 698 of main wall 692. Holes 712 typically have a mating configuration with the ends of prongs 516 for receiving said prongs therein when prong 514 is received in opening 706. Holes 712 are spaced radially outwardly from axis C approximately the same distance as the respective arcuate openings 578 in bottom component 520 so that a pair of holes 712 aligns respectively with the pair of openings 578 when device 500 is assembled, as illustrated in FIG. 58. A pair of optional connector projections 714 extend upwardly from top surface of main wall 692 and may be used to secure locking disc 688 to the bottom of gear disc 626 although this is typically primarily used for assembly without affecting the function of the device. Four circumferentially spaced projection-receiving arcuate slots 716 are formed in main wall 692 adjacent and radially inwardly of outer perimeter 690. Each slot 716 is defined by an inner perimeter having first and second opposed radially extending circumferential ends 718 and 720, a convexly curving inner edge 722 and a concavely curving outer edge 724. Ends 718 and 720 define therebetween a circumferential width of slot 716 which is slightly greater than that of each projection 596 (FIGS. 51, 52, 61) of bottom component 520 of housing 522. Inner and outer edges 722 and 724 define therebetween a radial width which is also slightly greater than that of the respective projection 596. First and second ends 718 and 720 serve as stop engaging surfaces. Projections 596 are received respectively within arcuate slots 716. Inner edges 722 are arcs of a common circle which is concentric about axis C, as are outer edges 724. Four guide projections 726 extend upwardly from top surface 698 respectively circumferentially midway between each adjacent pair of slots 716. Projections 726 lie along a common circle which is concentric about axis C such that the radially outermost portion of each projection 726 lies on such a concentric circle having a diameter D9 (FIG. 55) which is slightly less than the diameter defined by inner perimeter 686 (FIGS. 54, 57, 59) of outer annular wall 654. Thus, guide projections 726 are received within annular space 676 as shown in FIG. 57 closely adjacent or in contact with inner perimeter 686 in order to properly position locking disc 688 and gear disc 626 relative to one another. In addition, guide projections 726 slidably engage inner perimeter 686 during relative rotation of discs 688 and 626 about axis C. Four detent projections 728 also project upwardly from top surface 698 respectively adjacent and circumferentially spaced from respective second ends 720 of slots 716. Detent projections 728 are configured to be received within detents 618, as illustrated in FIGS. 60, 60A and 61. Like guide projections 726, detent projections 728 project upwardly into annular space 676 when device 500 is assembled.

Figure 57A:
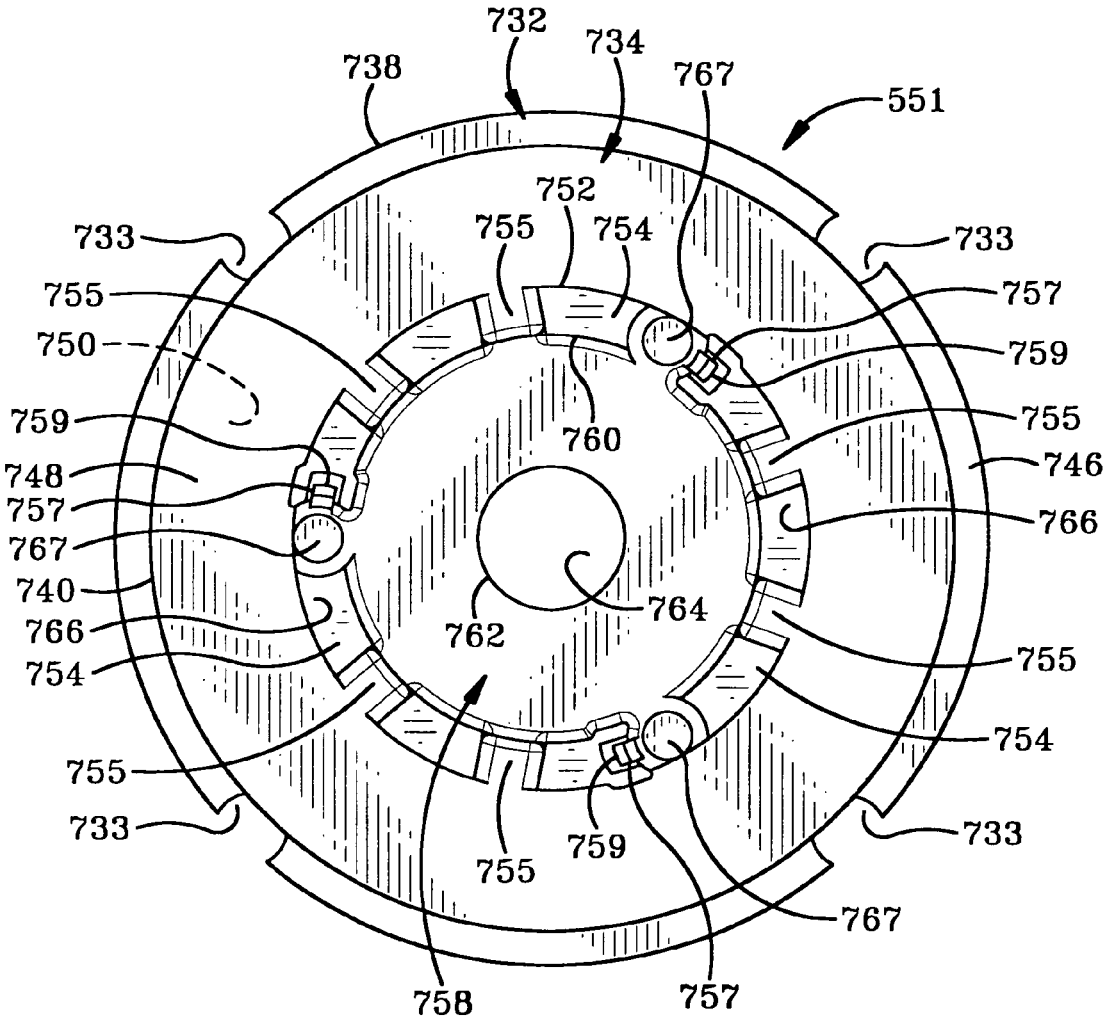
FIG. 57A is a bottom plan view of the spool.

Spool 551 is now described in greater detail with reference to FIGS. 57A and 59. Spool 551 is a rigid internal member and is configured similar to the spools of the previous embodiments with regard to the connections between the ends of cable loops 206 and 208, and thus some portions of spool 551 are not shown in greater detail. Spool 551, typically formed of a rigid plastic material, has a central cylindrical hub 730 with upper and lower flanges 732 and 734 secured respectively to the top and bottom of hub 730 and extending radially outwardly therefrom in a substantially horizontal direction. More particularly, hub 730 includes an outer substantially cylindrical annular wall 736 from which upper and lower flanges 732 and 734 extend radially outwardly to respective outer perimeters 738 and 740. Flanges 732 and 734 have respective top surfaces 742 and 744, and respective bottom surfaces 746 and 748. Upper flange 732 defines four notches 733 which are respectively at 90° to one another and extend inwardly from outer perimeter 738 and from top surface 740 to bottom surface 746. Bottom surface 748 is seated atop annular upper surface 558 of bottom component 520 whereby bottom surface 748 slidably engages upper surface 558 during rotation of spool 551 relative to the housing. Outer perimeter 740 defines an outer diameter of lower flange 734 which is slightly smaller than diameter D2 (FIG. 52) defined by inner perimeter 556 whereby outer perimeter 740 is closely adjacent or in abutment with inner perimeter 556 whereby there may be a sliding engagement between the two perimeters during rotation of spool 551. Outer perimeter 738 defines an outer diameter of upper flange 732 which is somewhat greater than that of lower flange 734. Outer perimeter 738 is adjacent and spaced radially inwardly of inner perimeter 552 of upper segment 534 of sidewall 524. The outer perimeter of outer cylindrical wall 736, top surface 744 and bottom surface 746 define therebetween a cable receiving space 750 in which the cables are windingly received around the hub of spool 551 whereby the cables may be wound on to the spool to tighten the cable around an object or package when spool 551 is rotated in a cable tightening direction, and loosened by unwinding the cable from the spool when the spool is rotated in the cable loosening direction. Outer wall 736 has an inner perimeter 752 (FIG. 59) which defines a diameter which is slightly larger than outer diameter D7 (FIG. 53) of annular ridge 632 which is defined by outer perimeter 655.

Figure 63:
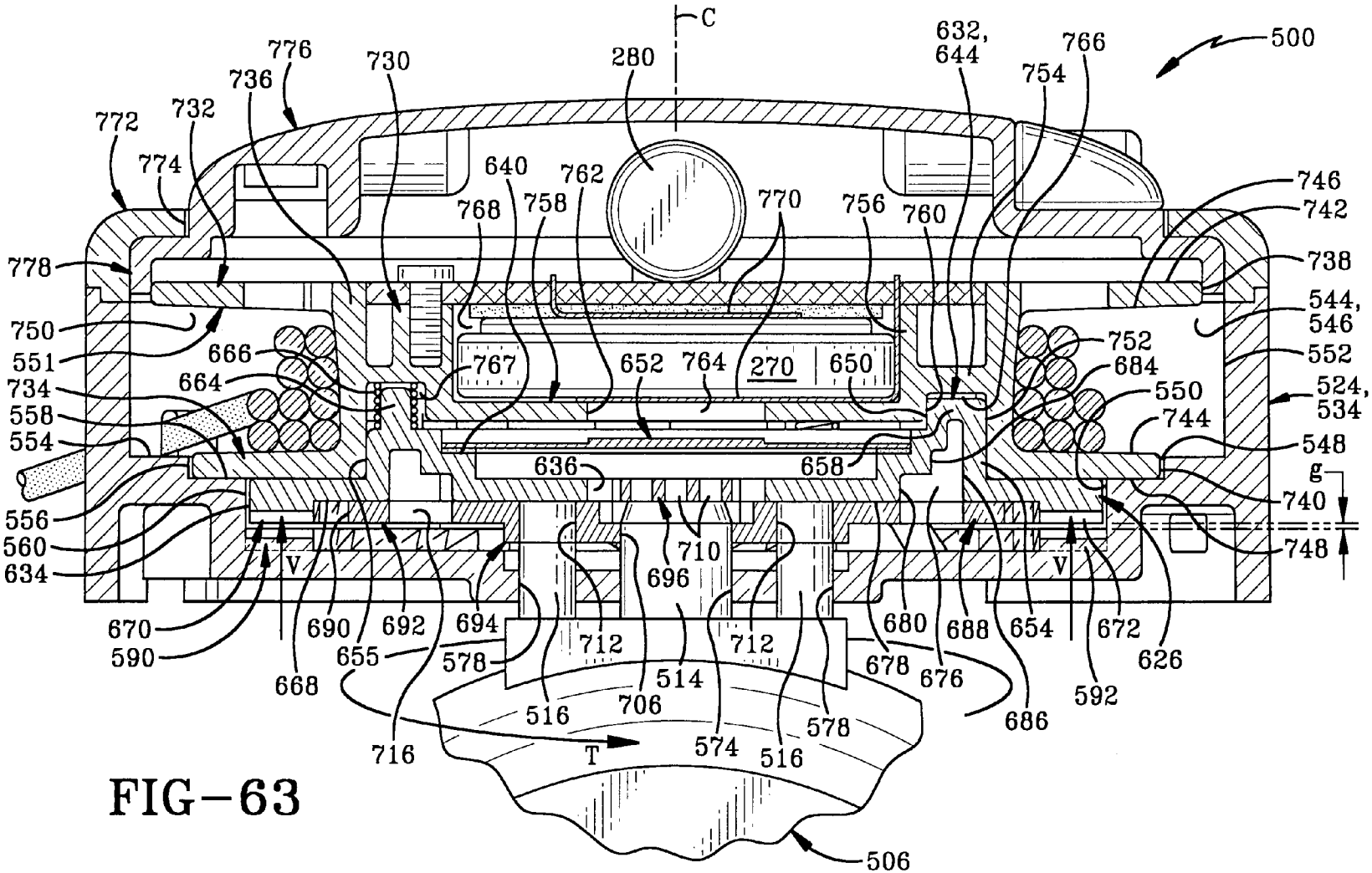
FIG. 63 is a sectional view of the tightening mechanism in the unlocked position shown in FIG. 62 showing the locking disc and gear disc moved upwardly.
Figure 64:
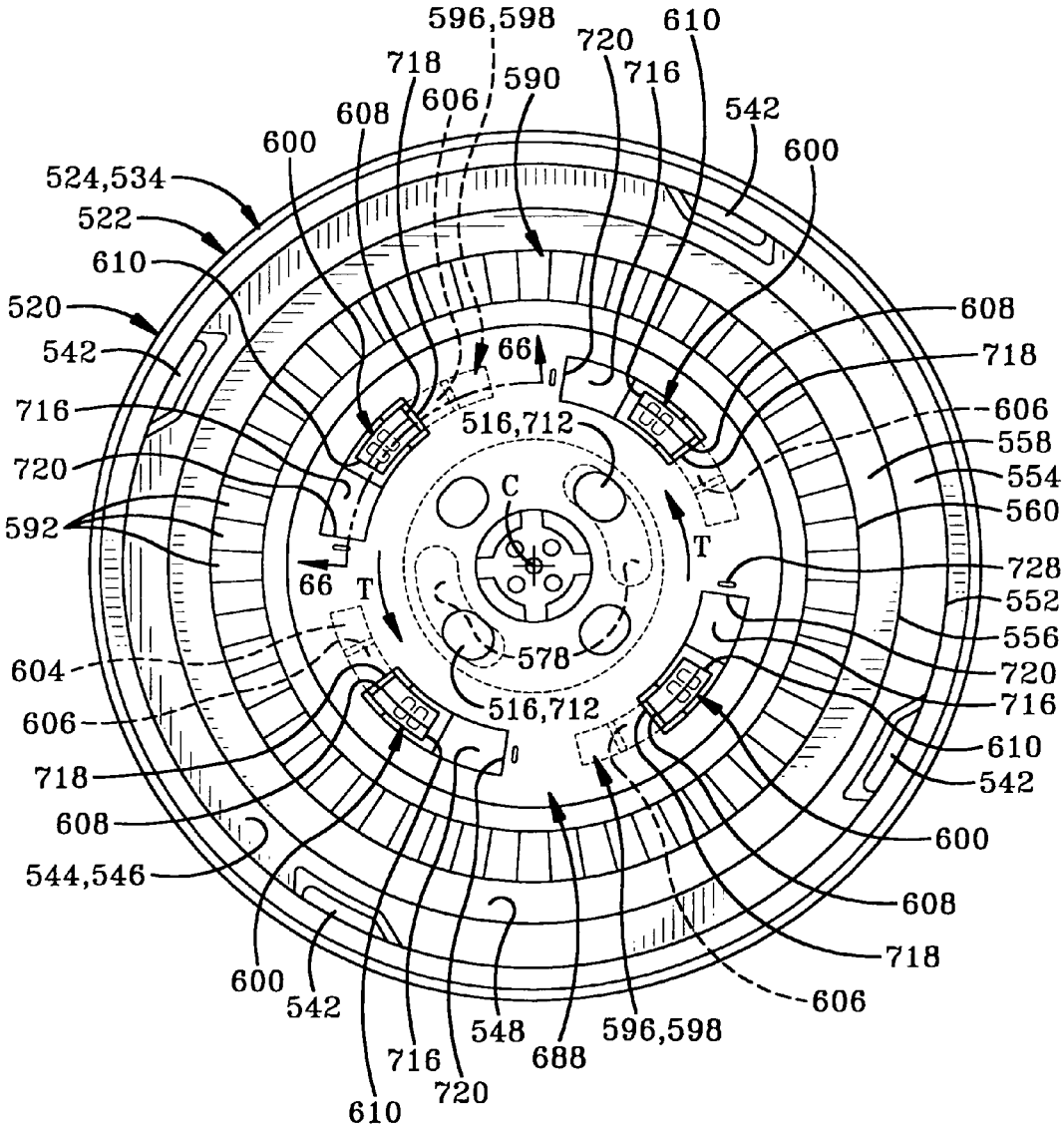
FIG. 64 is a top plan view similar to FIG. 60 showing the locking disc in the unlocked and retained position.

Hub 730 (FIG. 59) further includes a horizontal annular connector wall 754 which is rigidly secured to and extends radially inwardly from inner perimeter 752 generally midway between the top and bottom of outer wall 736 to a rigid connection with an inner vertical annular cylindrical wall 756 of hub 730, which extends upwardly and downwardly in opposite directions from connector wall 754. A flat horizontal circular annular wall 758 of hub 730 is rigidly secured to and extends radially inwardly from the bottom of inner wall 756, and has outer and inner perimeters 760 and 762, the latter defining a central hole 764 through which axis C passes. An annular circular ridge receiving cavity or space 766 is defined between outer diameter 760 and inner diameter 752 with the top of space 766 being defined by the bottom of connector wall 754. The upper portion of annular ridge 632 is thus receivable within annular space 766 via its bottom entrance opening when gear disc 626 moves upwardly to its disengaged position shown in FIG. 63 such that top step 644 is received within annular space 766 and is closely adjacent connector wall 754 with inner perimeter 650 closely adjacent or engaging outer perimeter 760.

Six vertical circumferentially spaced projections or posts 755 (FIG. 57A) extend vertically downwardly from horizontal connector wall 554 into annular space 766 and have bottom surfaces which communicate with and are at the same height as bottom surface 748 of lower flange 734. Projections or posts 755 are respectively received within post receiving holes 656 (FIGS. 53, 54). More particularly, posts 755 extend vertically downwardly into the respective openings 656 such that gear disc 626 is vertically movable relative to spool 551 with projections 755 disposed within openings 656. The circumferential opposed sides or edges of each post 755 abut the respective circumferential edges defining the respective openings 656 to serve as stops to prevent rotation of gear disc 626 relative to spool 551, whereby disc 626 rotates with spool 551 about axis C.

In addition, three cylinders extend downwardly from connector wall 754 to respectively define cylindrical spring receiving openings 767 which respectively receive the top ends of springs 666. Openings 767 are circumferentially spaced from one another equally and are also circumferentially spaced from posts 755. Three connector projections 757 are also secured to the respective cylinders defining openings 767 and extend vertically downwardly therefrom with snap tabs 759 extending a short distance circumferentially outwardly from the bottom of the respective projections 757. During assembly, annular ridge 632 of disc 626 is inserted vertically upwardly into annular space 766 of spool 551 (as shown in FIG. 59) so that projections 757 move vertically upwardly into respective openings 663 and snap tabs 759 form a snap fit engagement with respective latch ledges 655 (FIG. 54) in order to hold gear disc 626 to spool 551 with springs 666 simultaneously biasing gear disc 626 downwardly relative to spool 551.

The top surface of annular wall 758 and the inner perimeter of inner wall 756 define therewithin a battery receiving cavity 768 in which battery 270 is disposed below the top and bottom surfaces 742 and 746 of upper flange 732 and above the upper and lower surfaces 744 and 748 of lower flange 734. Upper and lower battery contacts 770 are also disposed at least partially within cavity 768 in electrical communication with battery 270. Battery 270 is thus configured to power the various electronic components of device 500, such as speaker 652 and other components which were described with reference to the previous embodiments.

With continued reference to FIG. 59, housing 522 further includes a rigid annular top wall 772 which is rigidly secured to the top of bottom component 520 and extends radially inwardly therefrom to an inner perimeter 774 defining a top entrance opening of an interior chamber of the housing defined largely by cavity 544 of bottom component 520. Similar to the previous embodiments, device 500 includes a rigid top wall portion 776 having a generally dome-shaped configuration such that an upper portion thereof is disposed within the entrance opening defined by inner perimeter 774 and extends upwardly therefrom. Pivotally mounted on top wall portion 776 is a rigid flip-up handle configured in substantially the same manner as the earlier embodiments. Top wall portion 776 includes a lower annular wall 778 which is secured to the dome-shaped portion adjacent inner perimeter 774, extending radially outwardly therefrom and then vertically downwardly to a terminal end about the same height as the top of bottom component 520. The inner perimeter of annular wall 778 defines a diameter which is slightly larger than that of outer perimeter 738 of upper flange 732. Upper flange 732 is received in the circular space defined by the inner perimeter of annular wall 778 with outer perimeter 738 disposed closely adjacent or in contact with the inner perimeter of annular wall 778. Upper flange 732 is connected to annular wall 778 so that top wall portion 766 and spool 551 rotate together about axis C relative to housing 522. It is noted that top wall portion 776 has four projections or tabs (not shown) which are adjacent and radially inward of annular wall 778 and which are respectively received within openings 733 (FIG. 57A) such that top wall portion 766 and spool 551 rotate together about axis C when manual rotational force is applied to the flip up handle on top wall portion 776.

The operation of device 500 is described with reference to FIGS. 58-68. When cable-linking member 504 has been unlocked so that fastener 508 is removed from base or key member 506 whereby device 500 is in its unsecured position shown in FIG. 49, prongs 514 and 516 of key member 506 may be inserted through the respective holes or openings 574 and 578 in bottom component 520 and holes 706 and 712 in locking disc 688, as shown in FIGS. 58 and 59. In accordance with one feature of the invention, interference members 600 are configured to prevent the unlocking of tightening mechanism 502 during the simple application of an upward force (arrows S in FIG. 59) on locking disc 688 by preventing the upward movement of locking disc 688 and gear disc 626, which thus helps prevent effective tampering and theft which might otherwise occur as a result. More particularly and with reference to FIG. 61, the downwardly facing bottom surface 612 of interference member 600 engages top surface 698 of locking disc 688 and/or detent projection 728 to prevent upward movement of gear disc 688 in response to the upward force (Arrow S in FIG. 59) applied by key member 506 or a tampering device.

Figure 65:
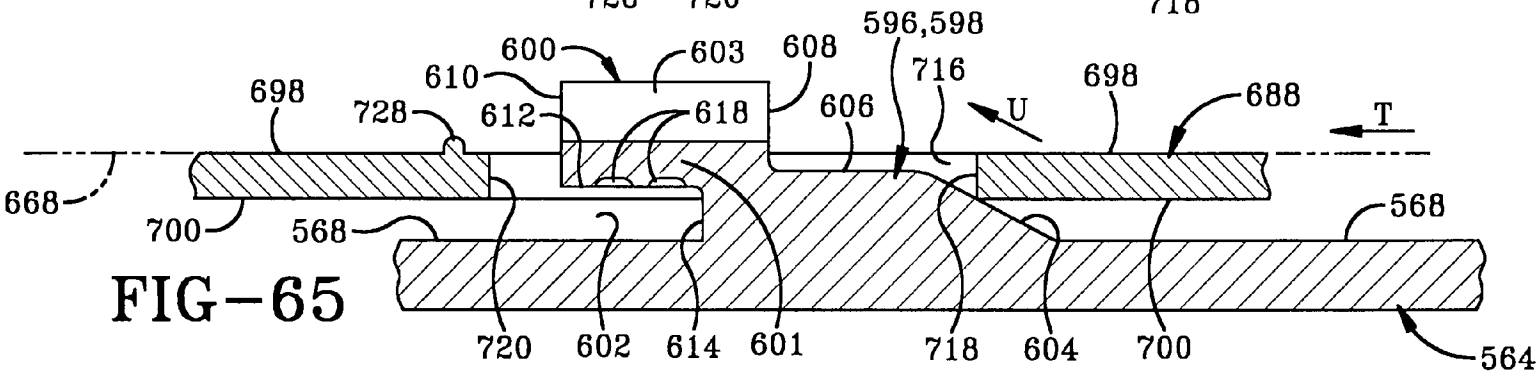
FIG. 65 is similar to FIG. 61 and shows the locking disc having moved out of the unlocked position and sliding up the ramp toward the unlocked and retained position.
Figure 66:
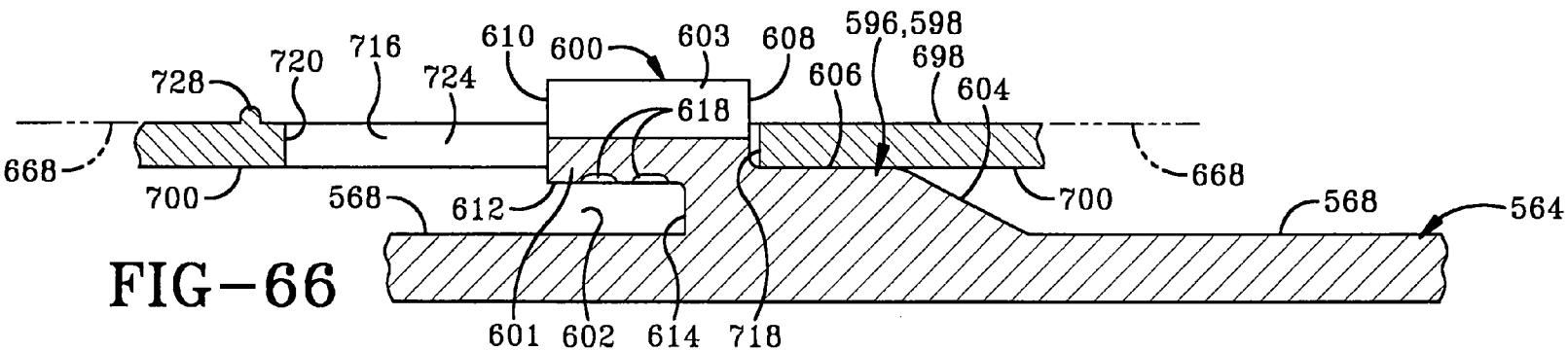
FIG. 66 is a sectional view taken on line 66-66 of FIG. 64 showing the locking disc having rotated to the unlocked and retained position.
Figure 62:
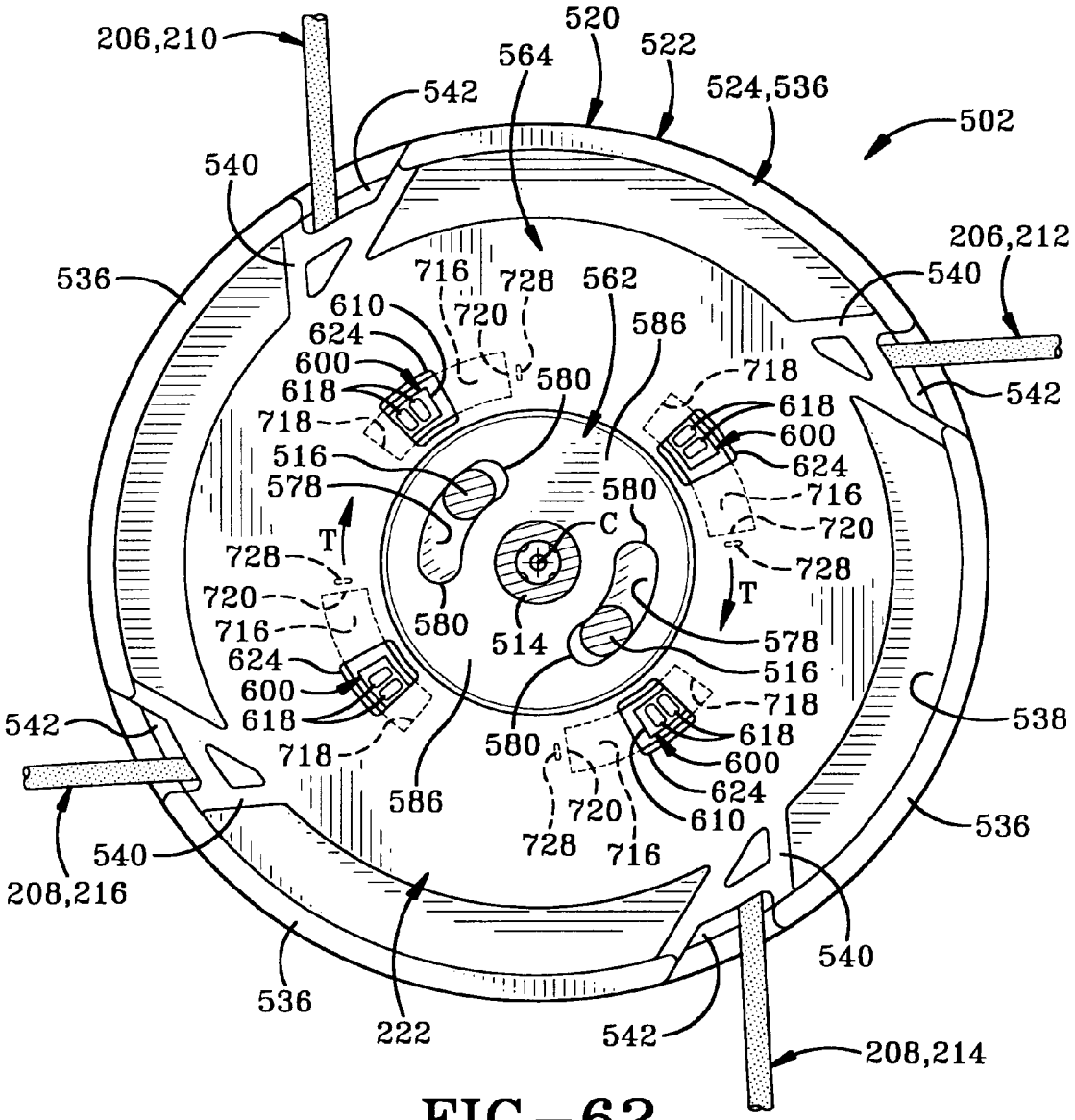
FIG. 62 is a bottom plan view of the tightening mechanism showing the key member and locking disc having been rotated to the unlocked position.

In order to eliminate the interference to the upward movement of locking disc 688 created by interference member 600, disc 688 must first be rotated about axis C in the cable loosening direction of spool 551, as illustrated by arrows T in FIGS. 62-65. More particularly, the user manually rotates key member 506 such that prong 514 rotates about axis C within holes 574 and 706 while prongs 516 rotate within arcuate slots 578 along the arcuate paths thereof. During this rotation, prongs 516 engage the vertical inner perimeters defining the respective openings 712 in locking disc 688 in order to rotate disc 688 relative to housing 522, gear disc 626, spool 551, top wall portion 776, and all other components of device 500 other than key member 506. During this rotation, locking disc 688 slidably engages the bottom wall of bottom component 520 and the bottom surface of gear disc 626. A small amount of resistance to this rotational movement is provided by detent projections 728 within respective detents 618. However, this detent interface is only intended to prevent disc 688 from inadvertently rotating out of the locked position, and thus this relatively minimal resistance is easily overcome by manual rotation of key member 506. It is noted, as illustrated in FIG. 61, that stop engaging surface 720 of disc 688 abuts stop 614 in order to limit or prevent rotation of locking disc 688 in the cable tightening direction of spool 551 when the locking disc and gear disc are in the lowered locked position. Rotation of locking disc 688 in the cable loosening direction indicated by arrows T (FIGS. 62, 65) moves surface 720 out of contact with stop 614 such that surface 720 and the portion of top surface 698 which was disposed directly below bottom surface 612 in the locked position (FIG. 61) moves out from under the downwardly facing surface 612 (FIGS. 65, 66). At the same time, locking disc 688 adjacent the intersection of its bottom surface 700 and first end 718 of opening 716 slides upwardly along ramp 604 (FIG. 65) to move bottom surface 700 adjacent end 718 atop seating ledge 606 and so that end 718 of abuts stop 608 to prevent further rotation. Arrow U in FIG. 65 more particularly shows the sliding movement of gear disc 688 along ramp 604 during rotation of disc 688.

The rotational movement of locking disc 688 is thus translated to upward movement of disc 688 via its sliding engagement with ramp 604. The combined rotational and upward movement of gear disc 688 thus means that any given reference point on disc 688 travels upwardly along a helical path which lies along an imaginary cylinder concentric about axis C. Once bottom surface 700 of disc 688 reaches the intersection of the top of ramp 704 and seating surface 606, the upward spiral movement of disc 688 stops as the rotation continues along a horizontal plane with a sliding engagement between bottom surface 700 and seating ledge 606 until surface or end 718 abuts stop 608. During this rotational and upward movement of disc 688, disc 688 moves from a first position in which the bottom surface 700 is seated on and engages top surface 568 (FIG. 61) to a second position in which bottom surface 700 is seated on and engages seating ledge 606 (FIG. 66), and thus out of contact with top surface 568. The upward movement of locking disc 688 causes the vertical non-rotational upward movement of gear disc 626 (arrows V in FIG. 63) as the top surface of locking disc 688 pushes upwardly on the bottom surface of gear disc 626. This upward movement of key member 506, locking disc 688 and gear disc 626 thus includes an upward force sufficient to overcome the downward spring bias created by springs 666. Locking disc 688 and gear disc 626 thus are moved upwardly from the locked position (FIG. 59) to the unlocked position (FIG. 63) such that set 670 of teeth 672 are disengaged from set 590 of teeth 592.

Figure 67:
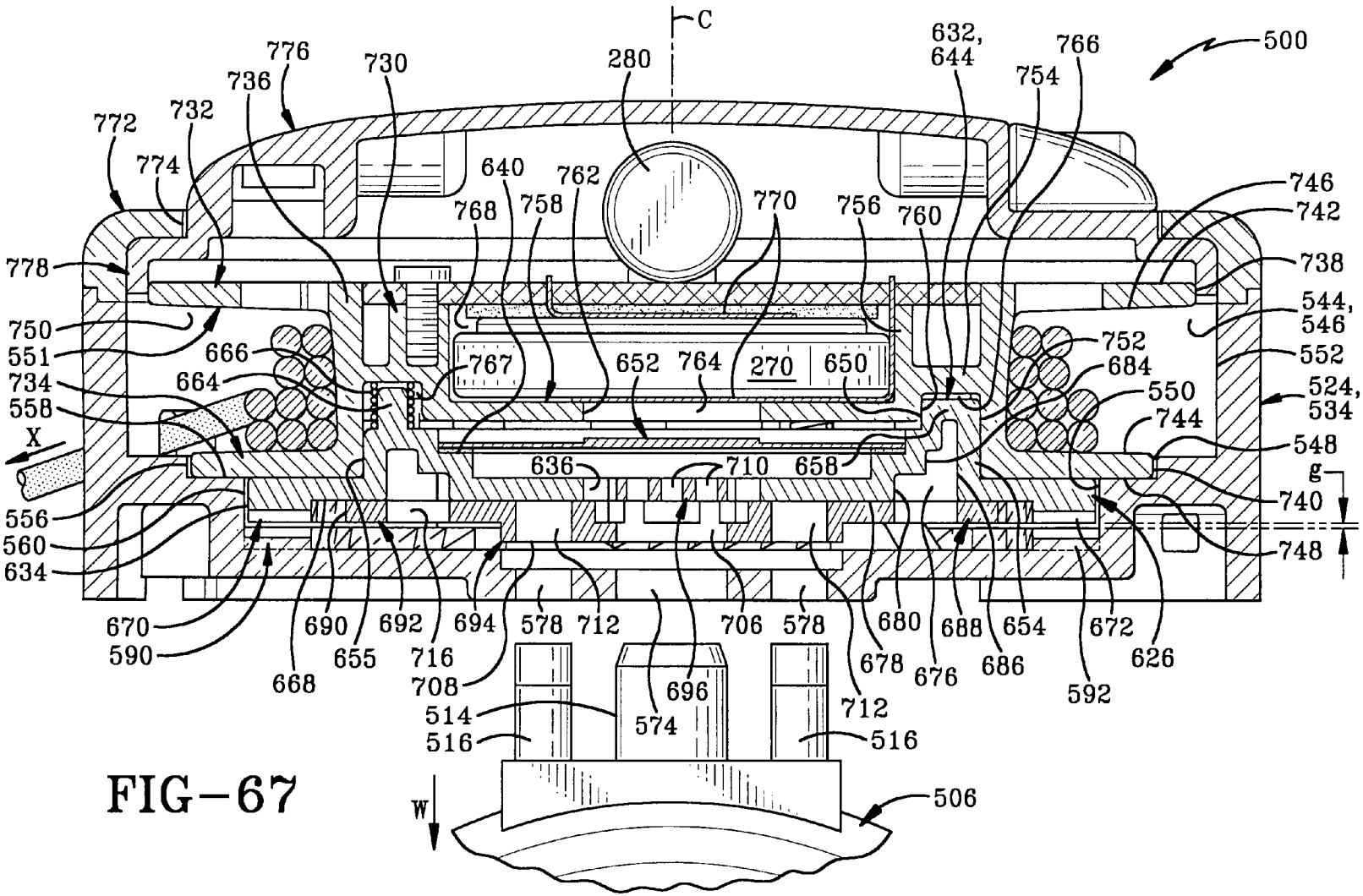
FIG. 67 is a sectional view similar to FIG. 63 showing the tightening mechanism in the unlocked and retained position with the key member having moved out of contact with the locking disc and away from the tightening mechanism.

Locking disc 688 and gear disc 626 are retained in the unlocked position by the seating (FIG. 66) of the downwardly facing horizontal bottom surface 700 of locking disc 688 atop the upwardly facing horizontal retaining or seating ledges 606, which provide an interference to downward movement of these two discs despite the downward bias of springs 666. The disengagement of teeth 672 from teeth 592 is illustrated by gap g in FIG. 63, which more particularly illustrates that said teeth are completely separated from one another. Gear disc 626 is likewise spaced upwardly entirely from the bottom wall of bottom component 520. FIG. 67 illustrates that even after key member 506 is moved downwardly (arrow W) out of contact with the tightening mechanism such that prongs 514 and 516 are removed from their respective openings in the housing and so forth whereby key member 506 no longer applies upward or rotational force on locking disc 688, seating ledges 606 still retain the locking disc and gear disc in the unlocked position. FIG. 67 also illustrates that when these two discs are in the unlocked position, the cables may be pulled outwardly away from the housing as indicated at arrow X in order to unwind the cables from spool 551 as it rotates in the cable loosening direction along with gear disc 626. During this cable loosening rotation, the bottom of gear disc 626 slidably engages the top of locking disc 688. The frictional engagement between the two discs thus applies a rotational force on locking disc 688 in the cable-loosening or unwinding direction. However, locking disc 688 cannot rotate in the unwinding direction in the unlocked position due to the engagement of edge 718 with stop 608, as illustrated in FIG. 66. Locking disc 688 thus remains fixed with regard to the housing during this unwinding rotation of spool 551, gear disc 626, and other components such as top wall portion 776, springs 666, speaker 652, battery 270, contacts 770 and so forth.

When the user wishes to secure device 500 to another item of merchandise package 2 (FIGS. 47-48), the tightening mechanism is positioned adjacent the package with the cables wrapped therearound and the base and fastener 506 and 508 are locked to one another on the opposite side of the package from the tightening mechanism. To tighten the cables about the package, the flip-up handle is flipped to its up or raised position shown in FIG. 68 so that the user can manually apply rotational force on the handle in the cable tightening direction (arrows Y) to rotate the top wall portion 776, spool 551 and gear disc 626 in the cable tightening direction in order to wind the cables (arrows Z) back on to spool 551. Device 500 provides an automatic return from the unlocked position to the locked position which is initiated by the rotation of spool 551 in the cable tightening direction. More particularly, rotation of the spool and gear disc 626 in the cable tightening direction applies a rotational force in the cable tightening direction on locking disc 688 via the frictional engagement between the bottom of gear disc 626 and the top of locking disc 688, whereby locking disc 688 is likewise rotated in the cable tightening direction the short distance needed to move locking disc 688 from its position seated atop seating ledges 606 (FIG. 66) until locking disc 688 comes into contact with ramps 604. At this point, the vertical downward force applied by springs 666 on locking disc 688 via gear disc 626 is translated into rotational movement of locking disc 688 in the cable tightening direction via the sliding engagement between disc 688 and ramps 604. In the exemplary embodiment, the force provided by springs 666 is sufficient to rotate gear disc 688 all the way into the locked position illustrated in FIG. 61 whereby the respective portions of disc 688 are moved into undercuts 602 directly below bottom surface 612 with each projection 728 within one of detents 618 and typically with each end 720 abutting or closely adjacent the respective stop 614. Gear disc 626 is thus moved downwardly during this automatic return from the unlocked position of FIG. 63 to the locked position of FIG. 59 such that teeth 672 and 592 engage one another again to prevent rotation of the spool in the cable loosening direction while allowing for rotation in the cable tightening direction. The combined rotational and downward movement of gear disc 688 during the automatic return thus means that any given reference point on disc 688 travels downwardly along the helical path previously discussed where the helical path lies along an imaginary cylinder concentric about axis C. This rotational and downward movement of disc 688 during the automatic return is thus the opposite of movement of disc 688 during its movement from the locked position to the unlocked position whereby such a reference point travels along the helical path in a corresponding opposite direction, or in other words, in a reverse spiral.

Figure 56:
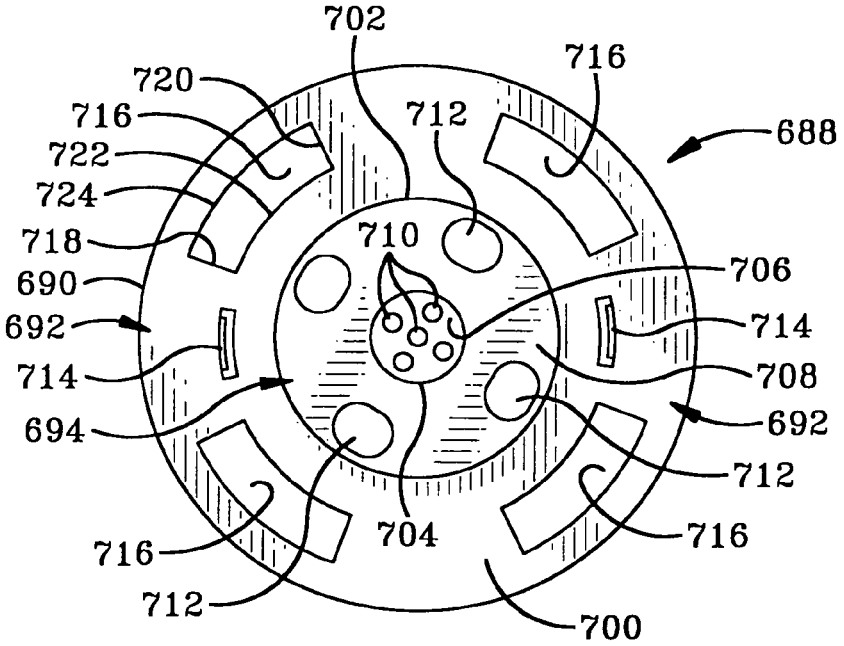
FIG. 56 is a bottom plan view of the member in FIG. 55.
Figure 69:
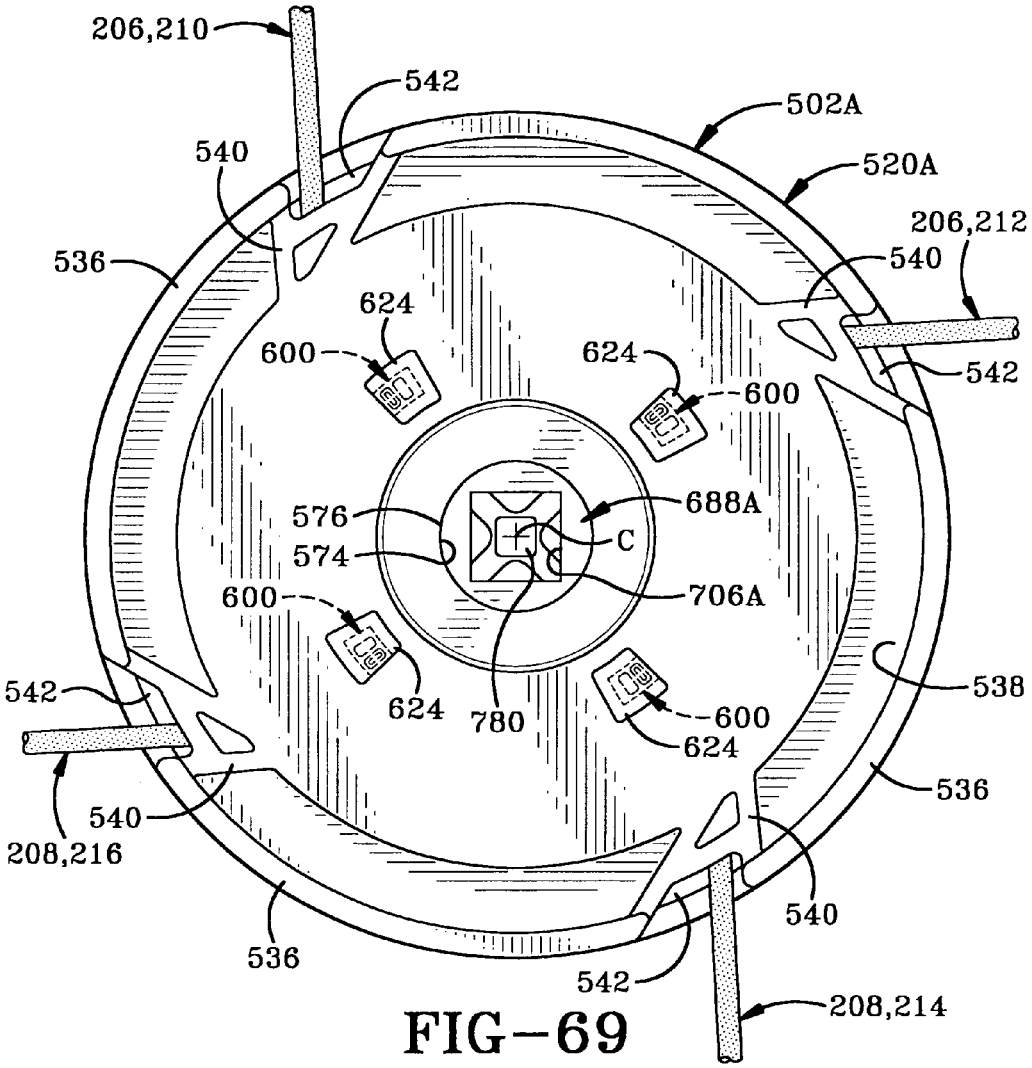
FIG. 69 is a bottom plan view of a modified tightening mechanism having only a single hole for receiving a modified key member.
Figure 70:
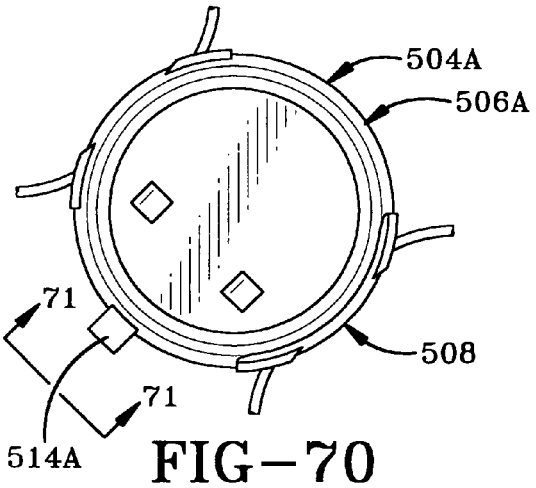
FIG. 70 is a top plan view of the modified key member/cable-linking member.
Figure 71:
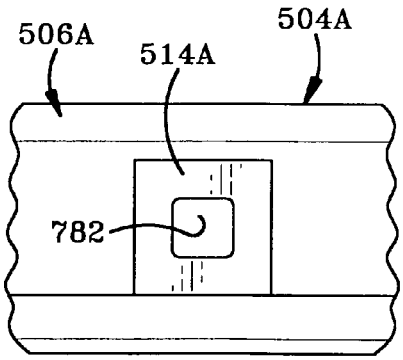
FIG. 71 is a side elevational view taken on line 71-71 of FIG. 70 showing an end view of the modified key member.

FIG. 69 shows an altered or modified tightening mechanism 502A which is very similar to tightening mechanism 502 and operates in substantially the same manner. FIGS. 70 and 71 show an alternate locking member or cable-linking member 504A which in particular has a modified base or key member 506A which is lockably connected to fastener 508 in the same manner as described with reference to member 504. Returning to FIG. 69, tightening mechanism 502A includes a modified bottom component 520A and a modified locking disc 688A. Bottom component 520A is modified only in that it eliminates arcuate openings 578 (FIGS. 50, 51) while retaining central opening 574 defined by inner perimeter 576. In keeping with this modification, locking disc 688A has been modified to eliminate prong receiving holes 712 and to provide a square or other non-circular prong receiving opening 706A instead of the circular opening 706 of disc 688 (FIG. 56). In the exemplary embodiment, locking disc 688A includes a square post 780 which projects downwardly centrally within opening 706A. As illustrated in FIGS. 70 and 71, key member 506A includes a square or otherwise non-circular key prong 514A which extends outwardly from the main body of the key member and defines therein a square opening or cavity 782. The hollow square configuration of projection 514A is of a mating configuration with opening 706A and post 780 such that the square inner perimeter defining opening 706A is only slightly larger than the outer perimeter defining the square shape of prong 514A, and the square inner perimeter defining opening 782 is only slightly larger than the outer perimeter defining the square post 780. Thus, prong 514A is received within opening 706A while post 780 is received within opening 782. This non-circular configuration of prong 514A and opening 706A thus allows rotation of key member 506A to drive rotation of locking disc 688A, unlike the circular configuration of prong 514 and opening 706, which thus further utilize prongs 516 within openings 712 to provide this capability. Other than the modifications described in this paragraph, tightening mechanism 502A and cable-linking member 504A operate in the same manner as described above with reference to the cables, tightening mechanism 502 and cable-linking member 504.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first internal member within the housing which is movable relative to the housing between a lowered locked position which prevents rotation of the spool in the cable-loosening direction and a raised unlocked position which allows rotation of the spool in the cable-loosening direction;

a spring which biases the first internal member downwardly to the locked position so that an upward force is required to overcome the downward spring bias to move the first internal member from the locked position to the unlocked position; and an interference member within the housing which selectively prevents movement of the first internal member from the locked position to the unlocked position;

wherein the spool is rotatable relative to the interference member.

2. The device of claim 1 further comprising an upwardly facing surface on the first internal member; and a downwardly facing surface on the interference member which abuts the upwardly facing surface to prevent upward movement of the first internal member.

3. The device of claim 1 further comprising a first opening formed in the first internal member; and wherein the interference member extends upwardly into the opening.

4. The device of claim 3 wherein the first internal member is rotatable about the vertical axis; and further comprising an arcuate edge which defines a portion of the first opening and is concentric about the vertical axis.

5. The device of claim 1 wherein the first internal member is rotatable relative to the housing and spool.

6. The device of claim 5 further comprising a second internal member which rotates with the spool relative to the housing about the vertical axis; and a sliding engagement between the first and second internal members during relative rotation between the first and second internal members.

7. The device of claim 5 further comprising an engaging member within the housing; and a second internal member within the housing which rotates with the spool relative to the housing about the vertical axis and which is movable relative to the spool and housing between a lowered engaging position in which the second internal member engages the engaging member to prevent rotation of the spool in the cable-loosening direction and a raised disengaged position in which the second internal member is disengaged from the engaging member to allow rotation of the spool in the cable-loosening direction; and wherein the second internal member is in the lowered engaged position when the first internal member is in the lowered locked position and in the raised disengaged position when the first internal member is in the raised unlocked position.

8. The device of claim 5 further comprising a first stop within the housing; and wherein the first internal member engages the first stop to limit rotation of the first internal member in a first direction.

9. The device of claim 8 further comprising a second stop within the housing; and wherein the first internal member engages the second stop to limit rotation of he first internal member in a second direction opposite the first direction.

10. The device of claim 1 further comprising a ramp within the housing; and a sliding engagement between the first internal member and ramp to translate rotational movement of the first internal member to upward movement of the first internal member.

11. The device of claim 1 further comprising a ramp within the housing; and a sliding engagement between the first internal member and ramp to translate downward movement of the first internal member to rotational movement of the first internal member.

12. The device of claim 1 wherein the first internal member is rotatable relative to the interference member between first and second positions; and further comprising a detent formed in one of the first internal member and interference member; and a detent projection on the other of the first internal member and interference member which is received in the detent in the first position to prevent the first internal member from inadvertently rotating out of the first position toward the second position.

13. The device of claim 1 further comprising an upwardly facing seating ledge within the housing; and wherein the first internal member in the unlocked position is seated on the seating ledge to prevent downward movement of the first internal member.

14. The device of claim 13 further comprising a ramp adjacent the seating ledge; and a sliding engagement between the first internal member and ramp during movement of the first internal member from the locked position to the unlocked position.

15. The device of claim 1 further comprising an annular space formed in the first internal member; and wherein the interference member is received within the annular space.

16. The device of claim 15 further comprising a second internal member within the housing which is below and rotates relative to the first internal member and housing; and wherein the interference member extends upwardly from below the second internal member into the annular space.

17. The device of claim 16 further comprising a slot formed in the second internal member; wherein the interference member extends upwardly from below the second internal member through the slot into the annular space.

18. The device of claim 1 further comprising a cavity formed in the spool having a bottom entrance opening; and wherein the first internal member comprises an annular ridge which is received within the cavity via the bottom entrance opening.

19. The device of claim 18 further comprising an annular space formed in the annular ridge having a bottom entrance opening; and wherein the interference member is received within the annular space via the bottom entrance opening of the annular space.

20. The device of claim 1 wherein the first internal member is movable relative to the spool.

21. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

an interference member within the housing;

a downwardly facing surface on the interference member;

a first internal member within the housing which is movable relative to the housing between a lowered locked position which prevents rotation of the spool in the cable-loosening direction and a raised unlocked position which allows rotation of the spool in the cable-loosening direction; and an upwardly facing surface on the first internal member;

wherein the first internal member is rotatable between a first position in which the upwardly facing surface is directly below the downwardly facing surface whereby engagement of the upwardly and downwardly facing surfaces prevents movement of the first internal member from the locked position to the unlocked position and a second position in which the upwardly facing surface is not directly below the downwardly facing surface whereby the first internal member is movable from the locked position to the unlocked position;

wherein the spool is rotatable relative to the interference member.

22. The device of claim 21 wherein the first internal member is movable relative to the spool.

23. A security device comprising:

a housing;

a first cable;

a spool within the housing which is rotatable about a vertical axis in a cable-tightening direction to wind the cable thereon and rotatable in an opposite cable-loosening direction to unwind the cable therefrom;

a first internal member within the housing which is movable relative to the housing between a lowered locked position which prevents rotation of the spool in the cable-loosening direction and a raised unlocked position which allows rotation of the spool in the cable-loosening direction;

a second internal member within the housing which rotates with the spool relative to the first internal member and which is movable upwardly and downwardly relative to the spool and housing; and an interference member which selectively engages the first internal member to prevent upward movement of the first and second internal members;

wherein the spool is rotatable relative to the interference member.

24. The device of claim 23 wherein the first internal member is movable relative to the spool.

* * * * *